United States Patent [19]

Kohno et al.

[11] Patent Number: 5,032,499

[45] Date of Patent: Jul. 16, 1991

[54] THERMAL LIGHT-SENSITIVE MATERIAL WITH COMBINATION OF FOG RESTRAINERS

[75] Inventors: Junichi Kohno; Tawara Komamura; Ken Okauchi, all of Tokyo, Japan

[73] Assignee: Konishiroku Photo Industry Co., Ltd., Tokyo, Japan

[21] Appl. No.: 384,911

[22] Filed: Jul. 25, 1989

[30] Foreign Application Priority Data

Aug. 8, 1986 [JP] Japan ..... 61-187089
Jul. 20, 1987 [JP] Japan ..... 62-180856

[51] Int. Cl.[5] ..... G03C 5/54; G03C 1/34

[52] U.S. Cl. ..... 430/566; 430/203; 430/607; 430/611; 430/614; 430/615; 430/617

[58] Field of Search ..... 430/203, 351, 607, 611, 430/614, 615, 559, 562, 566

[56] References Cited

U.S. PATENT DOCUMENTS

| | | | |
|---|---|---|---|
| 3,531,286 | 9/1970 | Renfrew | 96/67 |
| 3,761,270 | 9/1973 | Mauriac et al. | 96/77 |
| 3,764,328 | 10/1973 | Birkeland | 96/67 |
| 3,985,565 | 10/1976 | Gabrielsen et al. | 96/114.1 |
| 4,022,617 | 5/1977 | McGuckin | 96/29 D |
| 4,235,957 | 11/1980 | Kohrt et al. | 430/203 |
| 4,451,561 | 5/1984 | Hirabayashi et al. | 430/611 |
| 4,569,899 | 2/1986 | Inagaki et al. | 430/611 |
| 4,610,954 | 9/1986 | Torigoe et al. | 430/611 |
| 4,614,702 | 9/1986 | Sawada et al. | 430/611 |
| 4,728,600 | 3/1988 | Hara et al. | 430/351 |
| 4,837,141 | 6/1989 | Kohno et al. | 430/203 |
| 4,859,580 | 8/1989 | Aono et al. | 430/203 |

FOREIGN PATENT DOCUMENTS 0218385 4/1987 European Pat. Off. .

*Primary Examiner*—Richard L. Schilling
*Attorney, Agent, or Firm*—Finnegan, Henderson, Farabow, Garrett, and Dunner

[57] ABSTRACT

There is disclosed a thermal developing light-sensitive material comprising a support and, provided thereon, photographic structural layers comprising at least one layer containing light-sensitive silver halide, said photographic structural layer comprising a compound represented by general formula (1);

Formula (1)

$$X_1—L_1—A$$

wherein $X_1$ represents a residual group of a photographic restrainer, $L_1$ is a mere bonding hand or a divalent group and A is selected from the group consisting of a hydrogen atom, an amino group, a hydroxyl group, a carboxyl group or a salt thereof, a sulfo group or a salt thereof and a sulfin group or a salt thereof;

and a compound represented by general formula (2);

Formula (2)

$$X_2—L_2—B$$

wherein $X_2$ represents a residual group of a photographic restrainer, $L_2$ is a divalent group and B is a ballast group.

12 Claims, 1 Drawing Sheet

THERMAL LIGHT-SENSITIVE MATERIAL WITH COMBINATION OF FOG RESTRAINERS

This application is a continuation of application Ser. No. 07,277,503, filed Nov. 28, 1988, now abandoned, which is a continuation of application Ser. No. 07/082,288, filed Aug. 6, 1987, now abandoned.

FIELDS OF THE INVENTION

The present invention relates to a thermal developing light-sensitive material for forming an image by the thermal development, in particular to a thermal developing light-sensitive material, wherein thermal-development-induced fogging (thermal fogging) has been improved.

BACKGROUND OF THE INVENTION

As to thermal developing light-sensitive materials with which developing process can be carried out by the thermal treatment, Japanese Patent Examined Publications No. 4921/1968 and No. 4924/1968 have disclosed light-sensitive materials comprising organic silver salts, silver halides and reducing agents.

With the improved thermal developing light-sensitive materials, the studies to obtain color images by various methods have been described.

For example, U.S. Pat. Nos. 3,531,286, 3,761,270 and 3,764,328 have independently disclosed thermal developing color light-sensitive materials respectively forming a dye image by the reaction of an oxidized product of aromatic primary amine developing agents and a coupler.

In addition, Research Disclosure No. 15108 and No. 15127 issues disclosed thermal developing color light-sensitive materials individually forming a dye image by the reaction of an oxidized product of sulfonamidephenol or sulfonamidaniline derivative color developing agent and a coupler. However, these methods incurred a disadvantage; since an image of reduced silver and a dye image are simultaneously formed on an exposed portion after the thermal development, the dye image accompanies stains. To solve this problem, a method is available, wherein a silver image is removed by a liquid treatment, or wherein only dyes are transferred onto other layers, for example, an image-receiving sheet comprising an image-receiving layer. However, such a method incurs still another problem; it is difficult to distinguish unreacted matter from the dyes to be transferred.

Further, Research Disclosure, No. 16966 disclosed a method involving thermal developing color light-sensitive materials, wherein using organic imino silver salts independently having a dye-portion, imino groups on the exposed portion are removed by the thermal development, whereby a dye image is formed on an image-receiving layer as a transfer paper by the use of solvents. However, in this method a problem occurs; it is difficult to suppress the liberation of dyes on unexposed portions, therefore, well-defined clear color images cannot be obtained.

Additionally, Japanese Patent Publication Open to Public Inspection (hereinafter referred to a Japanese Patent O.P.I. Publication) No. 105821/1977, Japanese Patent O.P.I. Publications No. 105822/1977 and No. 50328/1981, U.S. Pat. No. 4,235,957, Research Disclosure No. 14448, No. 15227 and No. 18137 issues disclosed thermal developing color light-sensitive materials for forming a positive color image by a heat-sensitive silver dye bleaching method. However, this method incurs problems: otherwise unnecessary steps to heat piled sheets independently having an activator to accelerate the bleaching of dye, as well as a photographic constituent material; the obtained dye image is eventually reduced and bleached, in the course of a prolonged storage, by the coexisting free silver and the like.

Furthermore, U.S. Patent Nos. 3,180,732, 3,985,565, 4,022,617 and Research Disclosure No. 12533 disclosed thermal developing color light-sensitive materials to form a color image by using a leuco dye. However, this method also incurs a problem; it is difficult to stably contain leuco dye in a photographic light-sensitive material and the photographic light-sensitive material is gradually discolored during its preservation.

Also, Japanese Patent O.P.I. Publications No. 179840/1982, No. 186744/1982, No. 123533/1982, No. 12431/1984, No. 124339/1984, No. 166954/1984, No. 159159/1984, No. 181395/1984, No. 229556/1984, and the like, have disclosed thermal developing coupler light-sensitive materials discharging or forming a diffusible dye by the thermal development to obtain a transferred color image.

However, these prior arts incurs a disadvantage; a larger density (Dmax) causes a increased fogging (Dmin), whereby a restrainer used in a conventional photographic light-sensitive material not only fails to show restraining effects but even deteriorates fogging, or simultaneously deteriorates Dmax as well as the sensitivity. Accordingly, the development of a restrainer usable in the thermal developing light sensitive material has been eagerly desired The inventor has found that not only the fogging in the thermal development but also the preservability could be simultaneously improved by using a thermal developing light-sensitive material containing a restrainer having a ballast group. However, the degree of the improvement was still insufficient. The inventor also found that if dye-sensitized silver halide emulsions are used, the fogging increases and the sensitivity is reduced during the preservation of the thermal developing light-sensitive materials under a high temperature and a high humidity.

In view of this, the inventors have found that the fogging in the thermal development may be improved by using a thermal developing light-sensitive material containing a restrainer having a hydroxyl group, carboxyl group, sulfon group or sulfin group, or a salt thereof. However, it was learned that this arrangement incurs another disadvantage: the fogging increases during the preservation of the thermal developing light-sensitive material under a high temperature and a high humidity.

SUMMARY OF THE INVENTION

It is an object of the present invention to solve the above disadvantages of the thermal developing light-sensitive material.

More specifically, it is an object of the present invention to provide a thermal developing light-sensitive material containing a novel fogging restrainer.

It is another object of the invention to provide a thermal developing light-sensitive material allowing the formation of the high-density fogging-free image.

It is still another object of the invention to provide a thermal developing light-sensitive material having improved preservability.

The above objects of the invention are attained by a thermal development light-sensitive material comprising a support and, provided thereon, a layer containing light-sensitive silver halide grains, in particular, a thermal development light-sensitive material containing at least one compound selected from those represented by the following general formula (1) and at least one compound selected from those represented by the following general formula (2):

General formula (1)

$$X_1L_1—A$$

[wherein $X_1$ represents a residual group of a photographic restrainer, $L_1$ is a mere bonding band or bivalent group, A represents any of a hydrogen atom, amino group, hydroxyl group, carboxyl group or salts thereof, sulfo group or salts thereof, or sulfin group or salts thereof;]

General formula (2)

$$X_2—L_2—B$$

[wherein $X_2$ represents a residual group of a photographic restrainer, $L_2$ represents a bivalent group and B represents a ballast group.]

Figure 1:
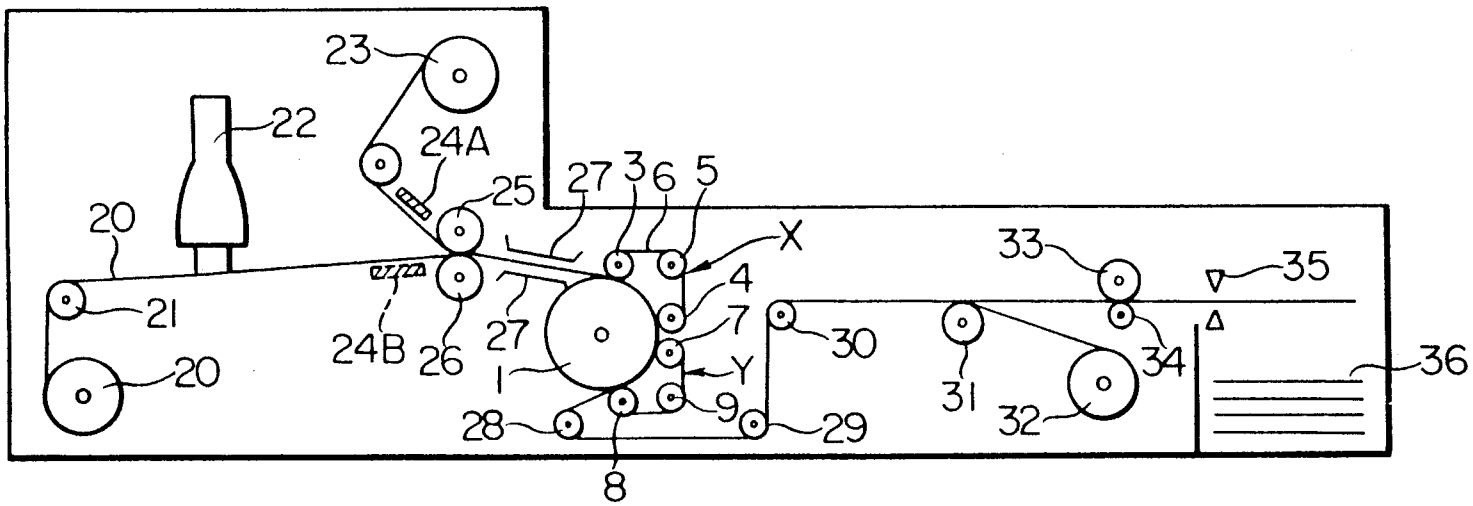
FIG. 1 is a schematic diagram illustrating the outline of thermal developing apparatus to process the thermal developing light-sensitive material of the invention, wherein the reference numerals correspondingly represent the following parts and components.

Reference numeral 1 represents a drum; 3, 4, 7 and 8, pressing rollers; 5 and 9, tension rollers; 6 and 10, belts; 21, a guide roller; 22, CRT; 23, an image receiving member; 24A and 24B, plate heaters; 25 and 26, heating rollers; 27, a guide plate; 28, 29 and 30, guide rollers; 31, a separation roller; 32, a take-in roller; 33 and 34, a transporting roller; 35, a cutter, and; 36, a container.

DETAILED DESCRIPTION OF THE INVENTION

A thermal developing light-sensitive material according to the invention comprises a thermal developing light-sensitive element and an image-receiving element. The thermal developing light-sensitive element is hereinunder referred to as a thermal light-sensitive material or simply as a light-sensitive material; and an image-receiving element is hereinafter called an image-receiving member.

The restrainer represented by the general formula (1) is described in detail below.

The examples of a residue, of photographic restrainer, represented by $X_1$ in the above general formula (1) are residues of organic compounds known a restrainers (or anti-fogging agents) in a conventional silver halide photographic light-sensitive material, and include those described in the following: "The Fundamentals of Photographic Technology, Silver Salt Photography" (compiled by Photographic Society of Japan, published from Corona Ltd.), p. 354; "Chemistry of Photography" (written by Akira Sasai, Shashin Kogyo Shuppan Co., Ltd.), pp. 168–169; The Theory of Photographic Process (edited by T. H. James, published from MacMillan Company), pp. 396–399. Among these examples, those preferred are the residues of the organic compounds of which silver salts have a pKsp (−log Ksp) of more than 10, provided that Ksp is a solubility product thereof in water of 25° C.

The preferred examples of a compound, wherein the residue $X_1$ in the above-mentioned general formula is replaced with $X_1$, are described in the following general formulae (3) through (18).

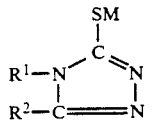

(3)

[wherein $R^1$ and $R^2$ independently represent any of a hydrogen atom, or alkyl group or aryl group each having 1 to 7 carbon atoms, M represents a hydrogen atom, alkali metal atom, ammonium group or organic amine residue.]

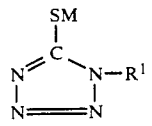

(4)

[wherein $R^1$ represents a hydrogen atom, or alkyl group or aryl group each having 1 to 7 carbon atoms, M is same as that in the general formula (3).]

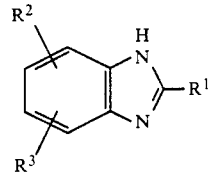

(5)

[wherein $R^1$ represents any of a hydrogen atom, alkyl group having 1–7 carbon atoms, aryl group having 1–7 carbon atoms

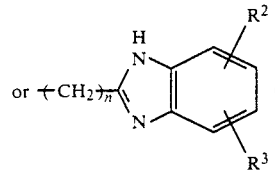

or $+CH_2+_n$ (n is 1 or 2), $R^2$ and $R^3$ independently represent a hydrogen atom, or alkyl group having 1–7 carbon atoms, or aryl group or nitro group having 1–7 carbon atoms, $R^2$ and $R^3$ may be bonded together to form a five-membered or six-membered ring.]

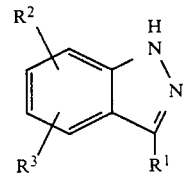

(6)

[wherein $R^1$ represents a hydrogen atom, or alkyl group or aryl group each having 1–7 carbon atoms, $R^2$ and $R^3$ independently represent any of a hydrogen atom, or alkyl group having 1–7 carbon atoms or aryl group having 1–7 carbon atoms, $R^2$ and $R^3$ may be bonded together to form a five-membered or six-membered ring.]

(7)

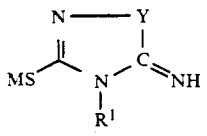

[wherein Y represents

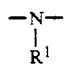

—O— or —S—, $R^1$ represents a hydrogen atom, or alkyl group or aryl groups each having 1-7 carbon atoms, and M is same as that in the general formula (3).]

(8)

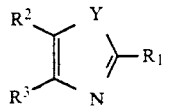

[wherein Y represents —O—, —S—,

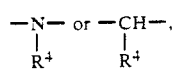

$R^1$ represents a thiol group, or —NH—$R^4$ ($R^4$ represents a hydrogen atom, or alkyl group or aryl group each having 1-7 carbon atoms), $R^2$ and $R^3$ independently represent a hydrogen atom, alkyl group having 1-7 carbon atoms, or aryl group or nitro group having 1-7 carbon atoms, $R^2$ and $R^3$ may be bonded together to form a five-membered or six-membered ring.]

(9)

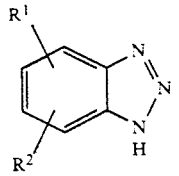

[wherein $R^1$ and $R^2$ independently represent a hydrogen atom, or alkyl group having 1-7 carbon toms, or aryl group having 1-7 carbon atoms, or hydrogen atom, $R^1$ and $R^2$ may be bonded together to form a five-membered or six-membered ring.]

(10)

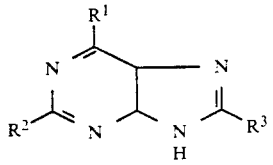

[wherein $R^1$, $R^2$ and $R^3$ independently represent any of a hydrogen atom, alkyl group having 1-7 carbon atoms, amino group, alkoxy group having 1-7 carbon atoms, thioalkoxy group having 1-7 carbon atoms or —SM (M is same as that in the general formula (3).]

(11)

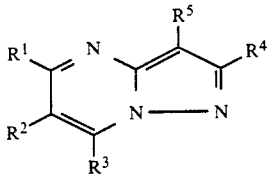

[wherein $R^1$, $R_2$, $R^3$, $R^4$ and $R^5$ independently represent any of a hydrogen atom, alkyl group having 1-7 carbon atoms, aryl group having 1-7 carbon atoms, —NH—$R^6$ ($R^6$ represents a hydrogen atom, alkyl group having 1-7 carbon atoms or aryl group having 1-7 carbon atoms), —SM (M is same as that in the general formula (3)), alkylthio group having 1-7 carbon atoms or alkoxy group having 1-7 carbon atoms.]

(12)

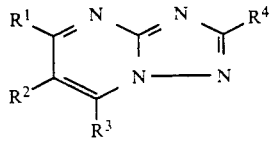

[wherein $R^1$, $R^2$, $R^3$ and $R^4$ are respectively identical to $R^1$ through $R^5$ in the general formula (11).]

(13)

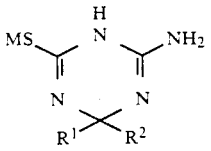

[wherein $R^1$ and $R^2$ independently represent a hydrogen atom, or alkyl group having 1-7 carbon atoms, M is same as that in the general formula (3).]

(14)

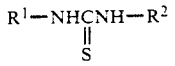

[wherein $R^1$ and $R_2$ independently represent a hydrogen atom, alkyl group or aryl group each having 1-7 carbon atoms, $R^1$ and $R^2$ may be bonded together to form a five-membered or six-membered ring.]

(15)

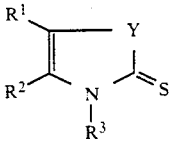

[wherein $R^1$, $R^2$ and $R^3$ independently represent a hydrogen atom, or alkyl group or aryl group each having 1-7 carbon atoms, $R^1$ and $R^2$ may be bonded together to form a five-membered or six-membered ring, and Y represents any of —O—, —S— or

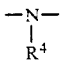

($R^4$ represents a hydrogen atom, or alkyl group having 1-7 carbon atoms.)]

(16)

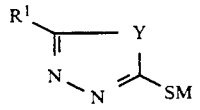

[wherein $R^1$ represents a hydrogen atom, or amino group or alkyl group or aryl group each having 1–7 carbon atoms, Y represents —O—, —S —or

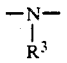

($R^3$ represents a hydrogen atom, or amino group, or alkyl group or aryl group each having 1–7 carbon atoms), and M is same as that in the general formula (3).]

(17)

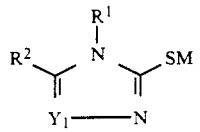

wherein $R^1$ and $R_2$ independently represent any of a hydrogen atom, and acyl group, alkyl group and aryl group each having 1–7 carbon atoms, $R^1$ and $R^2$ may be bonded together to form a five-membered or six-membered ring, Y represents =N— or

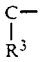

($R^3$ is a hydrogen atom, or alkyl group having 1–7 carbon atoms), and M is same as that in the general formula (3).]

(18)

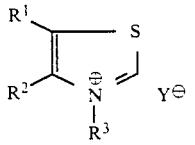

[wherein $R^1$, $R^2$ and $R^3$ are same as those in the general formula (15), and $Y^{(-)}$ represents a pair anion.]

With the general formulae (3) through (18), the preferred residues of photographic restrainer are the nitrogen-containing residues independently having a —SM group (M is a hydrogen atom, alkali metal atom, or ammonium group or organic amine reside), and the photographic restrainer residues represented by the general formula (4) or (8) are particularly advantageous.

In the above general formula (1), $L_1$ represents a bivalent group, and more favorably represents any of the following independently having 1 through 7 carbon atoms: an alkylene group (such as methylene group, ethylene group, propylene group and the like), alkenylene group (such as vinylene group, propenylene group and the like), arylene group (such as p-phenylene group, m-phenylene group, o-phenylene group and the like), imino group, carbonyl group, sulfonyl group, ether group or group comprising the combination thereof (such as alkylenecarbonylamino group, aralkylenamino group, sulfonylamino group and the like).

The compounds according to the invention expressed by the above general formula (1) are preferably those represented by the following general formula (19).

General formula (19)

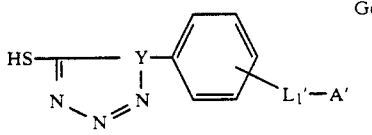

wherein $L_1'$ and A' are the same as $L_1$ and A in the above general formula (1) respectively; Y represents a nitrogen atom or carbon atom.

The typical examples of the compounds according to the invention represented by the above general formula (1) are listed below. However, the scope of the useful compounds according to the present invention are not limited only to them.

(A-1)

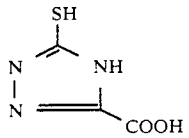

(A-2)

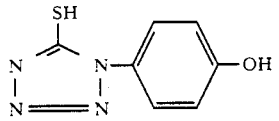

(A-3)

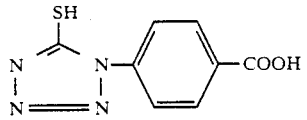

(A-4)

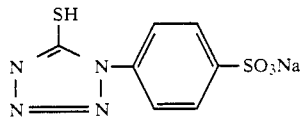

(A-5)

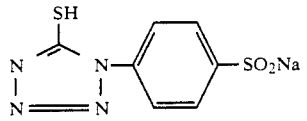

(A-6)

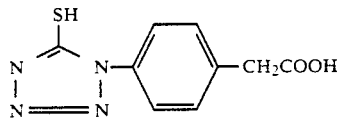

(A-7)

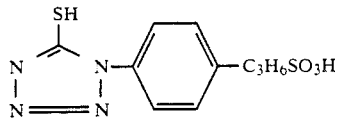

(A-8)

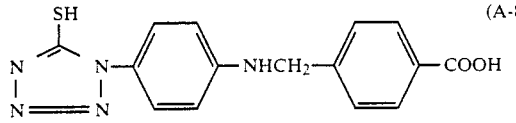

-continued
(A-9)
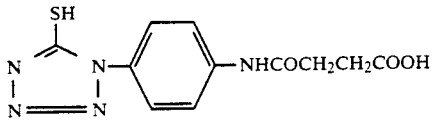
(A-10)
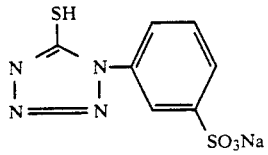
(A-11)
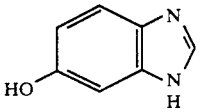
(A-12)
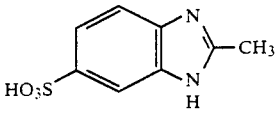
(A-13)
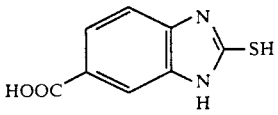
(A-14)
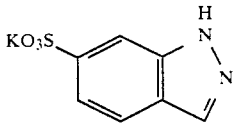
(A-15)
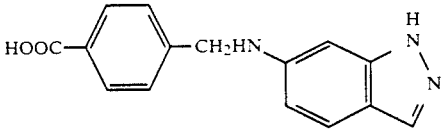
(A-16)
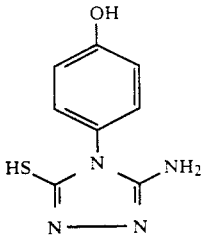
(A-17)
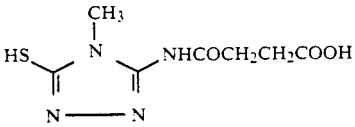
(A-18)
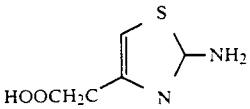
(A-19)
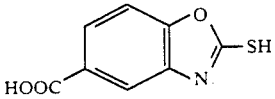
-continued
(A-20)
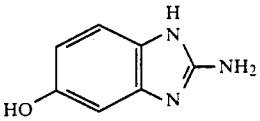
(A-21)
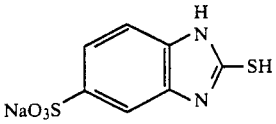
(A-22)
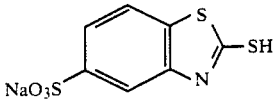
(A-23)
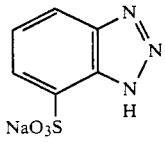
(A-24)
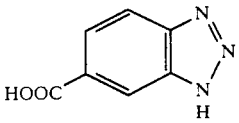
(A-25)
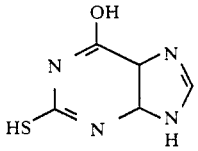
(A-26)
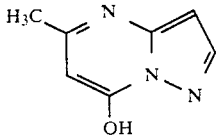
(A-27)
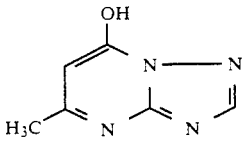
(A-28)
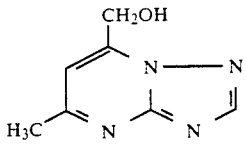
(A-29)
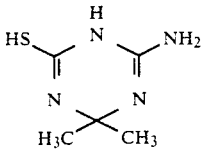
(A-30)
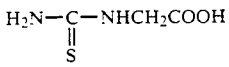
(A-31)
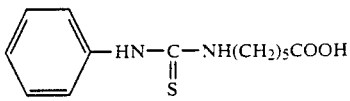

-continued
(A-32)
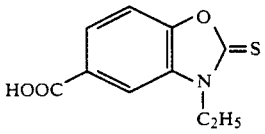
(A-33)
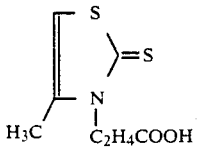
(A-34)
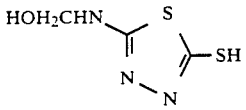
(A-35)
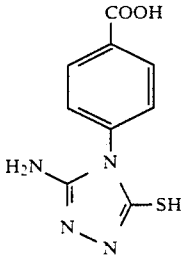
(A-36)
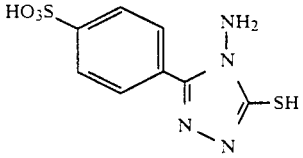
(A-37)
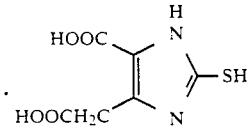
(A-38)
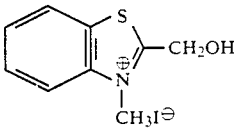
(A-39)
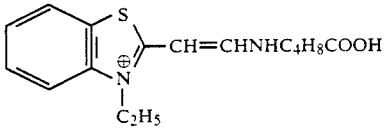
(A-40)
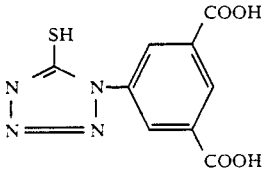
(A-41)
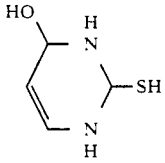
-continued
(A-42)
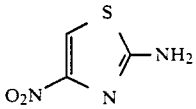
(A-43)
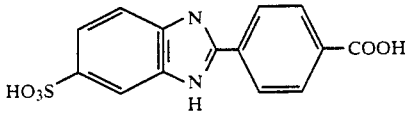
(A-44)
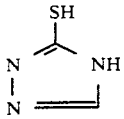
(A-45)
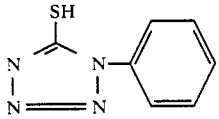
(A-46)
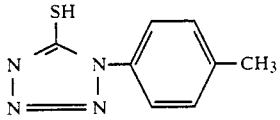
(A-47)
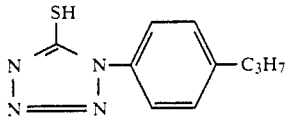
(A-49)
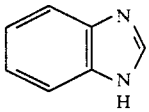
(A-50)
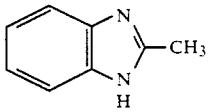
(A-51)
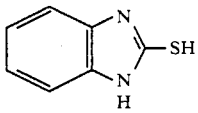
(A-52)
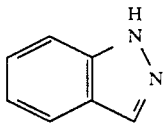
(A-53)
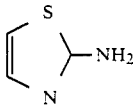
(A-54)
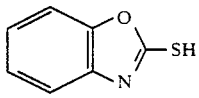

-continued (A-55)

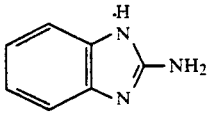

(A-56)

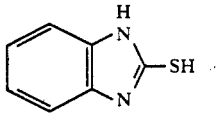

(A-57)

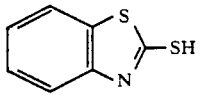

(A-58)

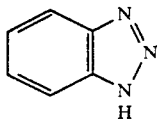

(A-59)

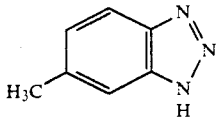

The compounds represented by the above general formula (1) can be synthesized by a conventional method. For example, they can be synthesized with reference to methods disclosed in "Chemische Berichte", 86, pp. 314 (1953); "Canadian Journal of Chemistry", 37, pp. 101 (1959); "Journal of Chemical Society", 49, pp. 1748 (1927); British Patent No.. 1,275,701; U.S. Pat. No. 3,266,897; Japanese Patent O.P.I. Publications No. 89034/1975, No. 28426/1978, No. 21067/1980, No. 111846/1981; and the like.

The amount of addition of the compound according to the invention represented by the general formula (1) is not particularly limited. It may be determined in accordance with the following factors; a type of the compound; whether the compounds are used singly or combinedly; the types, amount, the ratio of mixture of light-sensitive silver halide or organic silver salt, or what types of layers comprise the light-sensitive material of the invention. In general, the preferred amount of addition is $10^{-7}$ to $10^{-1}$, more specifically, $10^{-5}$ to $10^{-2}$ mol per mol light-sensitive silver halide.

The compound of the invention represented by the general formula (1) may be contained in any of the structural layers of the thermal developing light-sensitive material, and may be simultaneously contained in more than two layers. Though contained in the structural layers, usually the light-sensitive layers containing light-sensitive silver halide or the layers containing organic silver salts, the compound may be contained non-light-sensitive layers. When such a compound is incorporated into the silver halide light-sensitive layers, the timing of addition is arbitrarily selected from the period, after the precipitation of silver halide grains used for the above-mentioned light-sensitive layers has been formed following the physical ripening, and before the emulsions containing the light-sensitive silver halide grains are applied by coating. The addition method is arbitrarily selected from those used in incorporating an ordinary compound into emulsions. Accordingly, for example, the compound of the invention is, in the form of acid of salt, firstly solved in water or an organic solvent such as methanol or the like, or in the mix solvent comprising them, then added into emulsions. Additionally, if the compound of the invention can be solved in an organic solvent such as ethyl acetate, cyclohexane or the like, it may be incorporated into the layers, in the form of emulsion.

Next, the restrainers represented by the general formula (2) are specifically described below.

As residues, of photographic restrainer, represented by $X_2$ in the compound represented by the general formula (2), those identical to the examples of $X_1$ in the general formula (1) are available. Among them, the residues, of photographic restrainer, represented by the general formula (4) or (8) are particularly advantageous.

Further, the examples of a bivalent group represented by $L_2$ in the above general formula (2) are identical to those of $L_1$ in the general formula (1). More specifically, the following bivalent groups are available.

—CONH—, —$SO_2$NH—, —NHCONH—,

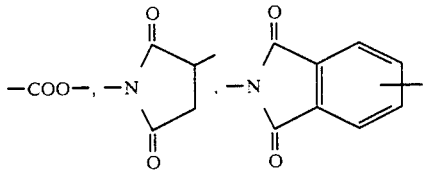

—NHCO—, —$NHSO_2$—, —O—, —S—,

—N—(R is a hydrogen atom or alkyl group) and —$\overset{R}{\overset{|}{C}}$O—.

The ballast groups of the invention represented by B in the general formula (2) are organic ballast groups individually having molecular size and configuration sufficient enough to reduce or eliminate the diffusibility of a compound of the invention represented by the general formula (2) or the silver salt thereof (or silver complex) during the thermal developing process. The typical examples of such an organic ballast group include the following; a long-chained alkyl group bonded to the residue of photographic restrainer represented by $X_2$, directly, or via a bivalent bonding group represented by $L_2$; a benzene or naphthalene aromatic group directly or indirectly fused into a carbon-containing ring or heterocycle of the residue of photographic restrainer. A useful ballast group usually has at least 8 carbon atoms, and more favorably, is an alkyl group (which may have a substituent) having 8 to 40 carbon atoms (if it has a substituent, the number includes the carbon atoms in a substituent).

The useful ballast group is also typified by a group having not only a group having a hydrophilic substituent such as a sulfo group, carboxy group or the like, but a group having an alkyl group (which may have a substituent) containing 8 to 30 carbon atoms.

The preferred examples of ballast group ar listed below.

$-C_{17}H_{35}$, $-C_{15}H_{31}$, $-C_{10}H_{21}$, $-CH_2\underset{\underset{C_2H_5}{|}}{C}H-C_4H_9$, $-(CH_2)_3O(CH_2)_7CH_3$, -continued
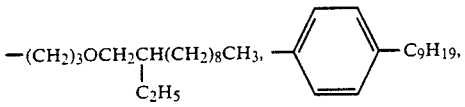
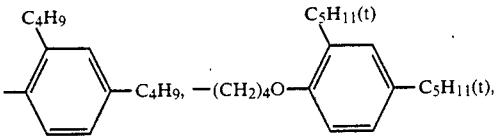
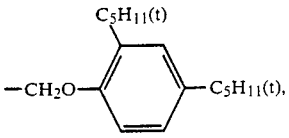
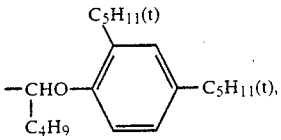
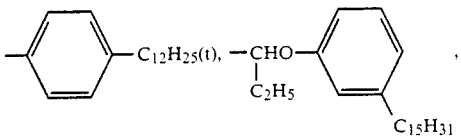
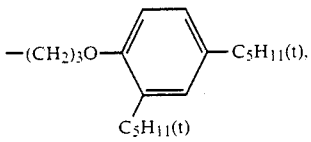
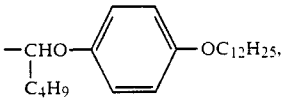
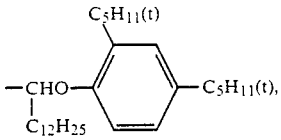
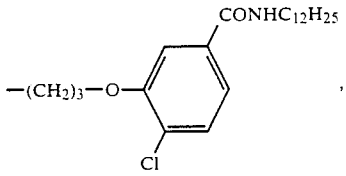
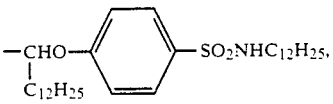
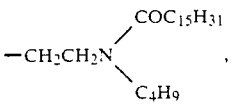
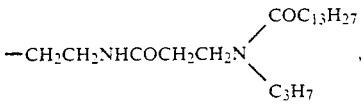
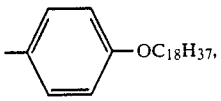
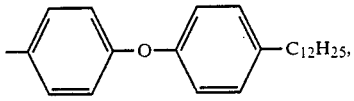
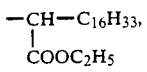
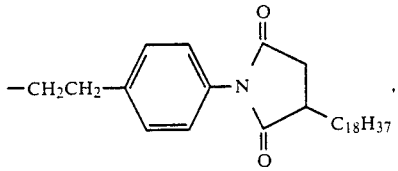
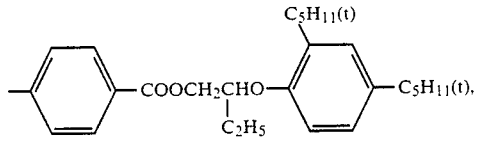
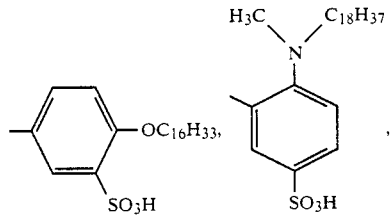
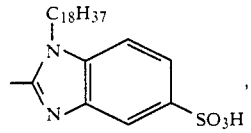
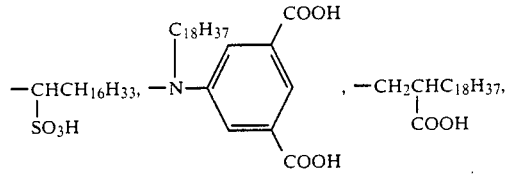
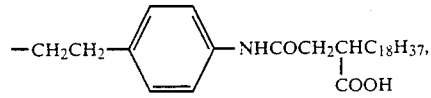
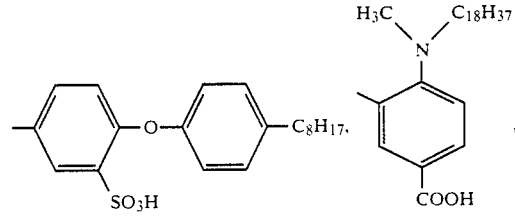
The typical example compounds represented by the above general formula (2) and embodying the invention are listed below. However, the scope of useful compounds of the invention is not limited only to these compounds.
(B-1)
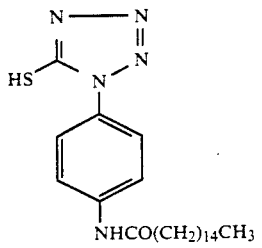
(B-2)
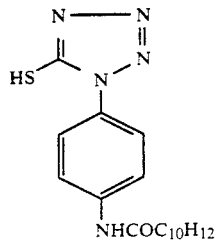
(B-3)
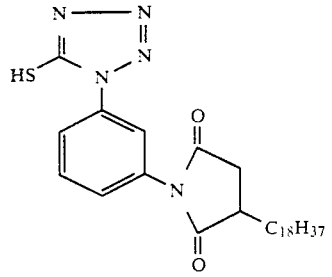
(B-4)
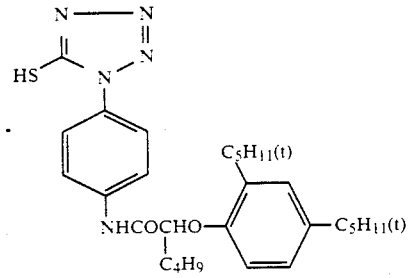
(B-5)
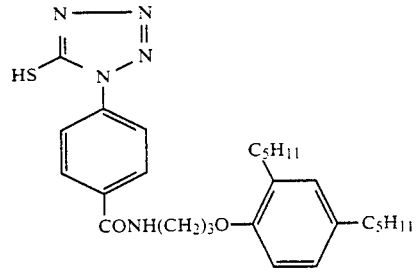
(B-6)
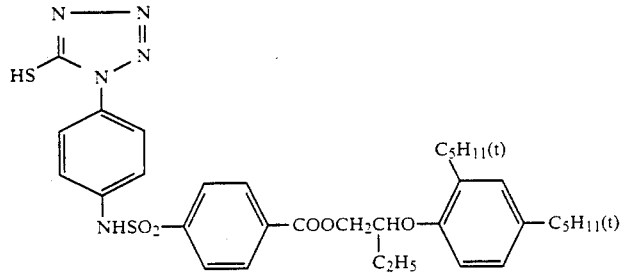

-continued
(B-7)
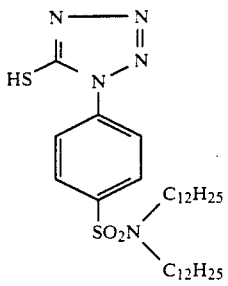
(B-8)
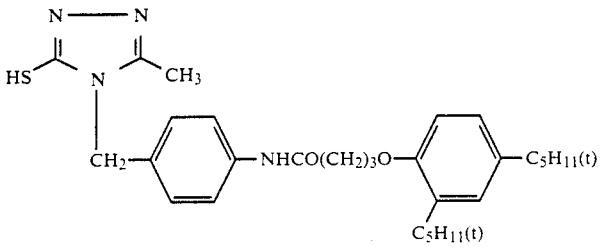
(B-9)
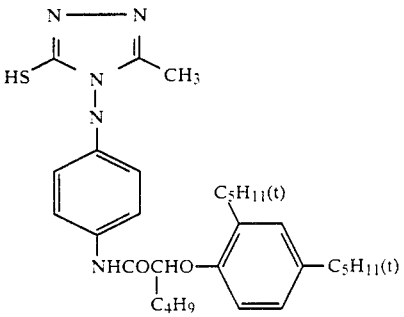
(B-10)
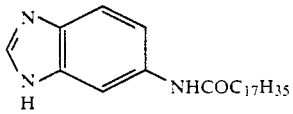
(B-11)
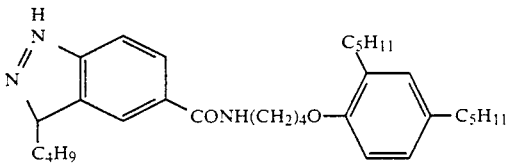
(B-12)
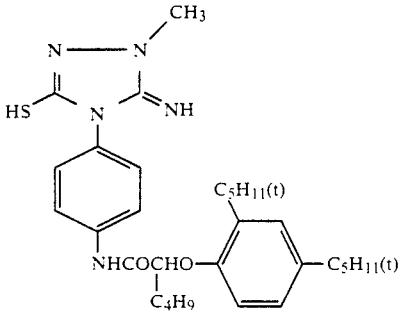

-continued
(B-13)
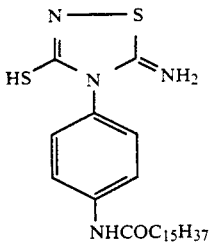
(B-14)
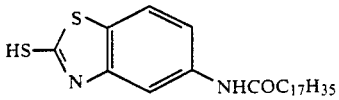
(B-15)
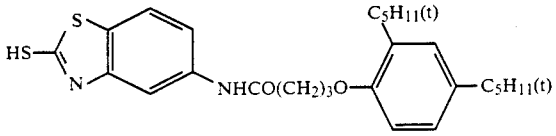
(B-16)
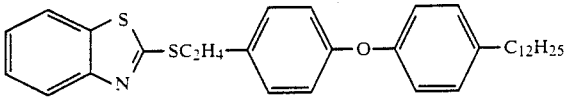
(B-17)
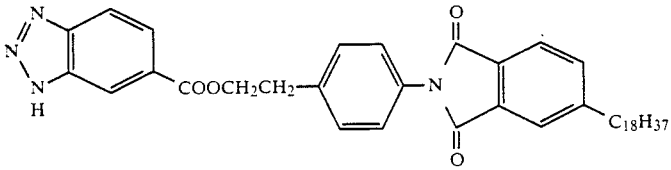
(B-18)
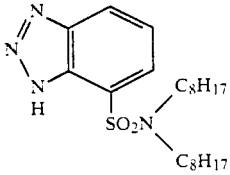
(B-19)
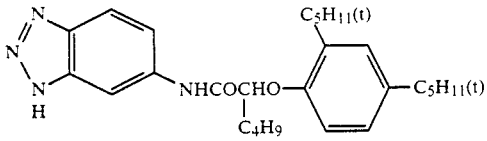
(B-20)
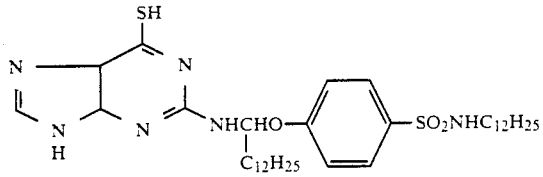
(B-21)
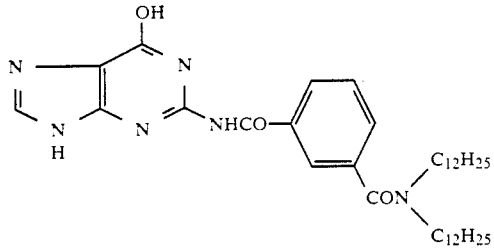

-continued
(B-22)
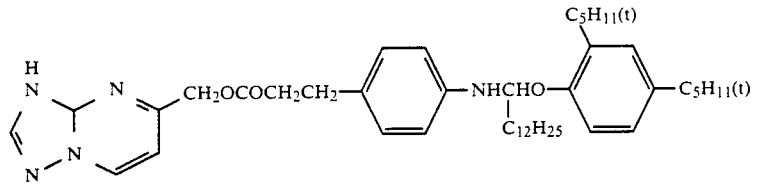
(B-23)
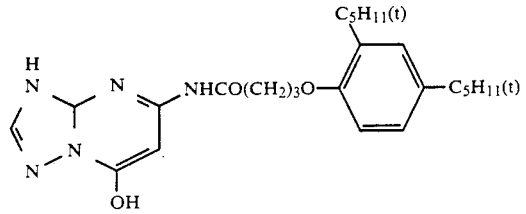
(B-24)
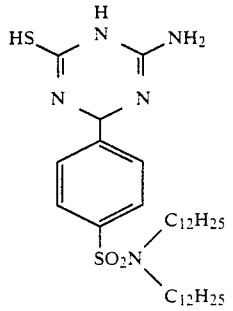
(B-25)
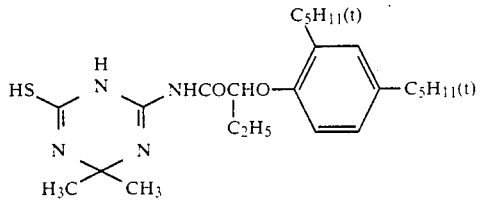
(B-26)
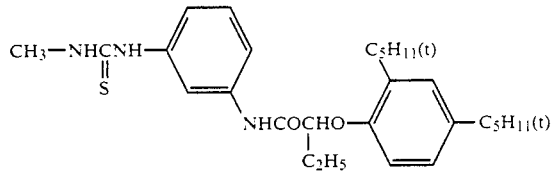
(B-27)
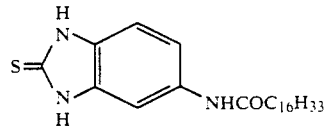
(B-28)
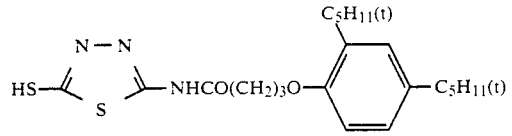
(B-29)
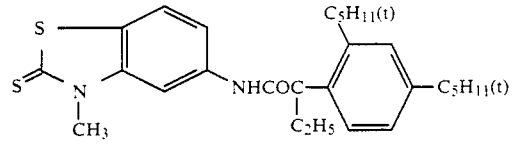

-continued
(B-30)
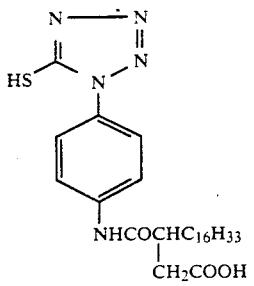
(B-31)
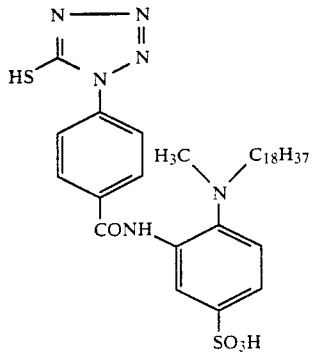
(B-32)
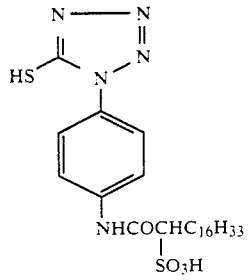
(B-33)
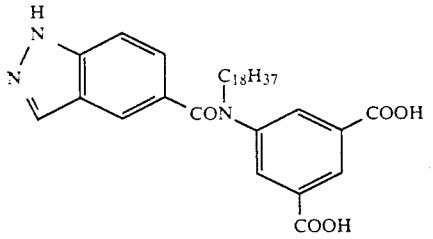
(B-34)
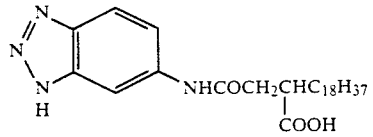
(B-35)
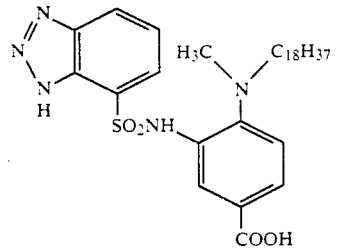

-continued (B-36)

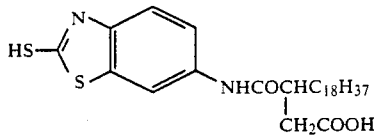

The examples typically demonstrating the synthesization of the compounds of the invention are as follows.

Synthesizing example - 1: Compound (B - 1)

19.3 g of 1-(p-aminophenyl)-1,2,3,4-tetrazol-5-thiol and 20 ml of pyridine were added into 200 ml acetonitrile, thereinto 33 g of palmitoyl chloride was added dropwise with stirring under a room temperature, then the solution was heated and refluxed for one hour, then cooled. This caused crystals to precipitate. The crystals were filtered out and rinsed with cool acetonitrile, then dried, thus 31.5 g (yield, 76%) object product was obtained.

Synthesizing example - 2: Compound (B - 15)

18.2 g of 6-amino-2-mercaptobenzothiazole and 20 ml of pyridine were added into 200 ml acetonitrile, thereinto 50 ml acetonitrile solution containing 35 g of 3-(2,4-di-(t)-pentylphenoxy)-butyric chloride was added dropwise, with stirring under a room temperature, then the solution was heated and refluxed for one hour. The reaction solution was rinsed with water, and the crystals were filtered out, then recrystallized with acetonitrile, thus 33.8 g (yield, 88%) object product was obtained.

The other compounds of the invention may be synthesized with the similar methods.

The amount of addition of the compound according to the invention represented by the general formula (2) is not particularly limited. It may be determined in accordance with the following factors; a type of the compound; whether the compounds are used singly or more than two of them are combinedly used; the types, amount, the ratio of mixture of light-sensitive silver halide or organic silver salt, or; what types of layers comprise the light-sensitive material of the invention. In general, the preferred amount of addition is $10^{-5}$ to $10^{-1}$, more specifically, $10^{-4}$ to $10^{-2}$ mol per mol light-sensitive silver halide.

The compound of the invention represented by the general formula (2) may be contained in any of the structural layers of the thermal developing light-sensitive material, and may be simultaneously contained in more than two layers. However, the compound should be favorably contained in the light-sensitive layers containing light-sensitive silver halide. When such a compound is incorporated into the silver halide light-sensitive layers, the timing of addition is arbitrarily selected from the period, after the formation of silver halide grains used for the above-mentioned light-sensitive layers, and before the emulsions containing the light-sensitive silver halide grains are applied by coating. The addition method is arbitrarily selected from the conventional methods. Such methods are as follows; a method, wherein a compound is firstly dissolved in a low-boiling solvent (such as methanol, ethanol, ethyl acetate or the like) or high-boiling solvent (such as bibutyl phthalate, dioctyl phthalate, tricresyl phosphate or the like), then, subjected to an ultrasonic dispersion; a method, wherein a compound is dissolved in an aqueous alkali solution (for example a 10% aqueous sodium hydroxide solution or the like), and then neutralized by a mineral acid (for example hydrochloric acid, nitric acid or the like); a method, wherein a compound is dispersed together with an aqueous solution of suitable polymer (for example, polyvinyl butyral, polyvinyl pyrolidone or the like) by means of a ball mill.

It is preferable that only of the thermal developing light-sensitive layers of the thermal developing light-sensitive material of the invention contains all of (1) light-sensitive silver halides, (2) reducing agent, (3) dye-supplying material, (4) binder, and if so required, (5) organic silver salt. It is, however, not always necessary that these are contained in only one photographic structural layer. For example, a thermal developing light-sensitive layer is divided into two layers, whereby one thermal developing light-sensitive contains the above components (1), (2), (4) and (5) are contained in one thermal developing light-sensitive layer, while the other thermal developing light-sensitive layer adjacent to it contains the dye-supplying material (3). In other words, as far as these compounds can react with each other, they may be isolatedly distributed to more than two photographic structural layers.

In addition, the thermal developing light-sensitive layer may be divided into more than two layers, for example, a high sensitive layer and a low sensitive layer or a high density layer and a low density layer.

The thermal developing light-sensitive material of the invention comprises at least one thermal developing light-sensitive layer provided on a support. A thermal developing color light-sensitive material usually comprises three thermal developing light-sensitive layers independently having an individual color-sensitivity. In the light-sensitive layer, a dye having individual color is formed or released by a thermal developing. A blue-sensitive layer has a yellow dye; a blue-sensitive layer has a magenta dye, and; a red-sensitive layer has a cyan dye. However, these combinations are not necessarily mandatory. Also, a near-infrared light-sensitive layer may be incorporated into the material.

The constitution of the layers may be arbitrarily determined. The following constitutions are available; a constitution comprising a support, sequentially disposed thereon, a red-sensitive layer, a green-sensitive layer and a blue-sensitive layer; a constitution comprising a support, sequentially disposed thereon, a blue-sensitive layer, a green-sensitive layer and a red-sensitive layer; a constitution comprising a support, sequentially disposed thereon, a green-sensitive layer, a red-sensitive layer and a blue-sensitive layer.

The thermal developing light-sensitive material of the invention may have, in addition to the above-mentioned thermal developing light-sensitive layers, the non-light-sensitive layers, such as a subbing layer, intermediate layers, a protective layer, a filter layer, a backing layer and a separation layer, and others. To form the above thermal developing light-sensitive layers and these non-light-sensitive layers on the support, the coating methods similar to those used for preparing, by coating, a conventional silver halide light-sensitive material can be used.

More specifically, the a dipping method, a roller method, a reverse roll method, an air knife method, a doctor blade method, a spray method, a bead method, an extrusion method, a stretch flow method, a curtain flow method and the like (methods and apparatus) can be used.

The thermal developing light-sensitive material of the invention contains light-sensitive silver halides. The light-sensitive silver halides used according to the invention include silver chloride, silver bromide, silver iodide, silver chlorobromide, silver chloro-iodide, silver iodo-bromide, silver chloro-iodo-bromide and the like. The above light-sensitive silver halides can be prepared by an optional method known in the photographic art, such as a single-jet precipitation method and a controlled double-jet precipitation method. Light-sensitive silver halide emulsions containing light-sensitive silver halides prepared in accordance with a conventional method to prepare silver halide gelatin emulsions can be arbitrarily used.

Mono-dispersion silver halide grains are preferably used. They may be of core/shell type silver halide grains, and may be giant grains or fine grains. However, a preferred mean grain size is 0.001 to 1.5 μm, or more specifically, 0.01 to 0.5 μm.

The above light-sensitive silver halide emulsions may be chemically sensitized by an optional methods in the photographic art. Such sensitizing methods include a gold sensitization, sulfur sensitization, gold-sulfur sensitization, reducing sensitization and the like.

The light-sensitive silver halide emulsions can be turned into spectrally sensitized light-sensitive silver halide emulsions by containing various types of spectral sensitizing dyes.

The typical spectral sensitizing dyes used in the invention include cyanine, melocyanine, complex (tri-nucleus or tetra-nucleus) cyanine, holopolar cyanine, styril, hemicyanine, oxonol and the like. Of the cyanine dyes, those having a basic nucleus, such as thiazoline, oxazoline, pyroline, pyridine, oxazole, thiazole, selenazole and imidazole are favorably used. Such nuclei may have an enamine group capable of forming an alkyl group, alkylene group, hydroxyalkyl group, sulfoalkyl group, carboxylalkyl group and aminoalkyl group, or an enamine capable of forming a condensed carbon ring or heterocyclic ring. In addition, such a nucleus may be either a symmetrical type of asymmetrical type, and may have, in a methine chain or polymethine chain thereof, an alkyl group, phenyl group, enamine group or heterocyclic substituent.

The melocyanine dye may have, in addition to the above basic nuclei, an acidic nucleus such as a thiohydantoin nucleus, rhodanine nucleus, oxazolidine nucleus, barbituric nucleus, thiazolinethione nucleus, malononitrile nucleus and pyrazolone nucleus and the like. Such acidic nucleus may have a substituent of alkyl group, alkylene group, phenyl group, carboxyalkyl group, sulfoalkyl group, hydroxyalkyl group, alkoxyalkyl group, alkylamino group or heterocyclic nuclei. More than two of such dyes may be, if necessary, simultaneously used. Also, super-sensitizing dyes not absorbing visible light, such as ascorbic derivatives, cadmium salt of azaindene and organic sulfonic acids and the like, as disclosed in U.S. Pat. Nos. 2,933,390 and 2,937,089, can be used together with such a dye.

The amount addition of such a dye is $1\times10^{-4}$ to 1 mol, preferably $1\times10^{-4}$ to $1\times10^{-1}$ mol per mol silver halide or silver halide-forming component.

Such light-sensitive silver halides and the light-sensitive silver salt-forming components may be used in combination, in compliance with various methods, and the total amount of addition is 0.001 to 50 g/m$^2$, preferably 0.1 to 10 g/m$^2$ per layer.

According to the invention, various organic silver salts can be used to increase the sensitivity and improve the developability of the material.

The examples of organic silver salt used together with the thermal developing light-sensitive material of the invention are as follows; as disclosed in Japanese Patent Examined Publication No. 4921/1968, No. 26582/1969, No. 18416/1970, No. 12700/1970 and No. 22185/1970, Japanese Patent O.P.I. Publications No. 52626/1974, No. 31728/1977, No. 137321/1977, No. 141222/1977, No. 362241978, No. 36224/1978 and No. 37610/1971, U.S. Pat. Nos. 3,330,633, 3,794,496 and 4,105,451 and the like, silver salts of long-chained aliphatic carboxylic acids and silver salts of carboxylic acids having a heterocycle, for example, silver laurate, silver myristate, silver palmitate, silver stearate, silver alaquidonate, silver bahanate, α-(1-phenyltetrazolethio and the like, silver salts of aromatic carboxylic acids, for example silver benzoate and silver phthalate; as disclosed in Japanese Patent Examined Publications No. 26582/1969, No. 12700/1970 and No. 22185/1970, Japanese Patent O.P.I. Publications No. 137321/1977, No. 118638/1983 and No. 118639/1983, U.S. Pat. No. 4,123,274 and the like, silver salts of imino group.

The silver salts of imino group include silver benzotriazole silver. Such benzotriazole silver may be substituted or unsubstituted. The typical examples of substituted benzotriazole silver include alkyl-substituted benzotriazole silver (preferably substituted by an alkyl group having less than 22 carbon atoms, preferably less than 4 carbon atoms, such as methylbenzotriazole silver, ethylbenzotriazole silver, n-octylbenztriazole silver or the like), alkylamidebenzotriazole silver (preferably substituted by an alkylamide group having less than 22 carbon atoms, such as acetamidebenzotriazole silver, propyonamidebenzotriazole silver, iso-butylamidebenzotriazole silver, laurylamidebenzotriazole silver or the like), alkylsulfamoylbenzotriazole silver (preferably substituted by an alkylsulfamoyl group having less than 22 carbon atoms, such as 4-(N, N-diethylsulfamoyl) benzotriazole silver, 4-(N-propylsulfamoyl) benzotriazole silver, 4-(N-octylsulfamoyl) benzotriazole silver, 4-(N-decylsulfamoyl) benzotriazole silver, 5-(N-octylsulfamoyl) benzotriazole silver or the like), silver salts of halogen-substituted benzotriazole (such as 5-chlorbenzotriazole silver, 5-brombenzotriazole silver or the like), alkoxybenzotriazole silver (preferably, substituted by an alkoxy group having less than 22, or more specifically, less than 4 carbon atoms, such as 5-methoxybenzotriazole silver, 5-ethoxybenzotriazole silver or the like), 5-nitrobenzotriazole silver, 5-aminobenzotriazole silver, 4-hydroxybenzotriazole silver, 5-carboxybenzotyraizole silver, 4-sulfobenzotriazol silver 5-sulfobenzotriazol silver and the like.

The other examples of useful silver salt having an imino group are as follows; imidazole silver, benzimidazole silver, 6-nitrobenzimidazole silver, pyrazole silver, urazole silver, 1,2,4-triazole silver, lH-tetrazole silver, 3-amino-5-benzylthio-1,2,4-triazole silver, saccharin silver, phthalazinone silver, phthalimie silver;

salts of mrecapto compounds such as 2-mercaptobenzoxazole silver, 2-mercaptooxadiazole silver, 2-mercaptobenzothiazole silver, 2-mercaptobenzimidazole silver, 3-mercapto-4-phenyl-l,2,4-triazole silver, 4-hydroxy-6-methyl-1,3,3a,7-tetraazainde silver, 5-methyl-7-hydroxy-1,2,3,4,6-pentaazaindene silver.

Also silver complex compounds having a stability constant of 4.5–10.0 as disclosed in Japanese Patent O.P.I. Publication No. 31728/1977, as well as silver salts of imidazolinethione as disclosed in U.S. Pat. No. 4,168,980 and the like are used.

Of the above organic silver salts, silver salts of imino group are preferable, in particular, silver salts of benzotriazole derivatives, preferably 5-methybenzotriazole and derivatives thereof, sulfobenzotriazole and derivatives thereof, and N-alkylsulfamoylbenzotriazole and derivatives thereof are advantageous.

The organic silver salts in the invention may be used singly or in combination. A silver salt may be formed in an appropriate binder, which may be used without isolating the silver salt, or otherwise, the isolated silver salt may be dispersed in a binder to be used, with an appropriate means. The useful dispersing methods are include a ball mill, sand mill, colloid mill, vibration mill and the like, but the use of them are not mandatory.

In addition, the organic silver salts are usually prepared by a method, wherein silver nitrate and raw organic compounds are dissolved blended in water or organic solvent. If necessary, the addition of binder or the addition of alkali such as sodium hydroxide can accelerates the dissolution of the organic compounds, and the use of an ammonia solution of silver nitrate is also effective.

The preferred amount of such an organic silver salt is usually 0.01 to 500 mol, more specifically, 0.1 to 100 mol, and most specifically, 0.3 to 30 mol per mol light-sensitive silver halide.

When the thermal developing light-sensitive material of the invention is a color light-sensitive material, a dye-supplying material is employed.

The dye-supplying materials useful of the invention are described below. The dye-supplying materials should be compulsorily materials being capable of taking part in the reducing reaction of light-sensitive silver halide and/or organic silver salt used in compliance with a requirement, and being capable of forming or emitting diffusible dyes in proportion to the function of the reaction, and are categorized, based on the nature of reaction, into negative type dye-supplying materials which form a negative dye image, in proportion to the positive function, when negative silver halide is used, and positive type dye-supplying materials which form a positive dye image, in proportion to the negative function, when negative silver halide is used. The negative type dye-supplying materials are further divided into the following categories.

- Negative type dye-providing materials
  - Compounds emitting diffusible dye when oxidized: Reducing dye-emitting compounds
  - Compounds forming diffusible dye by the coupling reaction with reducing agent
    - Coupling dye-forming type compounds
    - Coupling dye-forming type compounds Each dye-supplying material is further described below.

The examples of reducing dye-emitting compound are, for example, those represented by the following general formula (2').

General formula (2)

Car—NHSO—Dye

In this formula, Car represents a reducing base (so called a carrier) which is oxidized to emit a dye in the reduction of light-sensitive silver halides and/or organic silver salts used if necessary, and Dye represents a residue of diffusible dye.

The typical examples of the above reducing dye-emitting type compound are disclosed in Japanese Patent O.P.I. Publications No. 179840/1982, No. 116537/1983, No. 60434/1984, No. 65839/1984, No. 71046/1984, No. 87450/1984, No. 88730/1984, No. 123837/1984, No. 165054/1984 and No. 165055/1984, and exemplified as follows.

Example dye-supplying materials

1

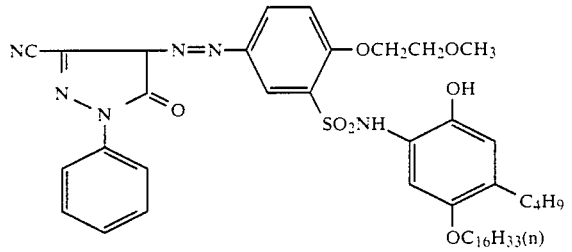

-continued
2
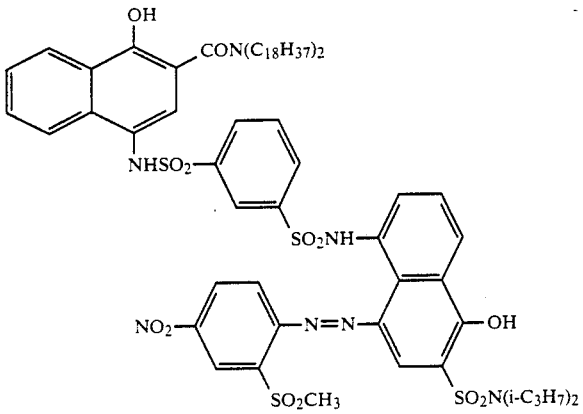
3
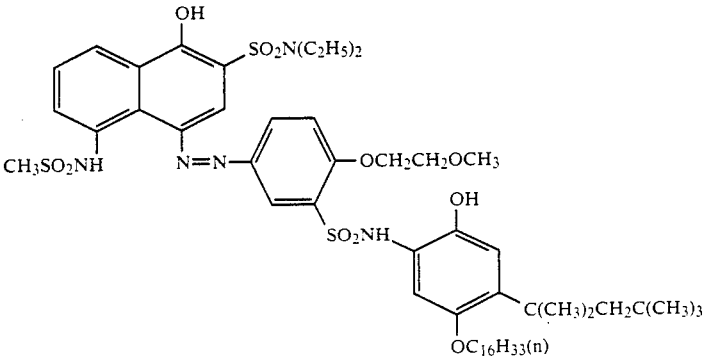
4
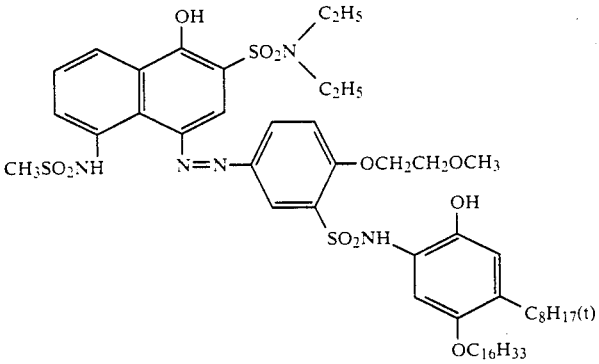
5
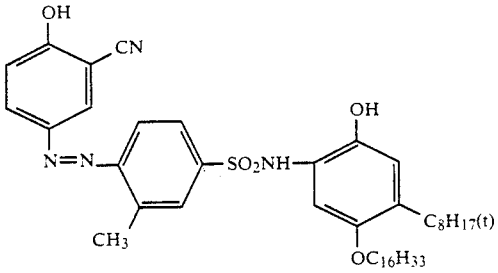
6
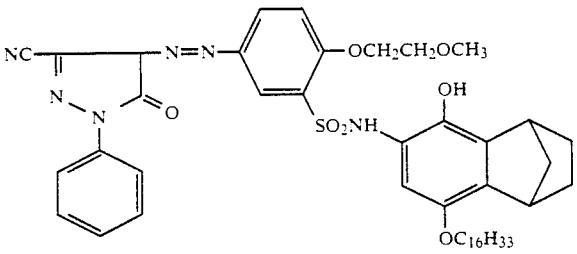

-continued
7
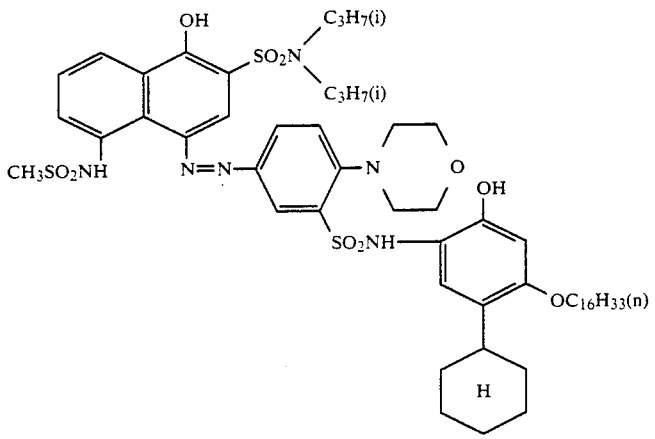
8
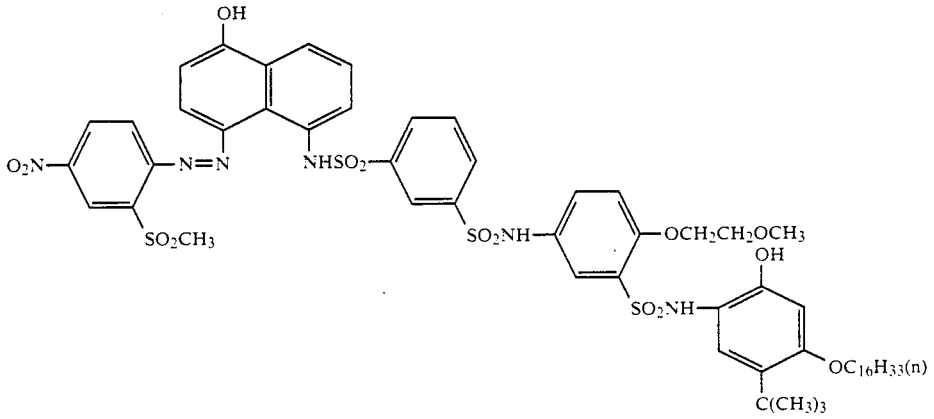
9
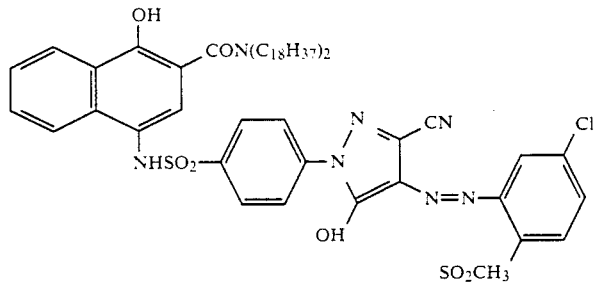
10
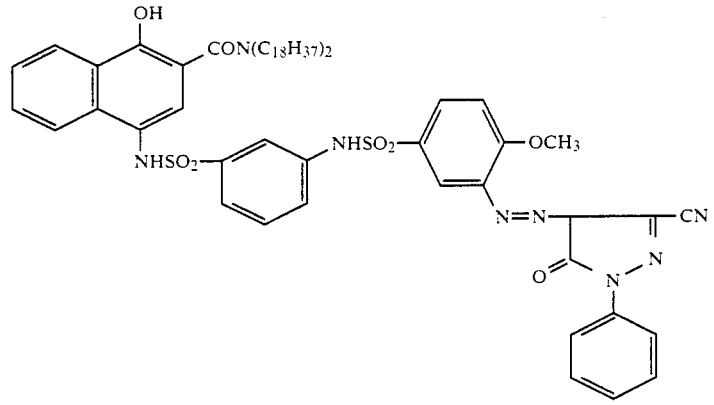

-continued
11
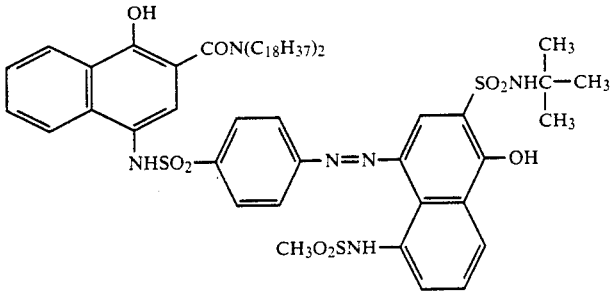
12
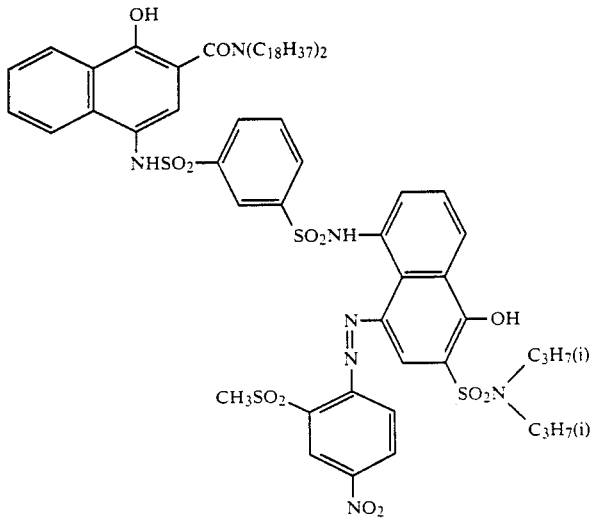
13
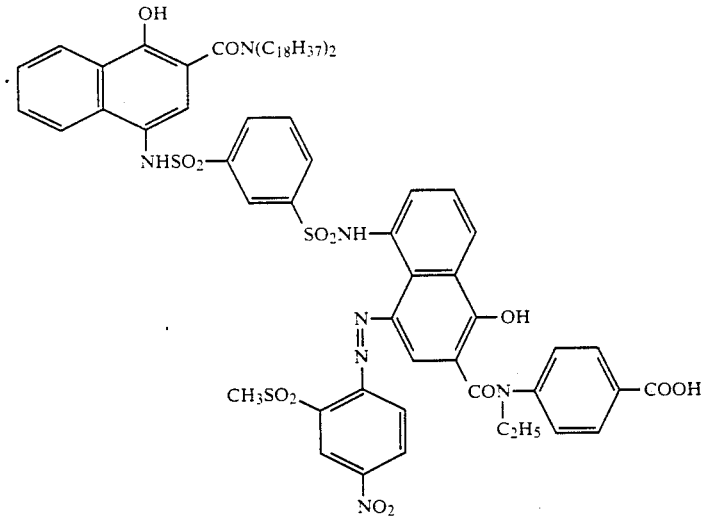
14
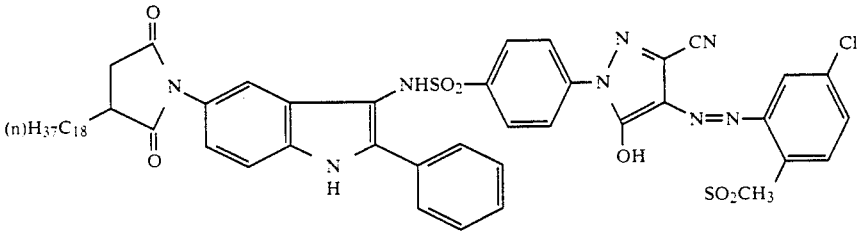

-continued

15

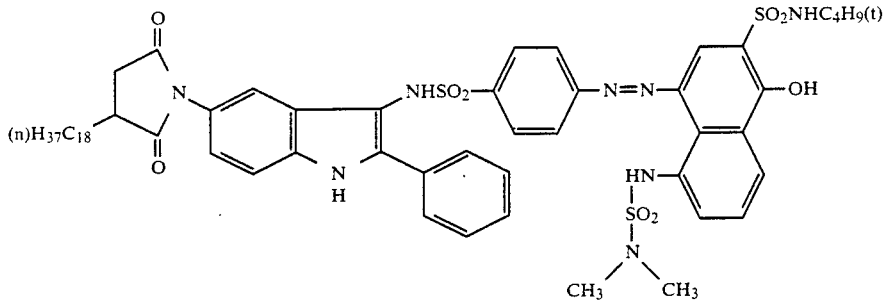

16

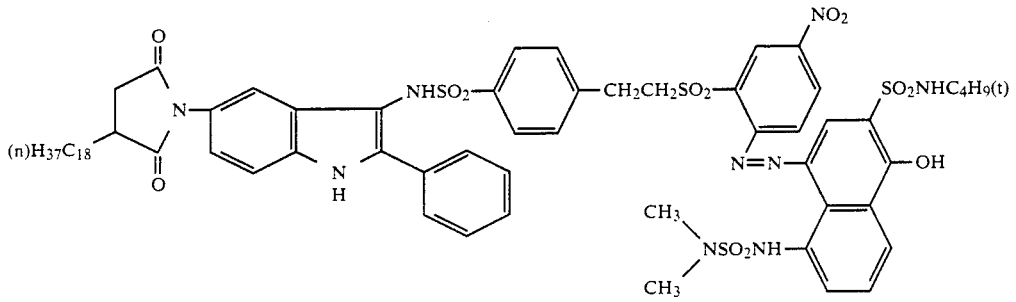

17

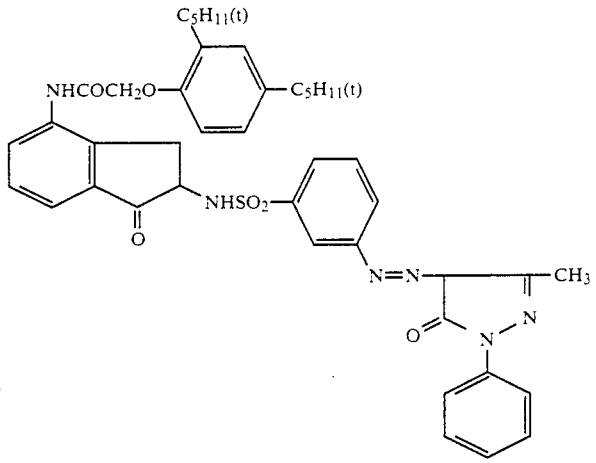

Other reducing dye-emitting compounds include compounds represented the following general formula (3'):

General formula (3')

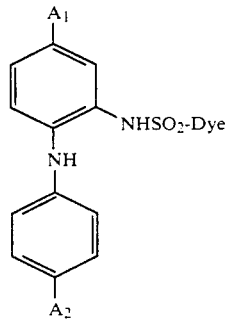

In the formula, $A_1$ and $A_2$ individually represent a hydrogen atom, hydroxyl group or amino group, and Dye is identical to Dye in the general formula (2'). The typical examples of this compound are disclosed in Japanese Patent O.P.I. Publication No. 124329/1984.

The coupling dye-emitting type compounds include the compounds represented by the following general formula (4'), General formula (4')

$$Cp_1—J—_{n1}Dye$$

In the formula, $Cp_1$ represents an organic group (so called a coupler residue) capable of reacting with an oxidized product of a reducing agent, to emit a dye, J represents a bivalent bonding group; a bond between $Cp_1$ and J is cleaved by the reaction with the oxidized produce of reducing agent; n represents 0 or 1; and Dye is identical to than in the general formula (2'). In addition, $Cp_1$ is preferably substituted with any of various types of ballast group in order to make the coupling dye-emitting type compounds non-diffusible. Though variable in accordance with the nature and configuration of the light-sensitive material to be used, the examples of such a ballast groups are as follows: an organic group having more than 8 carbon atoms (more specifically, more than 12 carbon atoms); a hydrophilic group, such as a sulfon group or carboxyl group each having more than 8 carbon atoms (preferably, more than 12 carbon atoms); a group simultaneously having carbon atoms, and hydrophilic groups such as a sulfon group, carboxy group and others. Another particularly advantageous ballast groups is a polymer chain.

The typical examples of the above compounds represented by the general formula (4'), are disclosed in Japanese Patent O.P.I. Publications No. 186744/1982, No. 122596/1982, No. 160698/1982, No. 174834/1984, No. 224883/1982, No. 159159/1984 and No. 231540/1984. For example, the following compounds are disclosed.

Preferably, the coupler residue represented by $Cp_2$ has a molecular weight of less than 700, more specially less than 500, to ensure the diffusibility of a dye to be formed.

In addition, the ballast group is preferably identical to that defined in the general formula (4'). In particular, a group having simultaneously more than 8 carbon atoms (preferably, more than 12 carbon atoms) and a hydrophilic group, such as a sulfon group and carboxyl group, is preferable. In addition, a polymer chain is more advantageous.

Example dye-supplying materials

18

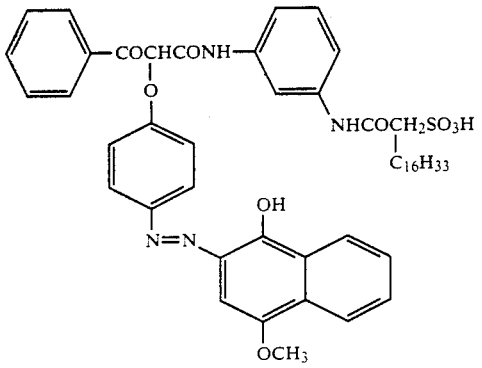

19

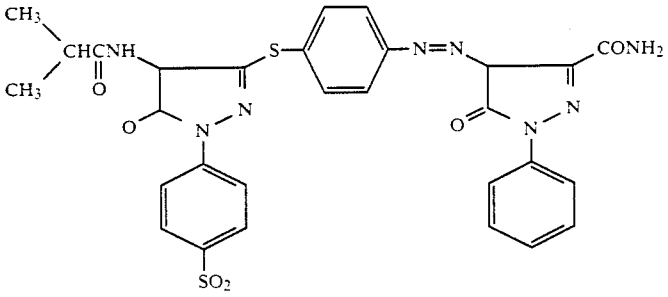

20

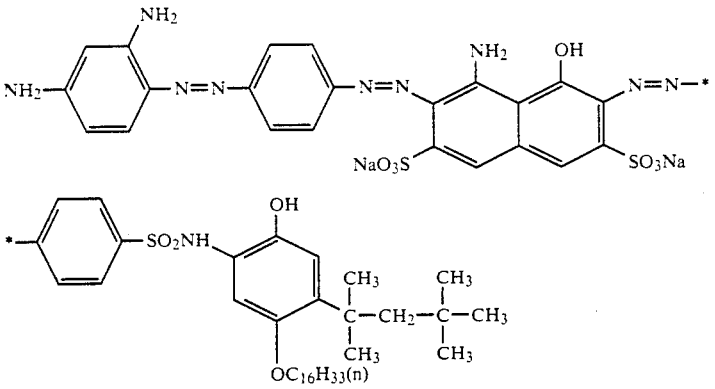

The coupling dye-forming compounds include those represented by the following general formula (5'):

General formula (5')

$$Cp_2—F—B)$$

In the formula, above, $Cp_2$ represents an organic group (so called a coupler residue) being capable of reacting (coupling reaction) with the oxidized product of a reducing agent to form a diffusible dye, F represents a bivalent bonding group, and B represents a ballast group.

As a coupling dye-forming compound having such a polymer chain, the polymer having repeated units derived from a monomer and represented by the following general formula (6') is advantageous.

General formula (6')

$$Cp_2—F—Y)_l(Z—L)$$

In this formula, $Cp_2$ and F respectively have the same meaning as in the general formula (5'); Y represents an alkylene group, arylene group or aralkylene group; l represents 0 or 1; Z represents a bivalent organic group; and L represents an ethylenic unsaturated group or a group having an ethylenic unsaturated group.

The typical examples of the coupling dye-forming compound respectively represented by the general formulae (5'), (6') are disclosed in Japanese Patent O.P.I. Publications No. 124339/1984, No. 181345/1984 and No. 2950/1985, Japanese Patent Applications No. 179657/1984, No. 181604/1984, No. 182506/1984 and No. 182507/1984, and others, 59-182507 and the like. For example, the following compounds are available.

Example dye-supplying materials

21

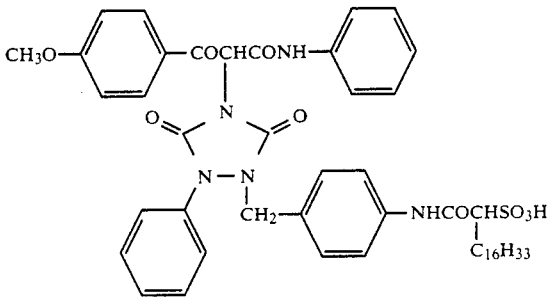

22

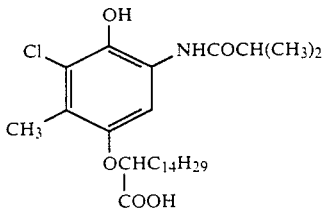

23

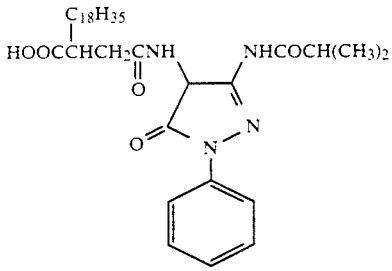

Polymers

PM-1

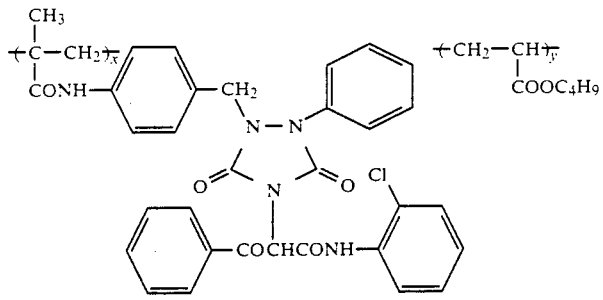

x: 80 weight %
y: 20 weight %

PM-2

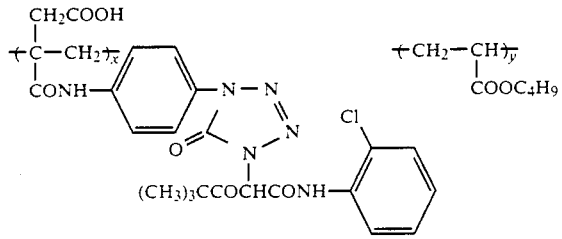

x: 50 weight %
y: 50 weight %

-continued
PM-3
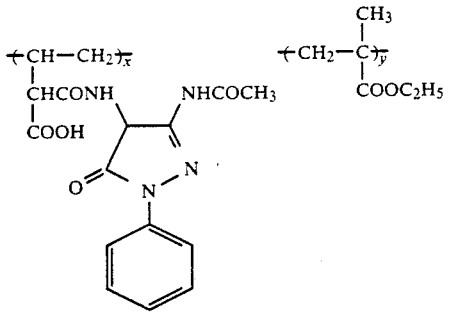
x: 40 weight %
y: 60 weight %
PM-4
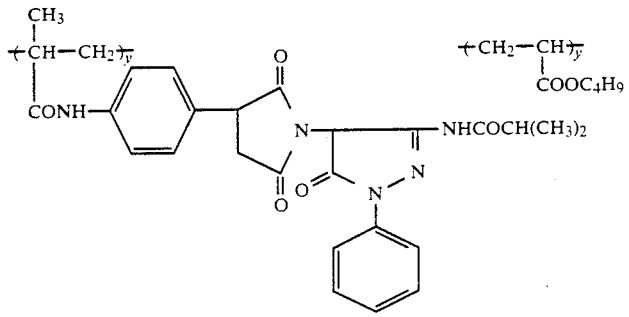
x: 40 weight %
y: 60 weight %
PM-5
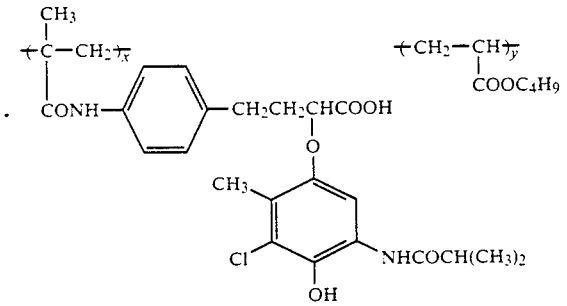
x: 60 weight %
y: 40 weight %
PM-6
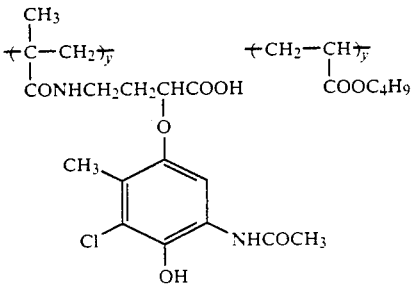
x: 50 weight %
y: 50 weight %

-continued

PM-7

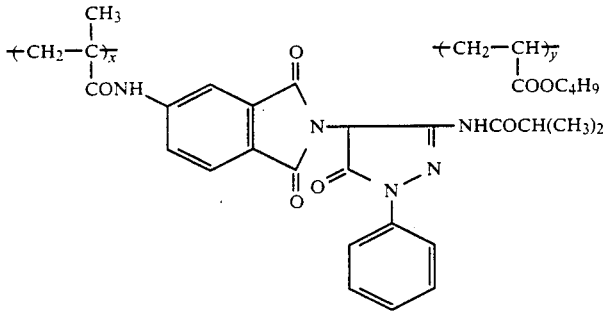

x: 50 weight %
y: 50 weight %

PM-8

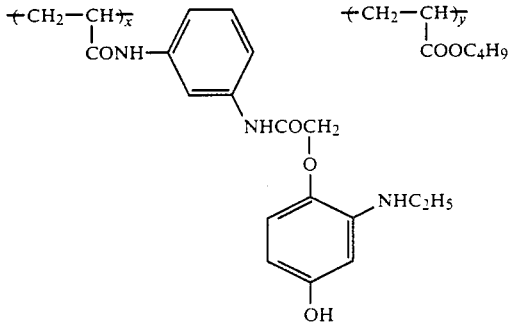

x: 50 weight %
y: 50 weight %

The coupler residues defined by $Dp_1$ or $Cp_2$ in the above general formulae (4'), (5'), and (6') are, more specifically, the groups represented by the following general formulae.

General formula (7')

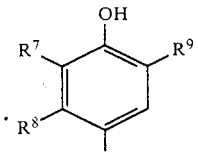

General formula (8')

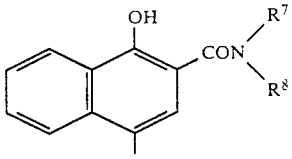

General formula (9')

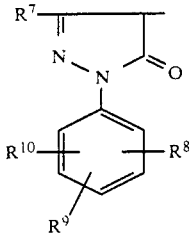

General formula (10')

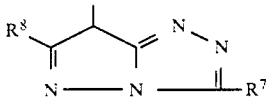

-continued

General formula (11')

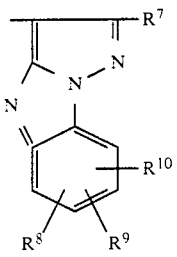

General formula (12')

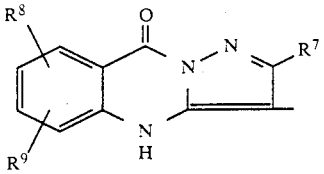

General formula (13')

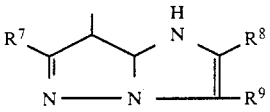

General formula (14')

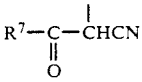

General formula (15')

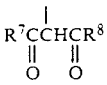

-continued

General formula (16')

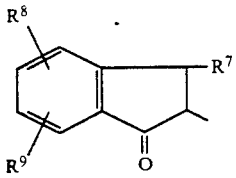

In these formulae, $R^7$, $R^8$, $R^9$ and $R^{10}$ independently represent any of a hydrogen atom, halogen atom, alkyl group, cycloalkyl group, aryl group, acyl group, alkyloxycarbonyl group, aryloxycarbonyl group, alkylsulfonyl group, arylsulfonyl group, carbamoyl group, sulfamoyl group, acyloxyl group, amino group, alkoxyl group, aryloxyl group, cyano group, alkylsulfonyl group, arylsulfonyl group, ureide group, alkylthio group, arylthio group, carboxy group, sulfon group or heterocyclic residue. Each of these groups may be substituted with a hydroxyl group, carboxyl group, sulfonyl group, alkoxy group, cyano group, nitro group, alkyl group, aryl group, aryloxy group, acyloxy group, acyl group, sulfamoyl group, carbamoyl group, imide group, halogen atom or the like.

These substituents are selected in compliance with a requirement for $Cp_1$ and $Cp_2$. As mentioned previously, one of the substituents in $Cp_1$ is preferably a ballast group, and substituents in $Cp_2$ should be preferably determined so as to make the molecular weight of $Cp_2$ less than 700, preferably, less than 500, less, in order to enhance the diffusibility of the dye to be formed.

Positive type dye-supplying materials include oxidizing dye-emitting compounds represented by the following general formula (17').

General formula (17')

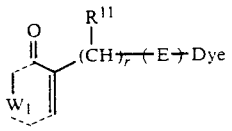

In the formula, $W_1$ represents a group of atoms required for forming a quinone ring (this ring may have substituents thereon); $R^{11}$ represents an alkyl group or hydrogen atom; E represents

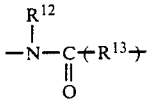

(wherein $R^{13}$ represents an alkyl group or hydrogen atom; and R represents an oxygen atom or

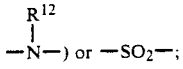

r represents 0 or 1; and Dye has the same meaning as in the general formula (2') The typical examples of the compounds are disclosed in Japanese Patent O.P.I. Publications No. 166954/1984, No. 154445/1984 and the like and include the following compounds.

Example dye-supplying materials

24

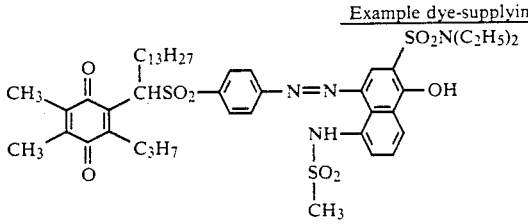

25

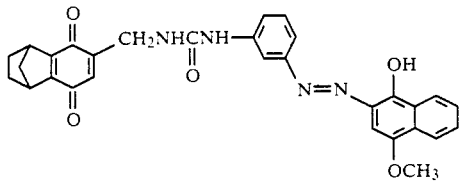

26

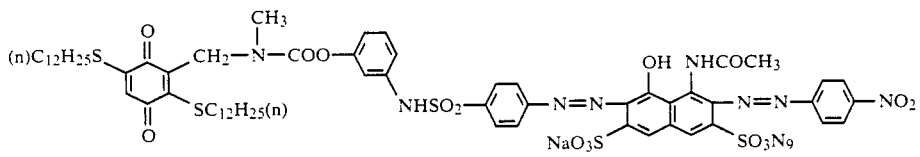

Other positive type dye-supplying materials are the compounds represented by the following general formula (18') each of which loses a dye-emitting capacity when oxidized.

General formula (18')

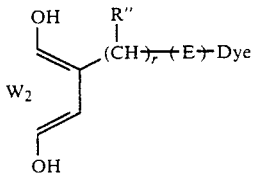

In the formula, $W_2$ represents a group of atoms required for forming a benzene ring (possibly having substituents thereon); and $R^{11}$, r, E, Dye are same as those in the general formula (17'). The typical examples of such a compound is disclosed in Japanese Patent O.P.I. Publications No. 124327/1984, No. 152440/1984 and the like. For example, the following compounds are available.

Example dye-supplying materials

27

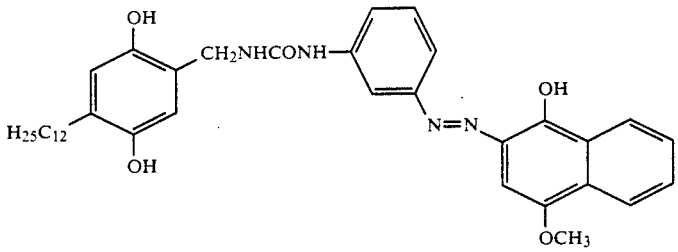

28

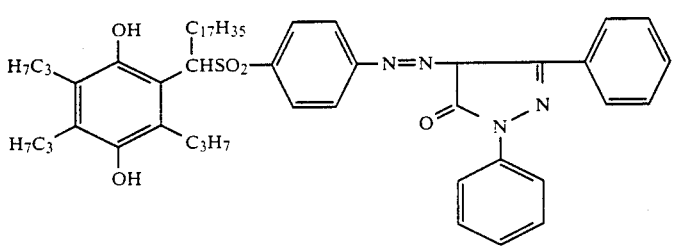

Still other positive type dye-supplying material are the compounds represented by the following general formula (19').

General formula (19')

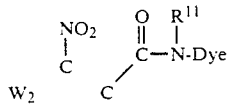

In this formula, above, $W_2$, $R^{11}$ and Dye are identical to those in the general formula (18'). The typical examples of these compounds are disclosed in Japanese Patent O.P.I. Publications No. 154445/1984 and others, wherein the following compounds are available.

Example dye-supplying materials

Example dye-supplying materials

29

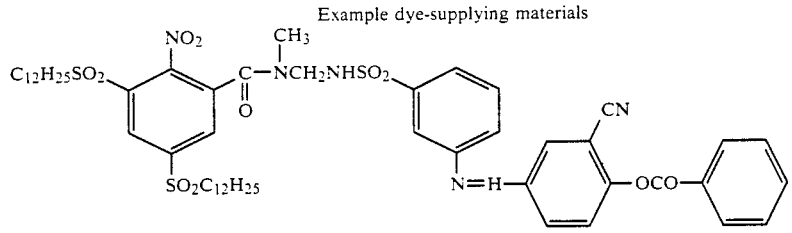

30

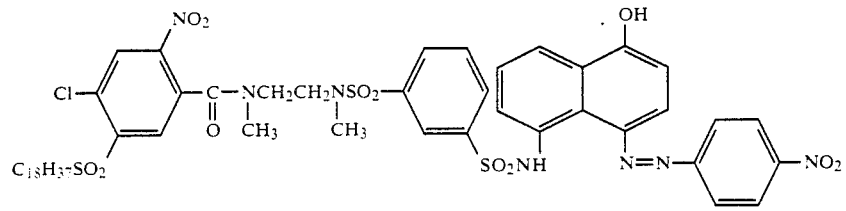

The residues of diffusible dye represented by Dye in the above general formulae (2'), (3'), (4'), (17'), (18') and (19') are hereinunder described more in detail. Such diffusible dye residue has molar weight of less than 800, or more favorably, less than 600, to ensure the diffusibility of the dye, and is available as the residues of azo dye, azomethine dye, anthraquinone dye, naphthoquinone dye, styryl dye, nitro dye,quinoline dye, carbonyl dye, phthalocyanine dye and the like. Such a dye residue may be in the form, where during the thermal developing or transferring it is temporarily rendered shortwave sensitive. Also, it is advantageous that these dye residues are the chelating dye residues, as disclosed in Japanese Patent O.P.I. Publications No. 48765/1984 and No. 124337/1984, since they can enhance the light-fastness of image.

These dye-supplying materials may be used singly or in combination. The amount to be used is not restrictive and may be in accordance with the following factors: the type of dye-supplying material; whether the materials are used singly or more than two are used combinedly; whether the photographic structural layer of light-sensitive material of the invention is of single layer type or multilayer type; and the like. As a guideline, the amount is 0.005 to 50 g, preferably 0.1 to 10 g per $m^2$ similar layer.

A method of incorporating the dye-supplying material into the photographic structural layers of a thermal developing material of the invention is arbitrarily determined. The examples of such a method to add the similar material into an emulsion to form the above layers are as follows: a method, wherein a compound is firstly dissolved in a low-boiling solvent (such as methanol, ethanol, ethyl acetate or the like) or high-boiling solvent (such as dibutyl phthalate, dioctyl phthalate, tricresyl phosphate or the like), then, subjected to an ultrasonic dispersion; a method, wherein a dye-supplying material is dissolved in an aqueous alkali solution (for example a 10% aqueous sodium hydroxide solution or the like), and then neutralized by a mineral acid (for example hydrochloric acid, nitric acid or the like); a method, wherein a compound is dispersed together with an aqueous solution of suitable polymer (for example, polyvinyl butyral, polyvinyl pyrolidone or the like) by means of a ball mill.

As the reducing agents for the thermal developing light-sensitive materials of the invention, those reducing agents conventionally used in a field of thermal developing light-sensitive material can be used.

If the dye-supplying materials used for the thermal developing light-sensitive materials of the invention are dye-supplying materials, as disclosed in Japanese Patent O.P.I. Publications No. 186744/1982, No. 79247/1983, No. 149046/1983, No. 149047/1983, No. 124339/1984, No. 181345/1984, No. 2950/1985 and the like, emitting or forming a diffusible dye by coupling with the oxidized product of reducing agent, the following are useful: p-phenylenediamine and p-aminophenol developing agents, phosphoroamidephenol and sulfonamidephenol developing agents, sulfonamideaniline developing agents, hydrazone color developing agents, and the like as disclosed in U.S. Pat. Nos. 3,531,286, 3,761,270, 3,764,328, Research Disclosure Nos. 12146, 15108 and 15127, and Japanese Patent O.P.I. Publications No. 27132/1981. Also the color developing agent precursors disclosed in U.S. Pat. Nos. 3,342,599, 3,719,492, Japanese Patent O.P.I. Publications No. 135628/1978 and No. 79035/1982 and the like, can be advantageously used.

Particularly preferred reducing agents include reducing agents represented by the following general formula (1') as disclosed in Japanese Patent O.P.I. Publication No. 146133/1981.

General formula (1')

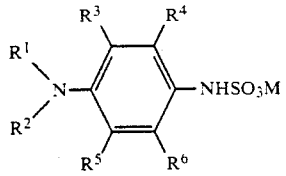

In the formula, $R^1$ and $R^2$ independently represent a hydrogen atom, or an alkyl group, having 1–30 carbon atoms (preferably 1–4 carbon atoms) and possibly be substituted, $R^1$ and $R_2$ may be bonded together to form a heterocycle, $R^3$, $R^4$, $R^5$ and $R^6$ independently represent a hydrogen atom, halogen atom, hydroxyl group, amino group, alkoxy group, acylamino group, sulfonamide group, alkylsulfonamide group, or an alkyl group having 1–30 carbon atoms (preferably 1–4 carbon atoms) and possibly be substituted, $R^3$ and $R^1$, or $R^5$ and $R_2$ may be bonded together to form a heterocycle, M represents an alkali metal atom, ammonium group, nitrogen-containing organic base or a compound having quaternary nitrogen.

The nitrogen-containing organic base in the above general formula (1') is an organic compound having a basic nitrogen atom capable of forming a salt with an inorganic salt. Amine compounds are particularly important organic bases. Such amine compounds are as follows: chained amine compounds such as a primary amine, secondary amine, tertiary amine and the like; as cyclic amine compounds, the well known examples of typical heterocyclic organic base, such as a pyridine, quinoline, pyperidine, imidazole and the like. In addition, the compounds such as hydroxylamine, hydrazine, amizine and the like are useful as the chained amines. As the salts of nitrogen-containing organic base, the inorganic salts for example, hydrochloride, sulfate, nitrate and the like) of the above-mentioned organic bases are favorably used.

At the same time, as the compounds having a quaternary nitrogen in the above general formula, the salts or hydroxydes of nitrogen compound having a tetravalent covalent bond.

The typical preferred examples of the reducing agents represented by the above general formula (I') are listed below.

(R-1)

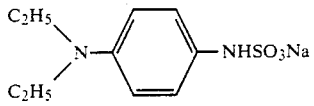

(R-2)

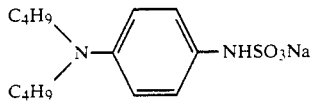

(R-3)

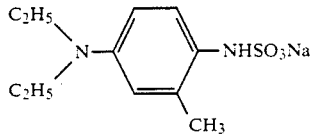

(R-4)

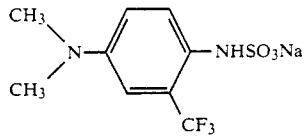

(R-5)

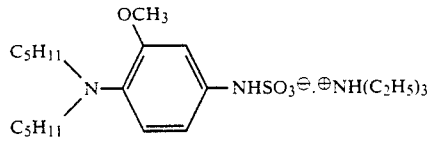

(R-6)

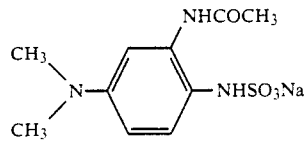

(R-7)

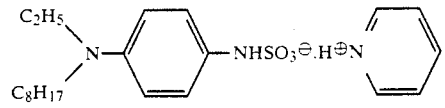

-continued
(R-8)
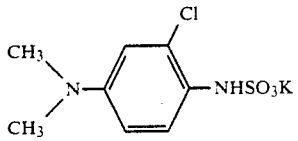
(R-9)
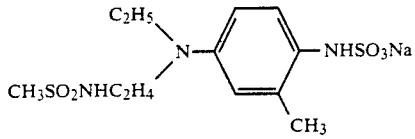
(R-10)
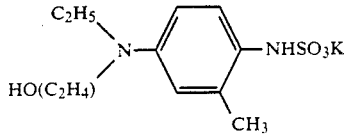
(R-11)
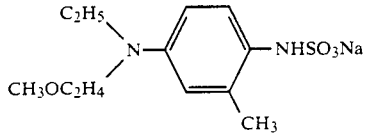
(R-12)
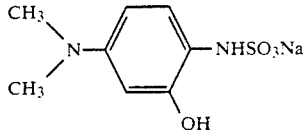
(R-13)
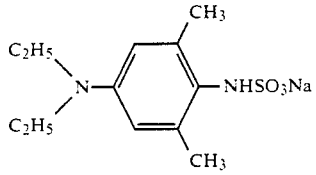
(R-14)
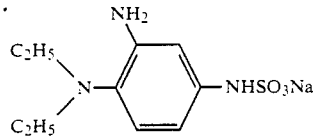
(R-15)
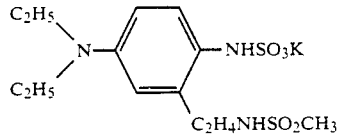
(R-16)
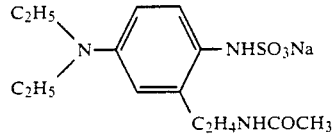
(R-17)
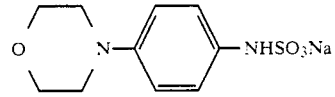
(R-18)
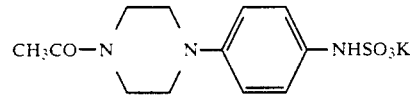
-continued
(R-19)
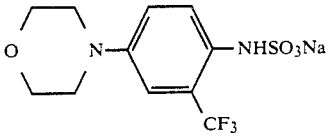
(R-20)
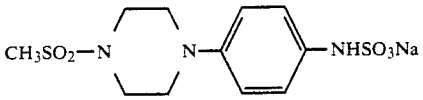
(R-21)
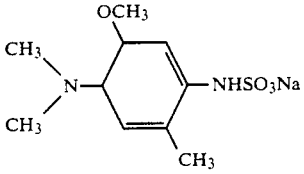
(R-22)
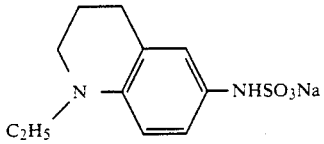
(R-23)
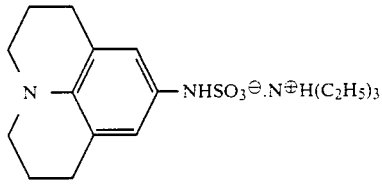
(R-24)
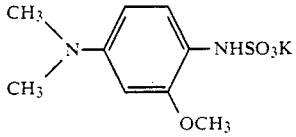
(R-25)
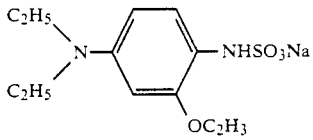
(R-26)
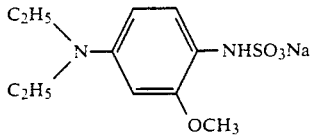
(R-27)
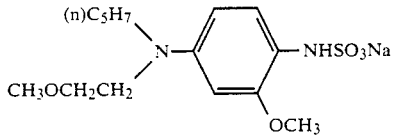
(R-28)
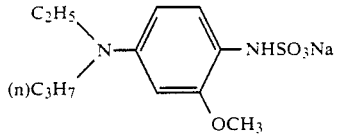

-continued (R-29)

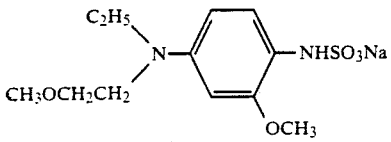

(R-30)

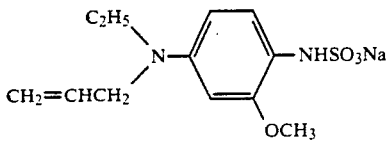

The above reducing agents represented by the above general formula (1') can be synthesized by known methods, for example a method described in Houben-Weyl, Methoden der Organischen Chemie, Band XI/2, pp. 645–703.

In addition, more than two types of the above reducing agents can be used simultaneously, or a black-and-white developing agent mentioned later can be used together with the reducing agents for the purposes including the enhanced developability.

If the dye-supplying materials used in the invention are, as disclosed in Japanese Patent O.P.I. Publications No. 179840/1982, No. 58543/1983, No. 152440/1984, No. 154445/1984 and the like, the compounds emitting dye when oxidized, or the compounds losing the dye-emitting capacity when oxidized, or the compounds emitting dye when reduced (or, merely a silver image is formed), the developing agents, described below, can be used.

The examples of such a developing agent are as follows: phenols such as p-phenylphenol, p-methoxyphenol, 2,6-di-tert-butyl-p-crezol, N-methyl-p-aminophenol and the like; sulfonamidephenols such as 4-benzenesulfonamidephenol, 2-benzenesulfonamidephenol, 2,6-dichloro-4-benzenesulfonamidephenol and 2,6-dibromo-4-(p-toluenesulfonamide) phenol and the like; polyhydroxybenzenes such as hydroquinone, tert-butylhydroquinone, 2,6-dimethylhydroquinone, chlorohydroquinone, carboxyhydroquinone, cathecol, 3-carboxycathecol and the like; naphthols (such as α-naphthol, β-naphthol, 4-aminonaphthol, 4-methoxynaphthol and the like; hydroxybinaphthyls and methylenebisnaphthols such as 1,1'-dihydroxy-2,2'-binaphthyl, 6,6'-dibromo-2,2'-dihydroxy-1,1'-binaphthyl, 6,6-dinitro-2,2'-dihydroxy-1,1'-binaphthyl, 4,4'-dimethoxy-1,1'-dihydrox-2,2'-binaphthyl, bis(2-hydroxy-1-naphthyl) methane and the like; methylenebisphenols such as 1,1-bis(2-hydroxy-3,5-dimethylphenyl)-3,5,5-trimethylhexane, 1,1-bis(2-hydroxy-3-tert-butyl-5-methylphenyl) methane, 1,1'-bis(2-hydroxy-3-,5-di-tert-butylphenyl) methane, 2,6-methylenebis(2-hydroxy-3-tert-butyl-5-methylphenyl)-4-methylphenol, α-phenyl-α,α-bis(2-hydroxy-3-tert-butyl-5-methylphenyl) methane, 1,1-bis(2-hydroxy-3,5-dimethylphenyl)-2-methylpropane, 1,1,5,5-tetrakis(2-hydroxy-3,5-dimethylphenyl)-2,4-ethylpentane, 2,2-bis(4-hydroxy-3,5-dimethylphenyl) propane, 2,2-bis(4-hydroxy-3-methyl-t-tert-butylphenyl) propane, 2,2-bis(4-hydroxy-3,5-di-tert-butylphenyl) propane and the like; ascorbic acid and the like; 3-pyrazolidones and the like; pyrazolone and the like; hydrazone and the like; para-phenylenediamine and the like.

These developing agents may be used singly or more than two of them may be simultaneously used.

The amount of the reducing agent used in the thermal developing light-sensitive material of the invention depends on the type of light-sensitive silver halide to be used, the type of silver salt of organic acid, the types of additives and the like, however, the amount is usually 0.01–1500 mol, preferably, 0.1–200 mol per mol light-sensitive silver halide.

The examples of binders used in the thermal light-sensitive material of the invention are synthetic or natural high molecular substances, such as polyvinyl butyral, polyvinyl acetate, ethylcellulose, polymethyl methacrylate, celluloseacetate butylate, polyvinyl alcohol, polyvinyl pyrolidone, gelatin, phthalated gelatin, and the like. These may be used singly, or more than two of them may be combinedly used. In particular, the combined use of gelatin or derivative thereof and hydrophilic polymer such as polyvinyl pyrolidone or polyvinyl alcohol is advantageous. Or, the following binders, as disclosed in Japanese Patent O.P.I. Publication No. 229556, are more advantageous.

Such binders independently have gelatin and polypyrolidone polymer. Such polyvinyl pyrolidone polymer may be polyvinyl pyrolidone which is homopolymer of vinyl pyrolidone, or may be copolymer (possibly, graft copolymer) of vinyl pyrolidone and at least one of other copolymerizable monomers. Such a polymer can be used regardless of a degree of polymerization thereof. Such polyvinyl pyrolidone may be substituted polyvinyl pyrolidone. The preferred polyvinyl pyrolidone has a molecular weight of 1,000–400,000. Other monomers copolymerizable with vinyl pyrolidone are as follows: acrylic acid and methacrylic acid, and alkyl ester thereof such as (metha) acrylic esters; vinyl monomers, such as vinyl alcohol, vinyl acetate, vinylimidazole, (metah)acrylamide, vinylcarbinol, vinyl alkylether and the like. In addition, it is desirable that at least 20% (in terms of weight %, applicable hereinunder) of copolymetic component comprises polypyrolidone. The preferred example of such a copolymer has a molecular weight of 5,000–400,000.

Gelatin may be treated with either lime or acids, and the examples of which include modified gelatin such as pig skin gelatin, hide gelatin or those esterificated and phenylcarbamoylized.

In the above-mentioned binder, the preferred gelatin component in the total binder is 10–90 weight %, more favorably, 20–60 weight %, and the preferred amount of vinyl pyrolidone is 5–90 weight %, or more favotably 10–80 weight %.

The above binder may contain other high molecular substances. The preferred examples of such mixture are as follows: a mixture comprising gelatine, and polyvinyl pyrolidone having a molecular weight of 1,000–400,000, and at least one of other high molecular substances; a mixture comprising gelatin, and vinyl pyrolidone copolymer having a molecular weight of 5,000–400,000, and at least one of other high molecular substances. The examples of such useful substance are as follows: polyvinyl alcohol, polyacrylamide, polymethacrylamide, polyvinyl butyral, polyethylene glycol, polyethylene glycol ester; proteins such as cellulose derivatives; natural materials including saccharides such as starch and gun arabic; and others. Such materials may be contained in the binder at a rate of 0–85 weight %, or preferably, 0–70 weight %.

In addition, the above vinyl pyrolidone polymers may be cross-linked polymers, but in this case, they are preferably applied on a support and then cross-linked (including the progress of the cross-linking reaction while they are allowed to stand).

The amount of binder to be used is usually 0.05–50 g, or preferably, 0.1–10 g per $m^2$ of one layer.

Also, the preferred amount of binder to be used is at a ratio of 0.1–10 g, preferably, 0.25–4 g per one g dye-supplying material.

The examples of useful supports used for the thermal developing light-sensitive material of the invention are as follows; synthetic plastic films, such as a polyethylene film, cellulose acetate film, polyethylene terephthalate film, polyvinyl chloride film and the like; paper supports, such as photographic paper, printing paper, baryta paper, resin-coated paper and the like; supports obtained by applying and setting electron beam-setting resin composite upon any of the above supports; and others.

With the thermal light-sensitive material of the invention, if the similar material is of a transfer type using an image-receiving member, various heat-melting solvents should be preferably contained in the thermal developing light-sensitive material of the invention and/or image-receiving member. The heat-melting solvent is a compound to promote the thermal development and/or the thermal transfer. As the examples of such a compound, the organic compound individually having polarity are available as disclosed in, for example, compounds as disclosed in U.S. Pat. Nos. 3,347,675, 3,667,959, Research Disclosure No. 17643 (XII), Japanese Patent O.P.I. Publication No. 229556/1984, Japanese Patent Application No. 47787/1984. Among them, those useful for the invention are urea derivatives (such as dimethylurea, diethylurea, phenylurea and the like), amide derivatives (such as acetamide, benzamide and the like), polyvalent alcohols (such as 1,5-pentanediol, 1,6-pentanediol, 1,2-cyclohexanediol, pentaerythritol, trimethylolethane and the like), or polyethylene glycol.

Furthermore, as a heat-melting solvent useful for the invention, a compound represented by the general formula (S) is available.

General formula (S)

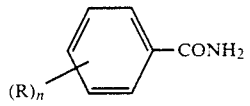

In this formula, n represents 1 or 2. When n=1, R represents a group, having 3 to 8, or favorably, 4 to 6 carbon atoms, such as an alkyl group (for example, i-propyl group, n-butyl group, t-butyl group, n-amyl group, i-amyl group, n-hexyl group, n-octyl group or to-octyl group), alkenyl group (for example, allyl group, crotyl group or i-crotyp group), alkoxy group (for example, n-butoxy group, n-amyloxy group, i-amyloxy group or n-hexyloxy group) or alkenyloxy group (for example, allyloxy group, crotyloxy group or i-crotyloxy group). When n=2, R represents a group, having 2 to 4 carbon atoms, such as an alkyl group (for example, ethyl group, propyl group or t-butyl group) or alkoxy group (for example, ethoxy group, n-propoxy group or n-butoxy group) or an alkenyloxy group having 3 to 4 carbon atoms (for example, allyloxyl group, crotyloxy group or i-crotyloxy group). Additionally, when n=2, the both groups independently represented by R may be identical or different to each other.

The typical examples of a compound of the invention represented by the above general formula are as follows: p-i-propylbenzamide, p-n-butylbenzamide, p-t-butylbenzamide, p-n-amylbenzamide, p-n-hexylbenzamide, p-n-octylbenzamide, p-allylbenzamide, p-n-butoxybenzamide, o-n-butoxybenzamide, m-n-butoxybenzamide, o-n-amyloxybenzamide, p-n-amyloxybenzamide, p-i-amyloxybenzamide, p-allyloxybenzamide, p-crotyloxybenzamide, o-i-crotyloxybenzamide, 3,5-diethylbenzamide, 3-ethyl-5-ethoxybenzamide, 2,4-diethoxybenzamide, 2,4-dipropoxybenzamide, 3,5-dipropoxybenzamide, 2,6-dipropoxybenzamide, 3,4-dibutoxybenzamide, 2,4-diallyloxybenzamide, 2,4-dicrotyloxybenzamide and 2,4-di-i-crotyloxybenzamide.

The compound of the invention represented by the above general formula (S) is synthesized with R-substituted benzoic acid, R-substituted benzoate, R-substituted cyanobenzene or the like in compliance with a synthesizing method disclosed for example in Synthetic Organic Chemistry pp. 565–589, by R. B. Wagner and H. D. Zook. Also the compound may be prepared by allowing hydroxybenzamide or dihydroxybenzamide to react with alkyl halide or alkenyl halide.

Among the above examples, the following water-insoluble solid heat melting solvents are more favorably used.

The water-insoluble solid heal melting solvents are compounds which are solid at a normal temperature but turn liquid at a higher temperature (higher than 60° C., preferably higher than 100° C., and in particular, higher than 130° C., but less than 250° C.) and they also have an inorganic-organic ratio ("Organic Schematics", by Yoshio Kohda, Sanyo Shuppan Co., Ltd., 1984) of 0.5–3.0, preferably, 0.7–2.5, and in particular, 1.0–2.0, as well as the water-solubility, at a normal temperature.

The typical examples of the water-insoluble solid heat melting solvent are listed below. However, the scope of the invention is not limited only to these examples.

Example water-insoluble solid heat melting solvents

| | Melting point (°C.) | Inorganic/organic |
|---|---|---|
| $C(Cl)_3CONH_2$ | 141° | 1.44 |
| 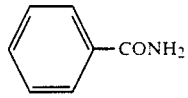  | 128° | 1.54 |

-continued
| | Melting point (°C.) | Inorganic/ organic |
|---|---|---|
| 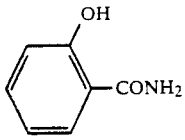 | 140° | 2.25 |
| 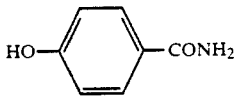 | 161° | 2.25 |
| 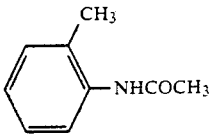 | 110° | 1.19 |
| 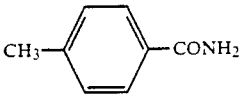 | 160° | 1.34 |
| 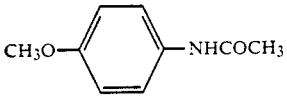 | 130° | 1.31 |
| 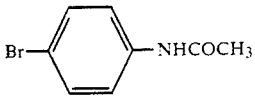 | 168° | 1.02 |
| 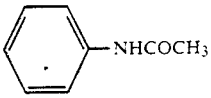 | 113~115° | 1.34 |
| 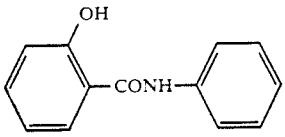 | 137° | 1.27 |
| 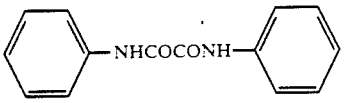 | 151~153° | 1.54 |
| 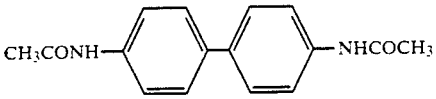 | Over 290° C. | 1.34 |
| 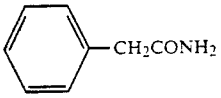 | 156° | 1.34 |
| 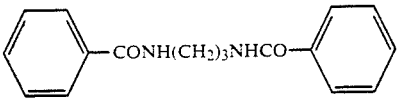 | 152~154° | 1.26 |

-continued
| | Melting point (°C.) | Inorganic/ organic |
|---|---|---|
| 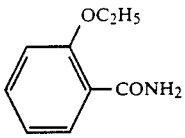 | 130° | 1.31 |
| 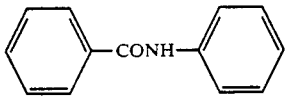 | 166° | 0.88 |
| 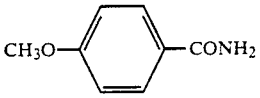 | 164 ~ 167° | 1.47 |
| 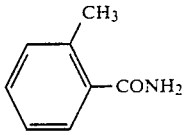 | 141 ~ 142° | 1.34 |
| 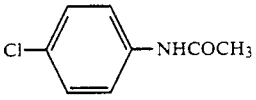 | 180° | 1.13 |
| 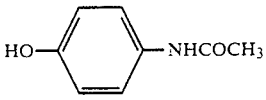 | 161° | 1.97 |
| 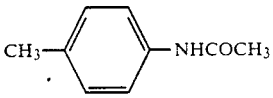 | 150° | 1.19 |
| 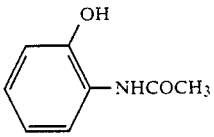 | 140° | 1.97 |
| 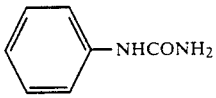 | 147° | 1.68 |
| 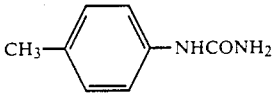 | 143° | 1.47 |
| 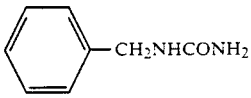 | 149° | 1.47 |
| 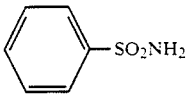 | 154° | 2.13 |

-continued

| | Melting point (°C.) | Inorganic/ organic |
|---|---|---|
| 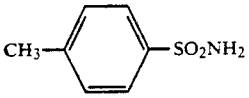 | 137° | 1.82 |
| 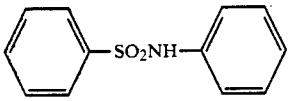 | 110° | 1.13 |
| 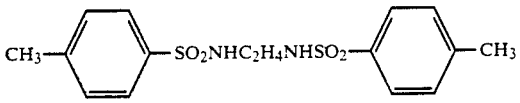 | 168° | 1.59 |
| 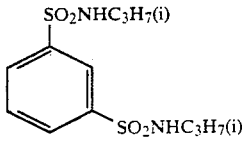 | 162~163° | 2.15 |
| 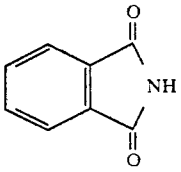 | 238° | 1.72 |
| 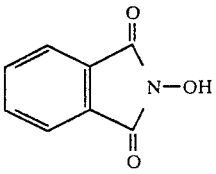 | 233° | 2.34 |
| 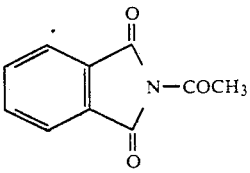 | 137° | 1.70 |
| 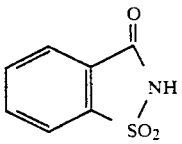 | 226° | 2.18 |

Many compounds used as the water-insoluble solid heat melting solvents are market-available, and be readily synthesized by the concerned manufacturers.

There is no mandatory method for adding the water-insoluble solid hot solvent into the light-sensitive material of the invention. The useful methods include a method, wherein the solvent is pulverized and distributed with a ballmill or sandmill, then added into the material, a method wherein the solvent is solved into an appropriate solvent to be added into the material, a method wherein the solvent is dissolved in high boiling solvent to prepare oil-in-water dispersion which is added into the material. However, the solvent should be favorably pulverized and distributed with a ballmill or sandmill, then added into the material, while its form, solid grains, are kept unchanged.

The layers where the above water-insoluble heat melting solvent is added include the light-sensitive silver halide layers, intermediate layers, protective layer, and an image receiving layer comprising image receiving member, in compliance with a requirement to ensure these layers may perform individual purposes.

. The amount of addition of water-insoluble heat melting solvent is usually 10–500 weight %, or preferably, 50–300 weight % per amount of binder.

Even if a melting point of water-insoluble solid heat melting solvent of the invention is higher than a thermal developing temperature, it can be satisfactorily used as a heat melting solvent, because it has been added into the binder, and this arrangement lowers the melting point.

In addition to the above-mentioned components, the thermal developing light-sensitive material of the invention may, in compliance with a requirement, contain various additives.

The examples of such additives are as follows: a melt-former, such as acetamide and imide succinate, as disclosed in U.S. Pat. No. 3,438,776: compounds, such as polyalkylene glycol, as disclosed in U.S. Pat. No. 3,666,477 and Japanese Patent O.P.I. Publication No. 19525/1976; water-insoluble polar organic compounds such as lactones respectively having a —CO— group, —$SO_2$— group and —SO— group, whose melting points being more than 20° C., as disclosed in U.S. Pat. No. 3,667,959; and others.

The examples further include the following; benzophenone derivatives disclosed in Japanese Patent O.P.I. Publication No. 115540/1974; phenol derivatives disclosed in Japanese Patent O.P.I. Publications No. 24829/1978 and No. 60223/1978; carboxylic acids disclosed in Japanese Patent O.P.I Publication No. 118640/1983; polyvalent alcohols disclosed in Japanese Patent O.P.I. Publication No. 198038/1983; sulfamoylamide compounds disclosed in Japanese Patent O.P.I. Publication No. 84236/1984; and others.

In addition, compounds known as toners in the field of thermal developing light-sensitive material may be incorporated as development accelerator into the thermal developing light-sensitive material of the invention. As disclosed in Japanese Patent O.P.I. Publications No. 4928/1971, No. 6077/1971, No. 5019/1974, No. 5020/1974, No. 91215/1974, No. 107727/1974, No. 2524/1975, No. 67132/1975, No. 67641/1975, No. 114217/1975, No. 33722/1977, No. 99813/1975, No. 1020/1978, No. 55115/1978, No. 76020/1978, No. 125014/1978, No. 156523/1979, No. 156524/1979, No. 156525/1979, No. 156526/1979, No. 4060/1980, No. 4061/1980, No. 32015/1980, West German Patents No. 2,140,406, 2,141,063, 2,220,618, U.S. Pat. Nos. 3,847,612, 3,782,941, 4,201,582, Japanese Patent O.P.I. Publications No. 207244/1982, No. 207245/1982, No. 189628/1983 and No. 193541/1983 and the like, the examples of toner are as follows; phthaladinone, phthalimide, pyrazolone, quinazolinone, N-hydrooxynaphthalimide, benzoxadine, naphthooxadinedione, 2,3-dihydro-phthaladinedione, 2,3-dihydro-1,3-oxadine-2,4-dione, oxypyridine, aminopyridine, hydroxyquinoline, aminoquinoline, isocarbostyryl, sulfonamide, 2H-1,3-benzothiadine-2,4-(3H)dione, benzotriazine, mercaptotriazole, dimercaptotetrazapentalene, aminomercaptotriazole, acylaminomercaptotriazole, phthalic acid, naphthalic acid phthalamine acid, and the like, and; mixtures of more than one of the above-mentioned and imidazole compounds; mixtures involving not only at least one of acids or acid anhydrides, such as phthalic acid, naphthalic acid or the like, but phthaladine compounds; mixtures involving any of phthaladine and maleic acid, itaconic acid, quinolic acid, genthidinic acid and the like.

The examples of useful anti-fogging agents are as follows: higher aliphatic compounds (such as behenic acid, stearic acid and the like) disclosed in U.S. Pat. No. 3,645,739; mercuric salts disclosed in Japanese Patent Examined Publication No. 11113/1982; N-halogen compounds (such as N-halogenoacetamide, N-halogenoimide succinate and the like) disclosed in Japanese Patent O.P.I. Publication No. 47419/1976; mercapto compound-emitting compounds disclosed in U.S. Pat. No. 3,700,457 and Japanese Patent O.P.I. Publication No. 50725/1976; arylsulfonic acids (such as benzenesulfonic acid and the like) disclosed in Japanese Patent O.P.I. Publication No. 125016/1974; lithium carboxylates (such as lithium laurate and the like) disclosed in Japanese Patent O.P.I. Publication No. 47419/1976; oxidizing agents (such as perchlorate, ion-organic peroxide, persulfate and the like) disclosed in British Patent No. 1,455,271 and Japanese Patent O.P.I. Publication No. 101019/1975; sulfinic or thiosulfonic acids disclosed in Japanese Patent O.P.I. Publication No. 19825/1978; 2-thiouracyls disclosed in Japanese Patent O.P.I. Publication No. 3232/1976; element sulfur disclosed in Japanese Patent O.P.I. Publication No. 26019/1976; disulfide and polysulfide compounds disclosed in Japanese Patent O.P.I. Publication No. 42529/1976, No. 81124/1976 and No. 93149/1980; rosins and diterpenes disclosed (such as abiethinic acid, pimalic acid and the like) disclosed in Japanese Patent O.P.I. Publication No. 57435/1976; polymeric acids independently having a free carboxyl group or sulfonic group, as disclosed in Japanese Patent O.P.I. Publication No. 104338/1976; thiazolinethione disclosed in U.S. Pat. No. 4,138,265; 1,2,4-triazole or 5-mercapto-1,2,4-triazole disclosed in Japanese Patent O.P.I. Publication No. 140833/1980 as well as U.S. Pat. No. 4,137,079; thisfulfinates disclosed in Japanese Patent O.P.I. Publication No. 140833/1980; 1,2,3,4-triazoles disclosed in Japanese Patent O.P.I. Publication No. 142331/1980; dihalogen compounds or trihalogen compounds disclosed in Japanese Patent O.P.I. Publications No. 46441/1984, No. 573233/1984 and No. 57234/1984 thiol compounds disclosed in Japanese Patent O.P.I. Publication No 111636/1984.

The examples of other preferred anti-fogging agents are as follows; hydroquinone derivatives (such as di-t-octylhydroquinone, dodecanylhydroquinone, and the like) disclosed in Japanese Patent Application No. 56506/1984; the combined use, as disclosed in Japanese Patent Application No. 66380/1984, involving hydroquinone derivative and benzotriazole derivative (for example, 4-sulfobenzotriazole, 5-carboxytriazole and the like).

The examples of still other particularly advantageous anti-fogging agent are as follows: restrainers, as disclosed in Japanese Patent Application No. 262177, independently having a hydrophilic group; polymer restrainers disclosed in Japanese Patent Application No. 263564/1985; compounds as disclosed in Japanese Patent Application No. 263565/1985, individually having a ballast group.

The examples of useful silver image stabilizer are as follows: polyhalogenated organic oxidizing agents (such as tetrabromobutaned, tribromoquinalidine and the like) disclosed in U.S. Pat. No. 3,707,377; 5-methoxycarbonylthio-1-phenyltetrazoles disclosed in Belgium Patent No. 768,071; monohalogenated compounds (such as 2-bromo-2-trylsulfonylacetamide and the like) disclosed in Japanese Patent O.P.I. Publication No. 119624/1975; bromine compounds (such as 2-bromomethylsulfonylbenzothiazole, 2,4-bis(tribromomethyl)-6-methyltrizine and the like) disclosed in Japanese Patent O.P.I. Publication No. 120328/1975; tribromoethanol disclosed in Japanese Patent O.P.I. Publication No. 46020/1978. In addition, monohalogenated organic anti-fogging agents for silver halide emulsions as disclosed in Japanese Patent O.P.I. Publication No. 119624/1975 may be used.

The examples of other useful image stabilizers are as follows: as disclosed in U.S. Pat. Nos. 3,220,846, 4,082,555 and 4,088,496, Japanese Patent O.P.I. Publication No. 22625/1975. Resarch Disclosure No. 12021, No. 15168, No. 15567, No. 15732, No. 15733, No. 15734 and No. 15766, the compounds, so-called activator precursors, being capable of releasing a basic substance by heat, and being typified by the compounds being capable of releasing a base by decarbonation due to heat, such as guanidiumtrichloro acetate, aldonamide compounds such as galactonamide, amineimides, 2-carboxycarboxyamide and other compounds; sodium phosphate base forming agents disclosed in Japanese Patent O.P.I. Publications No. 130745/1981 and No. 132332/1981; compounds being capable of forming amine by intramolecular nucleophilic reaction as disclosed in British Patent No. 2,079,480; aidoximecarbamates disclosed in Japanese Patent O.P.I. Publication No. 157637/1984; hydroxamic acid carbamates disclosed in Japanese Patent O.P.I. Publication No. 166943/1984; base-releasing agents disclosed in Japanese Patent O.P.I. Publications No. 180537/1984, No. 174830/1984 and No. 195237/1984.

Furthermore, irithiuronium compounds, s-carbamoyl compounds of mercapto-containing compounds, and nitrogen-containing heterocyclic compounds, as disclosed in U.S. Pat. Nos. 3,301,678, 3,506,444, 3,824,103 and 3,844,788, Research Disclosure No. 12035 and No. 18016, and the like, may be used to stabilize the image. Additionally, to accelerate the developing or to stabilize the image, the following may be used; as disclosed in U.S. Pat. Nos. 3,669,670, 4,012,260, 4,060,420 and 4,207,392, Research Disclosure No. 15109 and No. 17711, the nitrogen-containing organic bases called activator-stabilizers or activator stabilizer precursors, for example α-sulfonyl acetate of 2-aminothiazoline, or trichloro acetate and acylhydrozine compound.

In addition, as disclosed in Japanese Patent O.P.I. Publications No. 130745/1981 and No. 218443/1984, the development may be exercised in the presence of only a small amount of water, or to develop the light-sensitive material of the invention, a small amount of water may be sprayed or applied onto the material for supplying water thereto, before the material is heated. Furthermore, as mentioned in U.S. Pat. No. 3,312,550 and others, the material may be developed with a hot steam, or a blast containing moisture. Or, otherwise, as disclosed in Japanese Patent Examined Publication No. 26582/1969, a compound having crystalization water such as sodium phosphate $12H_2O$, ammonium alum. $24H_2O$ or the like may be contained in the thermal developing light-sensitive material.

The similar light-sensitive material may also have various additives and coating aids such as an anti-halation dye, fluorescent whitening agent, hardeners, anti-static agent, plasticizer, spreading agent and the like.

In order to improve the film property, the thermal developing light-sensitive material of the invention may contain colloidal silica in the heat developing light-sensitive layer and/or non-light-sensitive layers (such as a subbing layer, intermediate layers, protective layer and the like).

The colloidal silica useful for the invention is the colloid solution of silieic anhydride having a mean grain size or trichloro acetate and acylhydrozine compound.

In addition, as disclosed in Japanese Patent O.P.I. Publications No. 130745/1981 and No. 218443/1984, the development may be exercised in the presence of only a small amount of water, or to develop the light-sensitive material of the invention, a small amount of water may be sprayed or applied onto the material for supplying water thereto, before the material is heated. Furthermore, as mentioned in U.S. Pat. No. 3,312,550 and others, the material may be developed with a hot steam, or a blast containing moisture. Or, otherwise, as disclosed in Japanese Patent Examined Publication No. 26582/1969, a compound having crystalization water such as sodium phosphate.$12H_2O$, ammonium alum.$24H_2O$ or the like may be contained in the thermal developing light-sensitive material.

The similar light-sensitive material may also have various additives and coating aids such as an anti-halation dye, fluorescent whitening agent, hardeners, anti-static agent, plasticizer, spreading agent and the like.

In order to improve the film property, the thermal developing light-sensitive material of the invention may contain colloidal silica in the heat developing light-sensitive layer and/or non-light-sensitive layers (such as a subbing layer, intermediate layers, protective layer and the like).

The colloidal silica useful for the invention is in the form of a colloid solution comprising silicic anhydride grains having a mean grain size of 3–120 μm and a dispersion medium mainly composed of water. The main component of the solution is $SiO_2$ (silicon dioxide). Such colloidal silica is disclosed in Japanese Patent O.P.I. Publications No. 109336/1981, No. 123916/1978, No. 112732/1978, No. 100226/1978 and others. The preferred amount of colloidal silica to be used is, in terms of dry weight, 0.05–2.0 against the amount of binder in the layer made of the mixture involving such colloidal silica and the binder.

Organic fluoro compounds may be incorporated into the thermal developing light-sensitive layer and/or non-light-sensitive-layers (such as the subbing layer, intermediate layers, protective layer and others) of the thermal developing light-sensitive material of the invention, in order to improved the film property of the layers.

The useful organic fluoro compounds used for the invention are disclosed in U.S. Pat. Nos. 3,589,906, 3,666,478, 3,754,924, 3,775,126 and 3,850,640, West German OLS Patents No. 1,924,665, No. 1,961,638 and No. 2,124,262, British Patent No. 1,330,356, Belgium Patent No. 742,680, Japanese Patent O.P.I. Publications No. 7781/1971, No. 9715/1973, No. 46733/1974, No. 133023/1974, No. 99529/1975, No. 160034/1975, No. 43131/1976, No. 129229/1976, No. 106419/1976, No. 84712/1978, No. 111330/1979, No. 109336/1981, No. 30536/1984 and No. 45441/1984, Japanese Patent Examined Publications No. 9303/1972, No. 43130/1973 and No. 5887/1974, and others.

Anti-static agents can be added into the thermal developing light-sensitive layer and/or non-light-sensitive layers (such as the subbing layer, intermediate layers, protective layer and the like) of the thermal developing light-sensitive material of the invention.

The preferred anti-static agents for the invention are the compounds disclosed in British Patent No. 1,466,600, Research Disclosure No. 15840, No. 16258 and No. 16630 issues, U.S. Pat. Nos. 2,327,828, 2,861,056, 3,206,312, 3,245,833, 3,428,451, 3,775,126, 3,963,498, 4,025,342, 4,025,463, 4,025,691, 4,025,704, and others.

Ultraviolet absorbents can be added into the thermal developing light-sensitive layer and/or non-light-sensitive layers (such as the subbing layer, intermediate layers, protective layer and the like) of the thermal developing light-sensitive material of the invention.

The examples of useful ultraviolet absorbent for the invention are as follows: benzophenone compounds such as those disclosed in Japanese Patent O.P.I. Publication No. 2784/1971, U.S. Pat. Nos. 3,215,530 and 3,698,907); butadiene compounds such as those disclosed in U.S. Pat. No. 4,045,229); 4-thiazolidone compounds such as those disclosed in U.S. Pat. Nos. 3,314,794 and 3,352,681); aryl-substituted benzotriazole compounds such as those disclosed in Japanese Patent Examined Publications No. 10466/1958, No. 1687/1966, No. 26187/1967, No. 29620/1969 and No. 41572/1973, Japanese Patent O.P.I. Publications No. 95233/1979 and No. 142975/1982, U.S. Pat. Nos. 3,253,921, 3,533,794, 3,754,919, 3,794,493, 4,009,038, 4,220,711 and 4,323,633, Research Disclosure No. 22519 issue; benzoxidole compounds such as those disclosed in U.S. Pat. No. 3,700,455; cinnamate compounds such as those disclosed in U.S. Pat. Nos. 3,705,805 and 3,707,375, Japanese Patent O.P.I. Publication No. 49029/1977. Additionally, those disclosed in U.S. Pat. No. 3,499,762 and Japanese Patent O.P.I. Publication No. 48535/1979 can be used too. Furthermore, ultraviolet absorbing couplers (such as $\alpha$-naphthol cyan-dye forming couplers), ultraviolet absorbing polymers (such as those disclosed in Japanese Patent O.P.I. Publications No. 111942/1983, No. 178351/1983, No. 181041/1983, No. 19945/1984 and No. 23344/1984.

Hardeners can be added into the thermal developing light-sensitive layer and/or non-light-sensitive layers (such as the subbing layer, intermediate layers, protective layer and the like) of the thermal developing light-sensitive material of the invention.

According to the invention, the examples of useful hardeners are as follows: aldehyde or aziridine hardeners such as those disclosed in PB Report No. 19,921, U.S. Pat. Nos. 2,950,197, 2,964,404, 2,983,611 and 3,271,175, Japanese Patent Examined Publication No. 40898/1971, Japanese Patent O.P.I. Publication No. 91315/1974; issoxazoles such as those disclosed in U.S. Pat. No. 331,609; epoxy hardeners such as those disclosed in U.S. Pat. No. 3,047,394, West German Patent No. 1,085,663, British Patent No. 1,033,518, and Japanese Patent Examined Publication No. 35495/1973 sinylsulfone hardeners such as those disclosed in Photographic Business Report No. 19,920, West German Patents No. 1,100,942, No. 2,337,412, No. 2,545,722, No. 2,635,518, No. 2,742,308 and No. 2,749,260, British Patent No. 1,251,091, Japanese Patent Applications No. 54236/1970 and No. 110996/1973, U.S. Pat. Nos. 3,539,644 and 3,490,911; acryloyl hardeners such as those disclosed in Japanese Patent Application No. 27949/1973 and U.S. Pat. No. 3,640,720; carbodiimide hardeners such as those disclosed in U.S. Pat. Nos. 2,938,892, 4,043,818, 4,061,499, Japanese Patent Examined Publication No. 38715/1971, Japanese Patent Application No. 15095/1974; triazine hardeners such as those disclosed in West German Patents No. 2,410,973 and No. 2,553,915, U.S. Pat. No. 3,325,287, and Japanese Patent O.P.I. Publication No. 12722/1977. In addition, maleimide-, acethylene-, methansulfonate- and N-methylol hardeners may be also singly used, or otherwise, more than two of such hardeners may be combinedly used. The examples of advantageous combination are disclosed in West German Patents No. 2,447,587, No. 2,505,746 and No. 2,514,245, U.S. Pat. Nos. 4,047,957, 3,832,181 and 3,840,370, Japanese Patent O.P.I. Publications No. 43319/1973, No. 63062/1975 and No. 127329/1977, and Japanese Patent Examined Publication No. 32364.

High polymer hardeners can be added into the thermal developing light-sensitive layer and/or non-light-sensitive layers (such as the subbing layer, intermediate layers, protective layer and the like) of the thermal developing light-sensitive material of the invention.

According to the invention, the examples of useful high polymer hardeners are as follows: as disclosed in U.S. Pat. No. 3,396,029 and others, polymers having an aldehyde group (for example, copolymer of acroleine, or the like); polymers having dichlorotriazine group, as disclosed in U.S. Pat. No. 3,362,827, and Research Disclosure No. 17333 (1978); polymers having an epoxy group, as disclosed in U.S. Pat. No. 3,623,878; polymers having an active vinyl group or a precursor of such an active vinyl group, as disclosed in Research Disclosure No. 16725 (1978), U.S. Pat. No. 4,161,407, Japanese Patent O.P.I. Publications No. 65033/1979 and No. 142524/1981; polymers having an active ester group.

In order to improve the film property, the thermal developing light-sensitive material of the invention may contain polymer latex in the heat developing light-sensitive layer and/or non-light-sensitive layers (such as a subbing layer, intermediate layers, protective layer and the like).

The examples of useful polymer latex, according to the invention, include polymethyl acrylate, polyethyl acrylate, poly-n-butyl acrylate, copolymer of ethylacrylate and acrylic acid, copolymer of vinylidene chloride and butyl acrylate, copolymer of butyl acrylate and acrylic acid, copolymer of vinyl acetate and butyl acrylate, copolymer of vinyl acetate and ethyl acrylate, copolymer of ethyl acrylate and 2-acrylamide.

The preferred mean grain size of polymer latex grains is 0.02–0.2 $\mu$m. The amount of polymer latex to be used is, in terms of dry weight, 0.03–0.5 per amount of binder in the layer where the latex is incorporated.

In order to improve the film property, the thermal developing light-sensitive material of the invention may contain various surface active agents in the heat developing light-sensitive layer and/or non-light-sensitive layers (such as a subbing layer, intermediate layers, protective layer and the like).

The surface active agents used for the invention are whichever of anionic, amphoteric or nonionic surface active agents.

The preferred examples of anionic surface active agent, having any of acid groups such as carboxy group, sulfo group, phospho group, sulfate, phosphate or the like, include alkyl carbonate, alkyl sulfonate, alkylbenzene sulfonate, alkyl naphthalene sulfonate, alkyl sulfate, alkyl phosphate, N-acyl-N-alkyltaurine, sulfosuaccinate, sulfoalkylpolyoxyethylenealkylphenyl ether polyoxyethylenealkylphosphate and others.

The preferred examples of cationic surface active agent include alkyl amine salt, aliphatic or aromatic quaternary ammonium salt, heterocyclic quaternary ammonium salts such as pyridinium and imidazolium, aliphatic phosphonium or sulfonium salt, or phosphonium or sulfonium having a heterocycle.

The preferred examples of amphoteric surface active agent include amino acid, aminoalkylsulfonic acid, aminoalkyl sulfate, aminoalkyl phosphate, alkylbetaine and the like.

The preferred examples of nonionic surface active agent include saponine (steroide class), alkyleneoxide derivative (such as polyethylene glycol, polyethylene glycol-polypropylene glycol condensate, polyethyleneglycolalkylethers or polyethyleneglycolalkylarylethers, polyethyleneglycol esters, polyethyleneglycolsorbtan esters, polyalkyleneglycolalkylamines or amides, polyethyleneoxide-adducts of silicon), glycidol derivatives (such as alkenylsuccinic polyglyceride and alkylphenolpolyglyceride), aliphatates of polyvalent alcohol, alkyl esters of sugar, and the like.

In order to improve the developability, transfer property of image forming dye, and optical properties, non-light-sensitive silver halide gains may be incorporated into the thermal developing light-sensitive layer and/or non-light-sensitive layers (such as a subbing layer, intermediate layers, protective layer and the like) of the thermal developing light-sensitive material of the invention.

The non-light-sensitive silver halide grains used for the invention may have any silver halide composition arbitrarily containing any of silver chloride, silver bromide, silver iodide, silver iodo-bromide, silver chloro-bromide, silver chloro-bromo-iodide and the like. The preferred average grain size of such non-light-sensitive silver halide grains is less than 0.3 $\mu$m. The amount of such silver halide to be added is, in terms of silver-converted value, at a rate of 0.02–3 g per $m^2$ of a layer where the silver halide is incorporated.

In order to improve the film property, the thermal developing light-sensitive material of the invention may contain vinyl polymer, having a carboxyl group or sulfo group and disclosed in Japanese Patent O.P.I. Publication No. 104338/1976, in the heat developing light-sensitive layer and/or non-light-sensitive layers (such as a subbing layer, intermediate layers, protective layer and the like).

The amount of such vinyl polymer to be used is, in terms of dry weight ratio, 0.05–2.0 against amount of binder in the layer where such vinyl polymer is added.

Favorably, the thermal developing light-sensitive material of the invention should be provided with a protective layer. Such a layer is hereinunder called the protective layer of the invention.

Various additives sued in the photographic art are added into the protective layer of the invention. The examples of useful additive include various matting agents, colloidal silica, lubricants, organic fluoro compounds (in particular, fluorine surface active agent), anti-static agents, ultraviolet absorbents, high boiling organic solvent, antioxidants, hydroquinone derivatives, polymer latex, surface active agents (including high molecular surface active agents), hardeners (including high molecular hardeners), organic silver grains, non-light-sensitive silver halide grains, and others.

The matting agent used in the protective layer of the invention is made of fine particles of inorganic or organic substance. This agent is added in the thermal developing light-sensitive material in order to coarse the surface and provide it with a mat texture. In compliance with a method well known in the art, a matting is used in order to prevent the mutual sticking of light-sensitive material during preparation, storage and actual use, or the generation of triboelectricity which may occur due to the contact and friction with or peeling off from a similar or different type of light-sensitive material. The typical examples of matting agent are as follows; silicon dioxide disclosed in Japanese Patent O.P.I. Publication No. 46316/1975; alkali soluble matting agents, such as alkyl methacryrate-methacrilic acid copolymer, disclosed in Japanese Patent O.P.I. Publications No. 7231/1978, No. 66937/1973 and No. 8894/1985; alkali souble polymer, having an anionic group, disclosed in Japanese Patent O.P.I. Publication No. 166341/1973; mixture of, as disclosed in Japanese Patent O.P.I. Publication No. 145935/1973, more than two types of fine particles each type having individual Moh's hardness; combination of oil drops and fine particles as disclosed in Japanese Patent O.P.I. Publication No. 1447734/1973; combination of more than to types of sphericalgrain matting agent, each type having an individual average grain size, disclosed in Japanese Patent O.P.I. Publication No. 149356/1984; combination of fluorine surface active agent and matting agent, as disclosed in Japanese Patent O.P.I. Publication No. 44411/1981; organic matting agents disclosed in British Patent No. 1,055,713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924 and 3,767,448, Japanese Patent O.P.I. Publications No. 106821/1974 and No. 14835/1972, and others; inorganic matting agents disclosed in West Germany Patent No. 2,529,321, British Patents No. 760,775 and No. 1,260,772, U.S. Pat. Nos. 1,201,905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245 and 4,029,504; matting agents independently having unique properties, as disclosed in Japanese Patent O.P.I. Publications No. 7781/1971, No. 106821/1974, No. 6017/1976, No. 116143/1978, No. 100226/1978, No. 14835/1982, No. 82832/1982, No. 70426/1978 and No. 149357/1984, Japanese Patent Examined Publication No. 9053/1982, and EP - 107,378 issue, and others.

The matting agent should be added into the protective layer of the invention at a rate of 10 mg–2.0 g, or more favorably, 20 mg–1.0 g per $m^2$ layer. The preferred average grain size of the matting agent is 0.5–10 $\mu$m, or more specifically, 1.0–6 $\mu$m.

More than two types of the above matting agents may be combinedly used.

The lubricants used in the protective layer of the invention include solid paraffin, oil, surface active agent, natural wax, synthesized wax and the like, and more specifically, those preferred are disclosed in the following: French Patent No. 2,180,465, British Patents No. 955,061, No. 1,143,118, No. 1,270,578, No. 1,320,564 and No. 1,320,757, Japanese Patent O.P.I. Publications No. 5017/1974, No. 141623/1976, No. 159221/1979 and No. 81841/1981, Research Disclosure No. 13969 issue, U.S. Pat. Nos. 1,263,722, 2,588,765, 2,739,891, 3,018,178, 3,042,522, 3,080,317, 3,082,087, 3,121,060, 3,222,178, 3,295,979, 3,489,567, 3,516,832, 3,658,573, 3,679,411 and 3,870,521, and others.

To improve the film deposition, or to improve the vulnerability or to enhance to sliding property, the protective layer of the invention may contain oil-in water dispersion having oil drops of emulsified and dispersed water-insoluble compound, such as high-boiling organic solvent. In addition, photographic additives may be added into such oil-in-water dispersion, in compliance with a requirement. The preferred examples of such high boiling organic solvent are as follows: as disclosed in U.S. Pat. Nos. 2,322,027, 2,533,514 and 2,882,157, Japanese Patent Examined Publication No. 23233/1971, 1971, British Patents No. 958,441 and No. 1,222,753, U.S. Pat. Nos. 2,353,262, 3,676,142 and 3,700,454, Japanese Patent O.P.I. Publications No. 82078/1975 and No. 141623/1976, esters (such as phthalates, phosphates, aliphatates and the like), amides (such as aliphatic amide, sulfonic amide and the like), ethers, alcohols, paraffins and others.

The useful binders used in the protective layer of the invention are synthetic or natural high molecular substances, such as polyvinyl butyral, vinyl polyacetate, ethylcellulose, polymethyl methacrylate, celluloseacetatebutylate, polyvinyl alcohol, polyvinyl pyrolidone, polyethylxazoline, polyacrylamide, gelatin, phthalated gelatin and others. These may be singly used, or more than two of them may be combinedly used.

In particular, it is preferably to use gelatin (including gelatin derivative), polyvinylpyrolidone (preferably, having a molecular weight of 1000–400000), polyvinyl alcohol (preferably, having a molecular weight of 1000–100000) and polyoxazoline (preferably, having a molecular weight of 1000–800000) These may be singly used, or otherwise, a composite binder having more than two of them may be used. More specifically, a binder exclusively composed of gelatin, or a binder composed of gelatin as well as a hydrophilic polymer, having high compatibility with gelatin, such as the above polyvinyl pyrolidone, polyvinyl alcohol and polyoxazoline or the like. Gelatin may be lime-treated, or acid-treated gelatin, or ion exchange-treated gelatin, or may be ossein gelatin pig-skin gelatin, hyde-gelatin, or any of the modified gelatins, such as the estrificated or phenylcarbamoyl gelatin derived from the any of the above natural gelatins.

The preferred film thickness of the protective layer of the invention is 0.05–5 μm, or more specifically, 0.1–1.0 μm. The protective layer may comprise single layer or more than two layers.

It is also preferable that the hardness of the protective layer be set larger than that of the light-sensitive layer in order to enhance the film hardness and to prevent the damage in the film. As a method to set the film hardness of protective layer larger than that of light-sensitive layer, in other words, as a method to control the film hardness of individual layers, the method to use a diffusion-resistant hardeners, whereby, by incorporating such diffusion-resistant hardeners into the protective layer, the film hardness of protective layer can be made larger than that of light-sensitive layer. As a diffusion-resistant hardener, high-molecular hardeners are known in the art, and the examples of such useful hardener are disclosed in U.S. Pat. Nos. 3,057,723, 3,396,029 and 4,161,407, Japanese Patent O.P.I. Publications No. 50528/1983, and others.

With another method to control the film hardness of individual layer, the film hardness of protective layer can be made larger than that of light-sensitive layer, wherein a diffusible hardener (such as vinylsulfone hardener) is incorporated only in the protective layer, or the amount of hardener in the protective layer is set larger than that in the light-sensitive layer, whereby being applied by the multi-layer coating method, the multi-layered emulsions are drastically dried.

An image-receiving layer of the image-receiving member being capable of receiving dyes, in the thermal developing light-sensitive layer, released or formed by the thermal development is satisfactorily used in the invention. For forming such a layer, the polymers having, for example, tertiary amine or quaternary ammonium salt, in particular, the polymers disclosed in U.S. Pat. No. 3,709,690 are favorably used. More specifically, one example of polymer independently having ammonium salt, is a polymer comprising polystyrene-co-N,N,N-tri-n-hexyl-N-vinyl and benzylammonium-chloride at a ratio of 1:4 to 4:1, or more favorably, 1:1. As an example of a polymer having tertiary amine, polyvinyl pyridine and the like are available. The typical image-receiving layer for diffusion transfer is prepared by applying the blend involving a polymer containing ammonium salt, tertiary amine or the like, and gelatin, polyvinyl alcohol or the like, onto a support. Still other examples of useful dye-receiving material include, as disclosed in Japanese Patent O.P.I. Publications No. 207250/1982 and the like, those comprising heat-resistant organic high-molecular material whose glass transition temperature is higher than 40° C. and lower than 250° C.

Such a polymer may be disposed as an image receiving layer on a support, or the polymer itself may be used as a support.

The examples of the above-mentioned heat-resistant organic high molecular material are as follows; polystyrene, polystyrene derivative having a substituent with less than four carbon atoms, polyvinyl cyclohexane, polyvinyl benzene, polyvinyl pyrolidone, polyvinyl carbazole, polyallyl benzene, polyvinyl alcohol; polyacetals such as polyvinylformal and polyvinyl butyral; polyvinyl chloride, chlorinated polyethylene, poly-trichloro-fluorinated ethylene, polyacrylonitrile, poly-N,N-dimethylallyamide; polyacrylates having a p-cyanophenyl group, pentachlorophenyl group or 2,4-dichlorophenyl group; polyesters such as polyacrylchloro acrylate, polymethyl methacrylate, polyethyl methacrylate, polypropyl methacrylate, polyisopropyl methacrylate, polyisobutyl methacrylate, polytert-butyl methacrylate, polycyclohexyl methacrylate, polyethyleneglycol dimethacrylate, poly-2-cyano-ethylmethacrylate, polyethylene terephthalate and the like; polysulfones; polycarbonates such as bisphenol-A-polycarbonate; polyanhydrides; polyamides; cellulose acetates; and others. Additionally, the synthetic polymers respectively having a glass transition point of less than 40° C. and disclosed in Polymer Handbook, Second Edition, compiled by J. Brandrup, H. Immergut, published from John Wiley & Sons, are also useful. Usually, the preferred molecular weights of the above high molecular materials are within a range of 2000 to 200000. These high molecular materials may be singly used, or a blend of involving more than two of them may be used, or otherwise, more than two of them may be formed into a copolymer to be used.

The examples of useful polymers are as follows: cellulose acetage such as triacetate, diacetate and the like; polyamides composed of heptamethylene diamine and terephthalic acid, fluorenediporopylamine and adipic acid, hexamethylenediamine and diphenic acid, hexamethylenediamine and isophthalic acid, or of another combination; polyesters composed of diethylene glycol and diphenylcarboxylic acid, bis-p-carboxyphenoxybutane and ethylene glycol, or of another combination; polyethylene terephthalate; polycarbonate. Such polymers may be of modified types. In addition, polyethylene terephthalate modified with cyclohexanedimethanol, methoxypolyethyleneglycol, 1,2-dicarbomethoxy-4-benzenesulfonic acid or the like is useful.

The examples of especially favorable image receiving layer are as follows; a layer, as disclosed in Japanese Patent O.P.I. Publications No. 223425/1984, composed of vinyl chloride; a layer, as disclosed in Japanese Patent O.P.I. Publications No. 19138/1985, composed of polycarbonate and plasticizer.

Using these polymers, a support also serving as an image receiving layer (image receiving member) may be formed. In this case, the support may be composed of single layer, or of a plurality of layers.

As an image-receiving support, a transparent support, opaque support and the like may be arbitrarily used. The examples of a support useful for this purpose are as follows; films made of polyethylene terephthalate, polycarbonate, polystyrene, polyvinyl chloride, polyethylene, polypropylene or the like; a support made of one of above materials and containing colorant such as titanium oxide, barium sulfate, calcium carbonate, talc or the like; baryta paper; RC paper made of a paper having a lamination of thermoplastic resin containing colorant; cloth; glass; metal such as aluminum or the like; a support comprising any of such a support on which colorant-containing electron-setting resin component is applied and set; a support comprising such a support on which coat of colorant-containing layer is formed.

Allowing the use as an image-receiving member without any modification, because of the resin layer readily used as an image-receiving layer, the following supports are especially advantageous; a support comprising a paper sheet, applied and dried thereonto, an electron-setting resin component containing colorant; a support comprising a paper sheet, provided thereon, a colorant-containing layer, onto which an electronsetting resin component is applied and dried.

If the invention is applied to the thermal developing color light-sensitive material, any of the above-mentioned various polymers also serving as a mordant for a dye image may be used as an image-receiving layer. Such an image-receiving layer may be either an independent image-receiving component formed on an appropriate support and having an image-receiving layer, or a single layer which is a part of the thermal developing color light-sensitive material. If necessary, the light-sensitive material may have an opaque layer (reflective layer), which is used to reflect radiant ray such as visible ray strong enough for enabling the visual observation of a dye image in an image-receiving layer. The opaque layer (reflective layer) may contain various chemical agents, such as titanium oxide, to provide enough reflection.

The image-receiving layer in the image-receiving member may be the similar layer which is peeled off from the thermal developing light-sensitive layer. Otherwise, after the thermal developing color light-sensitive material is subjected to the imagewise exposure, the image-receiving layer placed on the thermal developing light-sensitive layer can be uniformly developed by heat. Additionally, after the thermal developing color light-sensitive material is subjected to the imagewise exposing as well as uniform thermal developing, the image-receiving layer placed on the material is heated with a temperature lower than the developing temperature, so as to transfer the dye image emitted from or formed by the dye supplying material onto the light-sensitive material.

After the imagewise exposure, the thermal developing light-sensitive material of the invention is readily developed, by subjecting to a temperature usually of 80°-200° C., or favorably, 100°-170° C., for 1-180 seconds, or favorably, 1.5-120 seconds. The transfer of diffusible dye onto the image-receiving layer may be effected simultaneously with the thermal developing, simply by contactly placing the image-receiving layer of the image-receiving member onto the light-sensitive surface of the light-sensitive material during the developing. Or, otherwise the similar transfer may be also effected after the thermal developing, by simply heating the light-sensitive material closely placed onto the image-receiving member, or by supplying water onto the material, and closely contacting the material and the image-receiving member, then, if necessary, subjecting them to reheating. Additionally, the preheating at a temperature of 70°-180° C. before the exposing may be also effected. Also, as mentioned in Japanese Patent O.P.I. Publication No. 143339/1985 and Japanese Patent Examined Publication No. 3644/1985, the light-sensitive material and the image-receiving member may be independently preheated immediately before the thermal developing/transferring, in order to ensure the mutual contact between them.

For the thermal developing light-sensitive material may be exposed by various means. The latent image is obtained by the imagewise exposing with the radiant ray involving visible ray. Usually, the light-sources useful for conventional color print, such as tungsten lamp, mercury-vapor lamp, xenon lamp, laser beam, CRT beam and the like, may be used.

Every method, useful for the conventional thermal developing light-sensitive material, can be used as a means for heating. The typical methods are as follows: a heating method to contact the material with a heated block, plate, heat-roller or heat drum; a heating method, wherein the material is subjected to high-temperature atmosphere; a method to use high-frequency heating; a method, wherein an electroconductive layer containing an electroconductive material such as carbon black is formed on the rear surface of the light-sensitive material of the invention, or on the rear surface of the heat transfer image receiving member, whereby the Joule heat derived from the electrical current flowing through the electroconductive material is utilized. There is no specific heating pattern. Accordingly, a once preheated light-sensitive material may be later reheated, or the similar material may be subjected to a heating program for a short time at a high temperature, or for a long time at a low temperature, or a heating program, wherein the temperature is repeatedly raised then dropped, or, otherwise the similar material may be heated intermittently. However, the simpler procedure is advantageous. Additionally, a method, wherein the exposing and the heating are simultaneously effected, may be employed.

Further, the thermal developing light-sensitive material of the present invention may be processed by the use of an automatic processing apparatus as shown in FIG. 1.

Naturally, the compound of the invention is also effective for the thermal light-sensitive material (dry silver) with which and image is formed only on silver.

EXAMPLES OF THE INVENTION

The present invention is hereinunder described in detail with the reference to the examples, however, the scope of embodiment of the invention is not limited only to these examples.

EXAMPLE 1

Preparation of light-sensitive silver halide

Into a mixer disclosed in Japanese Patent O.P.I. Publications No. 92523/1982 and No. 92524/1982, a solution A containing 20 g ossein gelatin, 1000 ml distilled water and ammonia, 500 ml aqueous solution B containing 11.62 g potassium iodide and 130.9 g potassium bromide and 500 $m^2$, and 500 ml aqueous solution C containing one mol silver nitrate and ammonia were poured while the pAg and pH being kept constant. Additionally, by controllingly adding the solutions B and C, the cubic core grains individually having 7 mol % silver iodide content and an average diameter of 0.15 μm were prepared. Next, with the same procedure, the 0.05 μm thick shell having one mol % silver halide content was formed on an individual core grain, thus cubic core/shell silver iodo-bromide grains individually having an average diameter of 0.2 μm were prepared. (The degree of mono-dispersion was 8%.) The yield after water-rinsing and desalination was 700 ml.

Preparation of light-sensitive silver halide dispersion (1)

The silver halide grains, prepared in the above step, were sensitized in accordance with the sulfur sensitization using sodium thiosulfate in the presence of the light-sensitive silver halide dispersion having the following composition was prepared.

| | |
|---|---|
| Above light-sensitive silver halide | 700 ml |
| Gelatin | 32 g |
| Sodium thosulfate | 10 mg |
| 0.5% methanol solution of spectral sensitizing dye (1) | 170 ml |
| Distilled water to prepare 2820 ml solution | |

Spectral sensitizing dye (1)

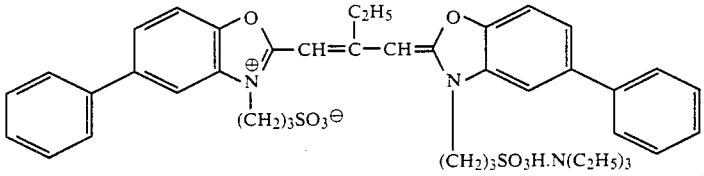

Preparation of organic silver salt dispersion 28.8 g 5-methylbenzotriazole silver prepared by allowing 5-methylbenzotriazole to react with silver nitrate in water-methanol mixture solvent, and 150 ml water containing 16.0 g poly-N-vinylpyrolidone were emulsified by using an alumina ball mill at the pH of 5.5 in order to prepare 200 ml 5-methylbenzotriazole silver dispersion.

Preparation of dispersion of magenta-dye supplying material 46.6 g example dye supplying material (PM - 4) and 2.5 g 2,5-di-t-octylhydroquinone were dissolved in 200 $m^2$ ethyl acetate, whereby the solution was blended with 124 ml aqueous solution containing 5 weight % of Alkanol XC (manufactured by DuPont) and 720 ml aqueous solution containing 30.5 g of phenylcarbamoyl gelatin, whereby the resultant solution was emulsified with an ultrasonic homogenizer, then ethyl acetate was removed by distillation and the pH of solution was adjusted to 5.5. In this way, 795 ml of magenta-dye-supplying material dispersion (1) was prepared.

Preparation of reducing agent solution (1)

23.2 g example reducing agent (R - 11), 14.6 g poly(N-vinylpyrolidone) (molecular weight, 30000) and 0.6 g of the following fluorine surface active agent were dissolved in water, whereby the pH was adjusted to 5.5, thus 250 ml of the reducing agent solution (1) was prepared.

Fluorine surface active agent

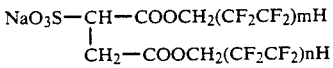

(m and n respectively represent 2 or 3)

Preparation of heat melting solvent dispersion 430 g of p-tolamide, and 1410 ml aqueous solution containing 1.0 weight % polyvinylpyrolidone (K - 90) were emulsified by using a ball mill, thus the heat melting solvent dispersion was prepared.

Preparation of thermal developing light-sensitive material (1)

6.0 ml light-sensitive silver halide dispersion, 4.20 ml organic silver dispersion, 26.5 ml of dye-supplying material dispersion (1), 4.2 ml reducing agent solution, and 14.8 g heat melting solvent dispersion, each having been prepared in above steps, as well as 7.6 ml of 10% aqueous solution containing a mixture of phenylcarbamoyl gelatin and gelatin were blended together. Next, as a hardener, a solution prepared in the following manner was added into the above mixture; tetra (vinylsulfonylmethyl)methane was allowed to react with tarine at a ratio of 1:1 (weight ratio), then the reaction product was dissolved in 1% aqueous phenylcarbamoyl gelatin solution, whereby the resultant solution was treated so as to have 3 weight % tetra(vinylsulfonylmethyl)methane, then the solution was further treated with 2.50 ml of 10% citric acid so as to have the pH level of 5.5. Subsequently, the prepared coating solution was applied and dried onto a subbing layer provided on a 180 μm thick photographic polyethylene terephthalate film so that the rate of coated silver is 1.31 g/$m^2$. Furthermore, upon the above layer was formed a protective layer by using the above phenylcarbamoyl gelatin, gelatin, poly(N-vinylpyrolidone) and p-tolamide.

Next, the thermal developing light-sensitive materials (2) through (13) were prepared in a manner identical to that for the thermal developing light-sensitive material (1) except that for each of these materials the compounds represented by the general formulae (1) and (2) according to the invention were correspondingly added in compliance with the combinations as listed in Table - 1.

TABLE 1

The figure in ( ) indicates the amount of addition per mol silver halide in terms of mol.

| Light-sensitive material Sample No. | Desensitazation ratio (%) | Compounds of formula (1) and (2) | Minimum density (fogging) | Maximum density | After standing Minimum density (fogging) | After standing Maximum density |
|---|---|---|---|---|---|---|
| 1 (Comparison) | 65 | Without addition | 0.34 | 2.24 | 0.42 | 2.26 |
| 2 (Comparison) | 53 | A-45 ($1.0 \times 10^{-3}$) | 0.40 | 2.31 | 0.59 | 2.37 |
| 3 (Comparison) | 52 | A-45 ($5.0 \times 10^{-3}$) | 0.57 | 2.35 | 0.84 | 2.41 |
| 4 (Comparison) | 56 | A-49 ($1.0 \times 10^{-3}$) | 0.39 | 2.26 | 0.53 | 2.31 |
| 5 (Comparison) | 61 | A-4 ($1.0 \times 10^{-3}$) A-45 ($1.0 \times 10^{-3}$) | 0.35 | 2.22 | 0.48 | 2.26 |
| 6 (Comparison) | 51 | A-49 ($1.0 \times 10^{-3}$) A-6 ($1.0 \times 10^{-3}$) | 0.38 | 2.31 | 0.55 | 2.38 |
| 7 (Comparison) | 40 | A-4 ($1.0 \times 10^{-3}$) Without addition | 0.18 | 2.19 | 0.25 | 2.16 |
| 8 (Comparison) | 31 | Without addition B-4 ($5.0 \times 10^{-3}$) | 0.16 | 2.25 | 0.25 | 2.26 |
| 9 (Invention) | 11 | A-4 ($1.0 \times 10^{-3}$) B-4 ($5.0 \times 10^{-3}$) | 0.12 | 2.20 | 0.14 | 2.22 |
| 10 (Invention) | 9 | A-4 ($1.0 \times 10^{-3}$) B-14 ($5.0 \times 10^{-3}$) | 0.14 | 2.20 | 0.14 | 2.18 |
| 11 (Invention) | 13 | A-4 ($1.0 \times 10^{-3}$) B-30 ($5.0 \times 10^{-3}$) | 0.12 | 2.19 | 0.13 | 2.17 |
| 12 (Invention) | 5 | A-3 ($2.0 \times 10^{-3}$) B-15 ($5.0 \times 10^{-3}$) | 0.13 | 2.22 | 0.14 | 2.23 |
| 13 (Invention) | 7 | A-3 ($2.0 \times 10^{-3}$) B-28 ($5.0 \times 10^{-3}$) | 0.14 | 2.24 | 0.15 | 2.26 |
| 14 (Invention) | 12 | A-45 ($1.0 \times 10^{-3}$) B-4 ($5.0 \times 10^{-3}$) | 0.19 | 2.30 | 0.21 | 2.31 |
| 15 (Invention) | 15 | A-57 ($1.0 \times 10^{-3}$) B-4 ($5.0 \times 10^{-3}$) | 0.17 | 2.28 | 0.19 | 2.27 |
| 16 (Invention) | 16 | A-59 ($1.0 \times 10^{-3}$) B-15 ($5.0 \times 10^{-3}$) | 0.16 | 2.27 | 0.15 | 2.27 |

Preparation of image-receiving member (1)

The image-receiving member (1) was prepared by applying and drying ethylene chloride solution containing polycarbonate (L - 1250; molecular weight, 25000; manufactured by Teijin Kasei Co., Ltd. onto a photographic baryta paper so that the rate of coated polycarbonate became 15.0 g/m$^2$.

The above thermal developing light-sensitive materials (1) through (13) were exposed with the light through optical stepwedge, whereby each material was combined with the image-receiving member (1) then subjected to the thermal developing with a thermal developing machine (Developer module, Model 77, manufactured by 3M) for one minute at 150° C., then immediately the thermal developing light-sensitive material was removed from the image-receiving member. As a result, a step-wedge patterned, magenta-colored negative image was formed on the polycarbonate surface on the image-receiving member. Also, each of the similar light-sensitive materials having been allowed to stand for 30 hours under a high temperature (50° C.) and a high humidity (80% relative humidity) was treated likewise. Then, with the samples both those not allowed to stand and those allowed to stand for 30 hours, the reflective green densities were measured by a photographic densitometer (PDA - 65, manufactured by Konishiroku Photo Industry Co., Ltd.). The minimum densities (fogging), maximum densities, and the desensitization ratios due to standing are listed in Table - 1, wherein the densitization ratio was determined by the following expression.

Standing-oriented desensitization ratio = (1 - post-standing sensitivity/pre-standing sensitivity) × 100 [%]

It is apparent from the results in Table - 1 that, when compared to each of the comparison thermal developing light-sensitive materials not having the compound of the invention or having only one of the compound of the invention represented by general formula (1) and the compound of the invention represented by general formula (2), the thermal developing light-sensitive material of the invention features low fogging in spite of its high maximum density, and shows smaller variation in both the minimum density (fogging) and the maximum density even stored under a high temperature and a high humidity, and that the light-sensitive material of the invention also features a low desensitization ratio. In essence, it is apparent that the thermal developing light-sensitive material of the invention has the excellent shelf life.

EXAMPLE 2

Using the light-sensitive silver halide grains prepared in Example 1, the light-sensitive silver halide dispersion was prepared in a manner identical to that of Example 1, except that the sulfur sensitization for the light-sensitive silver halide dispersion (1) was exercised in the presence of the compound A - 28 of the invention which was used at a rate of $1.0 \times 10^{-3}$ per mol silver halide. Then, the light-sensitive material (14) was prepared in a manner identical to that of Example 1, except that the light-sensitive silver halide dispersion (2) was used in the place of the light-sensitive silver halide dispersion (1).

Additionally, the thermal developing light-sensitive materials (15) through (21) were prepared in a manner identical to that of the thermal developing light-sensitive material, except that the compounds of the invention represented by the general formula (1) or (2) were correspondingly used in compliance with the combinations listed in Table - 2.

Each sample of the above thermal developing light-sensitive materials (14) through (21) was stored under a high temperature and a high humidity identical to those of Example 1, then exposed and subjected to the thermal developing using the image-receiving member (1). The reflective green density of the negative magenta image formed on the image receiving member was measured by a photographic densitometer (PDA - 65, manufactured by Konishiroku Photo Industry Co., Ltd.). The results of minimum densities (fogging), maximum densities, and the desensitization ratios are listed in Table - 2.

TABLE 2

The figure in ( ) indicates the amount of addition per mol silver halide in terms of mol.

| Light-sensitive material Sample No. | Desensitazation ratio (%) | Compounds of formula (1) and (2) | Minimum density (fogging) | Maximum density | After standing Minimum density (fogging) | After standing Maximum density |
|---|---|---|---|---|---|---|
| 14 (Comparison) | 59 | Without addition | 0.28 | 2.20 | 0.36 | 2.26 |
| 15 (Comparison) | 42 | (a) ($1.0 \times 10^{-3}$) | 0.38 | 2.27 | 0.45 | 2.37 |
| 16 (Comparison) | 48 | A-4 ($1.0 \times 10^{-3}$) | 0.27 | 2.13 | 0.38 | 2.17 |
| 17 (Invention) | 9 | B-4 ($5.0 \times 10^{-3}$) | 0.13 | 2.23 | 0.15 | 2.26 |
| 18 (Invention) | 11 | B-5 ($5.0 \times 10^{-3}$) | 0.14 | 2.22 | 0.16 | 2.24 |
| 19 (Invention) | 11 | B-8 ($5.0 \times 10^{-3}$) | 0.14 | 2.20 | 0.14 | 2.26 |
| 20 (Invention) | 9 | A-3 ($1.0 \times 10^{-3}$) B-15 ($5.0 \times 10^{-3}$) | 0.13 | 2.21 | 0.16 | 2.22 |
| 21 (Invention) | 7 | B-5 ($3.0 \times 10^{-3}$) B-15 ($3.0 \times 10^{-3}$) | 0.12 | 2.24 | 0.13 | 2.28 |
| 25 (Invention) | 13 | A-57 ($1.0 \times 10^{-3}$) B-15 ($5.0 \times 10^{-3}$) | 0.15 | 2.31 | 0.15 | 2.30 |

As can be understood from the results in Table - 2, the light-sensitive material of the invention shows excellent performance, even when the compound of the invention represented by the general formula (1) is added in the material before the chemical sensitization.

EXAMPLE 3

Preparation of light-sensitive silver halide dispersion

Using the light-sensitive silver halide grains identical to those of Example 1, three types of silver halide emulsions each spectrally sensitized to have a color sensitivity respectively to blue, green and red were prepared in a manner identical to that of Example 1, except that the above-mentioned spectral sensitizing dye (1) was used as the spectral green sensitizing dye, and that the following spectral sensitizing dyes were used.

Spectral blue sensitizing dye

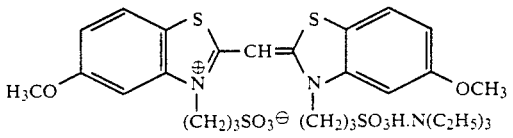

Spectral red sensitizing dye

-continued

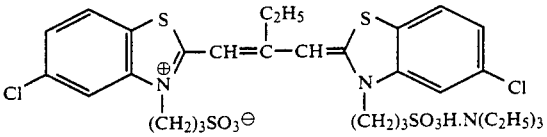

Preparation of yellow dye-supplying-material dispersion (1) and cyan dye-supplying-material dispersion (1)

By replacing 46.9 g of the sample dye-supplying material (PM - 4) respectively with 23.3 g of yellow dye-supplying material (PM - 1) and 45.9 g of cyan dye-supplying material (PM - 5), yellow dye-supplying material dispersion (1) and cyan dye-supplying material dispersion (1) were correspondingly prepared.

Preparation of anti-color stain agent dispersion (1)

25.0 g of anti-color stain agent (SC - 1) was dissolved in 80 ml of ethyl acetate, which was blended with 254 ml of aqueous solution containing 50 ml of 5 weight % Alkanol XC and 12.0 g gelatin, whereby the mixture was emulsified by using an ultrasonic homogenizer, then ethyl acetate was removed by distillation, so as to prepare anti-color stain agent dispersion (1).

Preparation of yellow filter dye dispersion (1)

20.0 g of yellow filter dye having the following chemical structure was dissolved in 120 ml of ethyl acetate, which was blended with 250 ml of aqueous solution containing 50 ml of 5 weight % Alkanol XC and 9.0 g/l of phenylcarbamoyl gelatin, whereby the mixture was emulsified by using an ultrasonic homogenizer, then ethyl acetate was removed by distillation, so as to prepare 300 ml of yellow filter dye dispersion (1).

Yellow filter dye

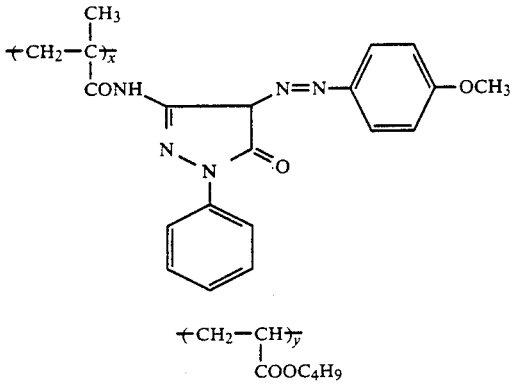

x:y = 1:1 (weight ratio)

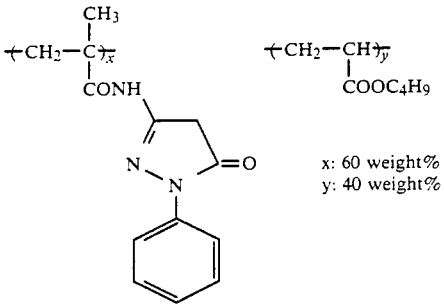

x: 60 weight%
y: 40 weight%

SC-1

Using these dispersions, the thermal developing light-sensitive materials (22) through (31) independently having the multi-layer constitution listed in Table - 3 were prepared, when the compounds of the invention respectively represented by the general formulae (1) and (2) were added, in compliance with the combination listed in Table - 4, into the corresponding materials.

The above thermal developing light-sensitive materials (22) through (31) were exposed with the 2000 CMS exposure through optical step-wedge, whereby each material was combined with the image-receiving member (1) then subjected to the thermal developing with a thermal developing machine (Developer module, Model 277, manufactured by 3M) for one minute at 150° C., then immediately the thermal developing light-sensitive material was removed from the image-receiving member. With each sample, the blue-, green- and red-reflective densities on the polycarbonate surface of image-receiving member were measured by a photographic densitometer (PDA - 65, manufactured by Konishiroku Photo Industry, Co., Ltd.). The results are listed in Table - 5.

TABLE 3

| The figure in ( ) represents the coated amount per one $m^2$ | |
|---|---|
| Protective layer | Gelatin (0.94 g), phenylcarbamoyl gelatin (0.16 g), poly-N-pyrolidone (0.32 g), reducing agent R - 11 (0.22 g), p-tolamide (1.22 g) |
| Blue-sensitive emulsion layer | Blue-sensitive silver iodo-bromide (silver-converted value, 0.43 g), 5-methylbenzotriazole silver (1.45 g), yellow dye-supplying material PM - 1 (0.94 g), reducing agent R - 11 (0.60 g), di-t-octylhydroquinone (0.10 g), gelatin (1.30 g), phenylcarbamoyl gelatin (0.43 g), poly-N-vinylpyrolidone (0.87 g), p-tolamide (2.17 g), polyethylene glycol (1.08 g) |
| Intermediate layer | Anti-color stain agent (0.20 g), yellow filter dye (0.56 g), reducing agent R - 11 (0.22 g), gelatin (0.49 g), phenylcarbamoyl gelatin (0.28 g), poly-N-pyrolidone (0.32 g), p-tolamide (0.81 g), polyethylene glycol (0.41 g) |
| Green-sensitive emulsion layer | Green-sensitive silver iodo-bromide (silver-converted value, 0.29 g), 5-methylbenzotriazole silver (0.96 g), magenta dye-supplying material PM - 4 (1.26 g), reducing agent R - 11 (0.40 g), di-to-octylhydroquinone (0.07 g), gelatin (0.87 g), phenylcarbamoyl gelatin (0.87 g), poly-N-vinylpyrolidone (0.58 g), p-tolamide (1.45 g), polyethylene glycol (0.72 g) |
| Intermediate layer | Anti-color stain agent (0.20 g), reducing agent R - 11 (0.22 g), gelatin (0.49 g), phenylcarbamoyl gelatin (0.16 g), poly-N-pyrolidone (0.32 g), p-tolamide (0.81 g), polyethylene glycol (0.41 g) |
| Red-sensitive emulsion layer | Red-sensitive silver iodo-bromide (silver-converted value, 0.43 g), 5-methylbenzotriazole silver (1.45 g), cyan dye-supplying material PM - 5 (1.84 g), reducing agent R - 11 (0.60 g), di-t-octylhydroquinone (0.10 g), gelatin (1.30 g), phenylcarbamoyl gelatin (0.43 g), poly-N-vinylpyrolidone (0.87 g), p-tolamide (2.17 g), polyethylene glycol (1.08 g) |
| Subbing layer | Gelatin (0.49 g), phenylcarbamoyl gelatin (0.16 g), poly-N-pyrolidone (0.32 g), reducing agent R - 11 (0.22 g) |
| Support | 180 μm thick transparent polyethylene terephthalate film having latex undercoat |

These layers independently contain small amount of surface active agent as well as gelatin hardener in addition to the above components.

TABLE 4

The figure in ( ) represents the amount of addition per mol silver halide [mol] or amount coated [g/cm$^2$].

| Sample No. | Subbing layer | Red-sensitive emulsion layer | | Intermediate layer | Green-sensitive emulsion layer | |
|---|---|---|---|---|---|---|
| 22 (Comparison) | Without addition | Without addition | | Without addition | Without addition | |
| 23 (Comparison) | Without addition | (a) ($1.0 \times 10^{-3}$) | | Without addition | (a) ($1.0 \times 10^{-3}$) | |
| 24 (Comparison) | Without addition | A-2 ($1.0 \times 10^{-3}$) | | Without addition | A-2 ($1.0 \times 10^{-3}$) | |
| 25 (Comparison) | A-2 ($1.0 \times 10$) | A-2 ($1.0 \times 10^{-3}$) | | A-2 ($1.0 \times 10^{-3}$) | A-2 ($1.0 \times 10^{-3}$) | |
| 26 (Comparison) | Without addition | B-5 ($5.0 \times 10^{-3}$) | | Without addition | B-5 ($5.0 \times 10^{-3}$) | |
| 27 (Invention) | Without addition | A-2 ($1.0 \times 10^{-3}$) | B-5 ($5.0 \times 10^{-3}$) | Without addition | A-2 ($1.0 \times 10^{-3}$) | B-5 ($5.0 \times 10^{-3}$) |
| 28 (Invention) | Without addition | A-3 ($1.0 \times 10^{-3}$) | B-14 ($5.0 \times 10^{-3}$) | Without addition | A-3 ($1.0 \times 10^{-3}$) | B-14 ($5.0 \times 10^{-3}$) |
| 29 (Invention) | Without addition | A-4 ($1.0 \times 10^{-3}$) | B-30 ($5.0 \times 10^{-3}$) | Without addition | A-4 ($1.0 \times 10^{-3}$) | B-30 ($5.0 \times 10^{-3}$) |
| 30 (Invention) | A-4 ($1.0 \times 10^{-3}$) | A-4 ($1.0 \times 10^{-3}$) | B-4 ($5.0 \times 10^{-3}$) | A-4 ($1.0 \times 10^{-3}$) | A-4 ($1.0 \times 10^{-3}$) | B-4 ($5.0 \times 10^{-3}$) |
| 31 (Invention) | A-4 ($1.0 \times 10^{-3}$) | B-4 ($6.0 \times 10^{-3}$) | | A-4 ($1.0 \times 10^{-3}$) | B-4 ($6.0 \times 10^{-3}$) | |
| 36 (Invention) | Without addition | A-45 ($1.0 \times 10^{-3}$) | B-4 ($5.0 \times 10^{-3}$) | Without addition | A-45 ($1.0 \times 10^{-3}$) | B-4 ($5.0 \times 10^{-3}$) |
| 37 (Invention) | A-47 ($1.0 \times 10^{-3}$) | B-4 ($6.0 \times 10^{-3}$) | | A-3 ($1.0 \times 10^{-3}$) | B-4 ($6.0 \times 10^{-3}$) | |

| Sample No. | Intermediate layer | Blue-sensitive emulsion layer | | Protective layer |
|---|---|---|---|---|
| 22 (Comparison) | Without addition | Without addition | | Without addition |
| 23 (Comparison) | Without addition | (a) ($1.0 \times 10^{-3}$) | | Without addition |
| 24 (Comparison) | Without addition | A-2 ($1.0 \times 10^{-3}$) | | Without addition |
| 25 (Comparison) | A-2 ($1.0 \times 10^{-3}$) | A-2 ($1.0 \times 10^{-3}$) | | A-2 ($1.0 \times 10^{-3}$) |
| 26 (Comparison) | Without addition | B-5 ($5.0 \times 10^{-3}$) | | Without addition |
| 27 (Invention) | Without addition | A-2 ($1.0 \times 10^{-3}$) | B-5 ($5.0 \times 10^{-3}$) | Without addition |
| 28 (Invention) | Without addition | A-3 ($1.0 \times 10^{-3}$) | B-14 ($5.0 \times 10^{-3}$) | Without addition |
| 29 (Invention) | Without addition | A-4 ($1.0 \times 10^{-3}$) | B-30 ($5.0 \times 10^{-3}$) | Without addition |
| 30 (Invention) | A-4 ($1.0 \times 10^{-3}$) | A-4 ($1.0 \times 10^{-3}$) | B-4 ($5.0 \times 10^{-3}$) | A-4 ($1.0 \times 10^{-3}$) |
| 31 (Invention) | A-4 ($1.0 \times 10^{-3}$) | B-4 ($6.0 \times 10^{-3}$) | | A-4 ($1.0 \times 10^{-3}$) |
| 36 (Invention) | Without addition | A-45 ($1.0 \times 10^{-3}$) | B-4 ($5.0 \times 10^{-3}$) | Without addition |
| 37 (Invention) | B-4 ($1.0 \times 10^{-3}$) | A-3 ($6.0 \times 10^{-3}$) | | B-4 ($1.0 \times 10^{-3}$) |

TABLE 5

| Light-sensitive material Sample No. | Before standing | | After standing | |
|---|---|---|---|---|
| | Minimum density (fogging) | Maximum density | Minimum density (fogging) | Maximum density |
| 22 (Comparison) | B 0.36 | B 2.05 | B 0.47 | B 2.09 |
| | G 0.29 | G 1.96 | G 0.36 | G 1.99 |
| | R 0.32 | R 2.03 | R 0.42 | R 2.04 |
| 23 (Comparison) | B 0.54 | B 2.11 | B 0.64 | B 2.14 |
| | G 0.39 | G 2.01 | G 0.46 | G 2.05 |
| | R 0.45 | R 2.06 | R 0.55 | R 2.10 |
| 24 (Comparison) | B 0.29 | B 2.01 | B 0.36 | B 1.96 |
| | G 0.22 | G 1.94 | G 0.31 | G 1.88 |
| | R 0.24 | R 1.98 | R 0.34 | R 1.90 |
| 25 (Comparison) | B 0.25 | B 1.98 | B 0.36 | B 1.93 |
| | G 0.18 | G 1.93 | G 0.30 | G 1.88 |
| | R 0.20 | R 1.96 | R 0.33 | R 1.90 |
| 26 (Comparison) | B 0.26 | B 2.08 | B 0.32 | B 2.02 |
| | G 0.18 | G 2.00 | G 0.26 | G 1.96 |
| | R 0.20 | R 2.02 | R 0.28 | R 1.98 |
| 27 (Invention) | B 0.22 | B 2.11 | B 0.21 | B 2.12 |
| | G 0.16 | G 2.02 | G 0.15 | G 2.05 |
| | R 0.18 | R 2.07 | R 0.18 | R 2.08 |
| 28 | B 0.23 | B 2.09 | B 0.23 | B 2.10 |

TABLE 5-continued

| Light-sensitive material Sample No. | Before standing | | After standing | |
|---|---|---|---|---|
| | Minimum density (fogging) | Maximum density | Minimum density (fogging) | Maximum density |
| (Invention) | G 0.17 | G 2.00 | G 0.18 | G 2.02 |
| | R 0.19 | R 2.04 | R 0.19 | R 2.05 |
| 29 | B 0.21 | B 2.08 | B 0.22 | B 2.10 |
| (Invention) | G 0.16 | G 1.99 | G 0.17 | G 2.00 |
| | R 0.18 | R 2.03 | R 0.19 | R 2.05 |
| 30 | B 0.21 | B 2.07 | B 0.23 | B 2.06 |
| (Invention) | G 0.16 | G 1.99 | G 0.18 | G 1.99 |
| | R 0.17 | R 2.04 | R 0.19 | R 2.03 |
| 31 | B 0.22 | B 2.10 | B 0.22 | B 2.11 |
| (Invention) | G 0.17 | G 2.02 | G 0.16 | G 2.01 |
| | R 0.19 | R 2.06 | R 0.18 | R 2.05 |
| 36 | B 0.27 | B 2.21 | B 0.29 | B 2.22 |
| (Invention) | G 0.25 | G 2.19 | G 0.26 | G 2.18 |
| | R 0.23 | R 2.16 | R 0.23 | R 2.16 |
| 37 | B 0.22 | B 2.15 | B 0.22 | B 2.14 |
| (Invention) | G 0.20 | G 2.11 | G 0.21 | G 2.10 |
| | R 0.18 | R 2.12 | R 0.18 | R 2.11 |

It is apparent from the results in Table - 5 that, when compared to each of the comparison thermal developing light-sensitive materials not having the compound of the invention or having only one of the compound of the invention represented by general formula (1) and the compound of the invention represented by general formula (2), the thermal developing light-sensitive material of the invention features limited fluctuation in the minimum density (fogging) as well as the maximum density even when stored under a high temperature and a high humidity. In essence, it is apparent that the thermal developing light-sensitive material of the invention has the excellent shelf life.

EXAMPLE 4

30.0 g of example dye-supplying material 17 was dissolved in a mixture of 30.0 g dimethyluramide 90.0 ml ethyl acetate, which was blended with 800 ml of aqueous solution containing 100 ml of 5 weight % Alkanol XC (manufactured by DuPont) and 36.0 g gelatin, whereby the mixture was emulsified by using an ultrasonic homogenizer, then ethyl acetate was removed by distillation, and water was added, so as to prepare 900 ml of yellow dye-supplying-material dispersion (2). In a similar manner, with example dye-supplying materials and 16 , magenta dye-supplying-material dispersion (2) and cyan dye-supplying material dispersion (2) were correspondingly prepared.

30.0 g of the following anti-color stain agent (SC - 2) was dissolved in a mixture of 15.0 g tricresyl phosphate and ethyl acetate, which was blended with 500 ml of aqueous solution containing 50 ml of 5 weight % Alkanol XC and 20.0 g gelatin, whereby the mixture was emulsified by using an ultrasonic homogenizer, then ethyl acetate was removed by distillation, so as to prepare 600 ml of anti-color stain agent dispersion (2).

Anti-color stain agent (SC-2)

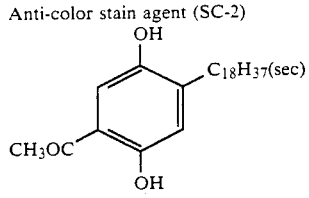

Using these dispersion, as well as silver halide emulsions and 5-methylbenzotriazole silver emulsions both identical to those in Example 4 the multi-layered thermal developing light-sensitive materials (32) through (41) whose layer constitutions being listed in Table - 6 were prepared. Additionally, the compounds listed in Table - 7 were added into the corresponding light-sensitive materials.

TABLE 6

| The figure in ( ) represents an amount coated per $m^2$ | |
|---|---|
| Second protective layer | Gelatin (0.36 g), $SiO_2$ (0.24 g) |
| First protective layer | Gelatin (0.44 g), anti-color stain agent SC - 2 (0.2 g) |
| Blue-sensitive emulsion layer | Blue-sensitive silver iodo-bromide (silver-converted value, (0.38 g), 5-methylbenzotriazole silver (0.85 g), example dye-supplying material (0.7 g), reducing agent R' (10 mg), potassium 2-sec-pentadecylhydroquinone-5-sulfonate (0.1 g), gelatin (0.70 g), phenylcarbamoyl gelatin (0.70 g), polyethylene glycol (0.25 g), guanidinetrichloroacetic acid (0.60 g) |
| Intermediate layer | Anti-color stain agent SC - 2 (0.4 g), guanidinetrichloroacetic acid (0.15 g), gelatin (0.40 g), phenylcarbamoyl gelatin (0.28 g) |
| Green-sensitive emulsion layer | Green-sensitive silver iodo-bromide (silver-converted value, 0.50 g), 5-methylbenzotriazole silver (1.11 g), example dye-supplying material (0.5 g), reducing agent R' (13 mg), potassium 2-sec-pentadecylhydroquinone-5-sulfonate (0.1 g), gelatin (0.60 g), phenylcarbamoyl gelatin (0.60 g), polyethylene glycol (0.2 g), guanidinetrichloroacetic acid (0.75 g) |
| Intermediate layer | Anti-color stain agent SC - 2 (0.4 g), guanidinetrichloroacetic acid (0.15 g), gelatin (0.40 g), phenylcarbamoyl gelatin |

TABLE 6-continued

| The figure in ( ) represents an amount coated per $m^2$ | |
|---|---|
| | (0.28 g) |
| Red-sensitive emulsion layer | Red-sensitive silver iodo-bromide (silver-converted value, 0.62 g), 5-methylbenzotriazole silver (1.38 g), example dye-supplying material (0.4 g), reducinq agent R' (16 mg), potassium 2-sec-pentadecylhydroquinone-t-sulfonate (0.1 g), gelatin (0.70 g), phenylcarbamoyl gelatin (0.70 g), polyethylene glycol (0.2 g), guanidinetrichloroacetic acid (0.90 g) |
| Support | 180 μm thick transparent polyethylene terephthalate film having latex undercoat |

These layers independently contain small amounts of surface active agent as well as gelatin hardener in addition to the above components.
R': 4-hydroxymethyl-4-methyl-1-phenyl-3-pyrazolidinone

TABLE 7

| The figure in ( ) represents the amount of addition per mol silver halide [mol] or amount coated [g/$cm^2$]. | | | | | |
|---|---|---|---|---|---|
| Sample No. | Red-sensitive emulsion layer | | Intermediate layer | Green-sensitive emulsion layer | |
| 32 (Comparison) | Without addition | | Without addition | Without addition | |
| 33 (Comparison) | (b) ($1.0 \times 10^{-3}$) | | Without addition | (b) ($1.0 \times 10^{-3}$) | |
| 34 (Comparison) | A-3 ($1.0 \times 10^{-3}$) | | Without addition | A-3 ($1.0 \times 10^{-3}$) | |
| 35 (Comparison) | B-28 ($5.0 \times 10^{-3}$) | | Without addition | B-28 ($1.0 \times 10^{-3}$) | |
| 36 (Comparison) | A-3 ($1.0 \times 10^{-3}$) | (b) ($5.0 \times 10^{-3}$) | Without addition | A-3 ($1.0 \times 10^{-3}$) | (b) ($5.0 \times 10^{-3}$) |
| 37 (Invention) | A-3 ($1.0 \times 10^{-3}$) | B-5 ($5.0 \times 10^{-3}$) | Without addition | A-3 ($1.0 \times 10^{-3}$) | B-5 ($5.0 \times 10^{-3}$) |
| 38 (Invention) | A-3 ($1.0 \times 10^{-3}$) | B-34 ($5.0 \times 10^{-3}$) | Without addition | A-3 ($1.0 \times 10^{-3}$) | B-34 ($5.0 \times 10^{-3}$) |
| 39 (Invention) | A-4 ($1.0 \times 10^{-3}$) | B-4 ($5.0 \times 10^{-3}$) | Without addition | A-4 ($1.0 \times 10^{-3}$) | B-4 ($5.0 \times 10^{-3}$) |
| 40 (Invention) | A-4 ($1.0 \times 10^{-3}$) | B-15 ($5.0 \times 10^{-3}$) | A-3 ($1.0 \times 10^{-3}$) | A-4 ($1.0 \times 10^{-3}$) | B-15 ($5.0 \times 10^{-3}$) |
| 41 | B-34 ($5.0 \times 10^{-3}$) | | A-3 ($1.0 \times 10^{-3}$) | B-34 ($5.0 \times 10^{-3}$) | |
| 48 (Invention) | A-45 ($1.0 \times 10^{-3}$) | B-4 ($5.0 \times 10^{-3}$) | Without addition | A-45 ($1.0 \times 10^{-3}$) | B-4 ($5.0 \times 10^{-3}$) |

| Sample No. | Intermediate layer | Blue-sensitive emulsion layer | | First protective layer | Second protective layer |
|---|---|---|---|---|---|
| 32 (Comparison) | Without addition | Without addition | | Without addition | Without addition |
| 33 (Comparison) | Without addition | (b) ($1.0 \times 10^{-3}$) | | Without addition | Without addition |
| 34 (Comparison) | Without addition | A-3 ($1.0 \times 10^{-3}$) | | Without addition | Without addition |
| 35 (Comparison) | Without addition | B-28 ($1.0 \times 10^{-3}$) | | Without addition | Without addition |
| 36 (Comparison) | Without addition | A-3 ($1.0 \times 10^{-3}$) | (b) ($5.0 \times 10^{-3}$) | Without addition | Without addition |
| 37 (Invention) | Without addition | A-3 ($1.0 \times 10^{-3}$) | B-5 ($5.0 \times 10^{-3}$) | Without addition | Without addition |
| 38 (Invention) | Without addition | A-3 ($1.0 \times 10^{-3}$) | B-34 ($5.0 \times 10^{-3}$) | Without addition | Without addition |
| 39 (Invention) | Without addition | A-4 ($1.0 \times 10^{-3}$) | B-4 ($5.0 \times 10^{-3}$) | Without addition | Without addition |
| 40 (Invention) | A-3 ($1.0 \times 10^{-3}$) | A-4 ($1.0 \times 10^{-3}$) | B-15 ($5.0 \times 10^{-3}$) | A-3 ($1.0 \times 10^{-3}$) | Without addition |
| 41 | A-3 ($1.0 \times 10^{-3}$) | B-34 ($5.0 \times 10^{-3}$) | | A-3 ($1.0 \times 10^{-3}$) | Without addition |
| 48 (Invention) | Without addition | A-45 ($1.0 \times 10^{-3}$) | B-4 ($5.0 \times 10^{-3}$) | Without addition | Without addition |

Next, by sequentially applying and drying the following layers onto a paper support having a 200 μm thick polyethylene coat, so as to prepared the image-receiving member (2).

(1) Neutralization layer having polyacrylic acid (7.0 g/$m^2$)
(2) Timing layer having cellulose acetate (4.0 g/$m^2$)
(3) Layer having a copolymer (3.0 g/$m^2$) comprising styrene and N-benzyl-N,N-dimethyl-N-(3-maleidepropyl) ammonium chloride at a ratio of 1:1, and acid-treated gelatin (3.0 g/$m^2$)
(4) Layer having urea (4.0 g/$m^2$) and polyvinyl alcohol (saponification rate, 98%) (3.0 g/$m^2$)

These layers independently contain small amounts of surface active agent as well as gelatin hardener in addition to the above components.

The above thermal developing light-sensitive materials (32) through (41) were exposed with the 4000 CMS exposure through optical step-wedge, whereby each material was combined with the previously mentioned image-receiving member (2) then subjected to the thermal developing with a thermal developing machine for one minute at 140° C., then immediately the thermal developing light-sensitive material was removed from the image-receiving member. With each sample, the reflective density of the transfer dye image formed on an image-receiving member was measured by a photographic densitometer (PDA - 65, manufactured by Konishiroku Photo Industry Co., Ltd.). The results are listed in Table - 8.

TABLE 8

| Light-sensitive material Sample No. | Before standing | | After standing | |
|---|---|---|---|---|
| | Minimum density (fogging) | Maximum density | Minimum density (fogging) | Maximum density |
| 32 | B 0.18 | B 2.06 | B 0.27 | B 1.73 |
| (Comparison) | G 0.16 | G 2.01 | G 0.23 | G 1.69 |
| | R 0.17 | R 1.98 | R 0.25 | R 1.68 |
| 33 | B 0.32 | B 2.01 | B 0.54 | B 2.19 |
| (Comparison) | G 0.29 | G 2.07 | G 0.51 | G 2.16 |
| | R 0.31 | R 2.04 | R 0.54 | R 2.15 |
| 34 | B 0.13 | B 1.98 | B 0.20 | B 2.03 |
| (Comparison) | G 0.12 | G 1.94 | G 0.19 | G 1.97 |
| | R 0.12 | R 1.89 | R 0.20 | R 1.94 |
| 35 | B 0.12 | B 2.09 | B 0.19 | B 2.12 |
| (Comparison) | G 0.11 | G 2.06 | G 0.17 | G 2.08 |
| | R 0.12 | R 2.01 | R 0.18 | R 2.03 |
| 36 | B 0.26 | B 1.96 | B 0.43 | B 2.08 |
| (Comparison) | G 0.23 | G 1.92 | G 0.37 | G 2.06 |
| | R 0.24 | R 1.86 | R 0.39 | R 2.00 |
| 37 | B 0.12 | B 2.08 | B 0.13 | B 2.09 |
| (Invention) | G 0.09 | G 2.04 | G 0.11 | G 2.05 |
| | R 0.11 | R 2.02 | R 0.12 | R 2.03 |
| 38 | B 0.11 | B 2.07 | B 0.12 | B 2.09 |
| (Invention) | G 0.10 | G 2.04 | G 0.12 | G 2.05 |
| | R 0.11 | R 2.01 | R 0.13 | R 2.01 |
| 39 | B 0.12 | B 2.09 | B 0.12 | B 2.10 |
| (Invention) | G 0.09 | G 2.05 | G 0.10 | G 2.07 |
| | R 0.10 | R 2.03 | R 0.11 | R 0.24 |
| 40 | B 0.11 | B 2.06 | B 0.11 | B 2.05 |
| (Invention) | G 0.09 | G 2.02 | G 0.10 | G 2.02 |
| | R 0.09 | R 2.00 | R 0.10 | R 2.00 |
| 41 | B 0.12 | B 2.07 | B 0.13 | B 2.08 |
| (Invention) | G 0.10 | G 2.04 | G 0.11 | G 2.06 |
| | R 0.11 | R 2.02 | R 0.11 | R 2.05 |
| 48 | B 0.15 | B 2.14 | B 0.16 | B 2.15 |
| (Invention) | G 0.14 | G 2.10 | G 0.14 | G 2.09 |
| | R 0.13 | R 2.08 | R 0.14 | R 2.08 |

It is apparent from the results in Table - 8, the thermal developing light-sensitive material of the invention features a high density, suppressed fogging, and does not show deteriorated fogging even when stored under a high temperature and a high humidity, and the maximum density is stably maintained. In essence, it is apparent that the thermal developing light-sensitive material of the invention has the excellent shelf life.

What is claimed is:

1. A thermal developing light-sensitive material comprising:

(a) a support; and (b) one or more photographic structural layers provided on the support and including at least one layer containing light-sensitive silver-halide, said one or more photographic structural layers containing (i) a reducing agent, (ii) a compound represented by formula (1);

Formula (1)

$$X_1—L_1—A$$

wherein $X_1$ represents a residual group of a photographic fog restrainer, $L_1$ is a valency bond or a divalent group, and A is selected from the group consisting of a hydrogen atom, an amino group, a hydroxyl group, a carboxyl group or a salt thereof, a sulfo group or a salt thereof, and a sulfin group or a salt thereof; and (iii) a compound represented by formula (2);

Formula (2)

$$X_2—L_2—B$$

wherein $X_2$ represents a residual group of a photographic fog restrainer, $L_2$ is a divalent group selected from the group consisting of an alkylene group having 1 to 7 carbon atoms, an alkenylene group, an arylene group, an imino group, a carbonyl group, a sulfonyl group, an ether group, and mixtures thereof, and B is a ballast group wherein said ballast group is an aliphatic or aromatic hydrocarbon group having at least 8 carbon atoms.

2. The thermal developing light-sensitive material of claim 1, wherein said residual group of a photographic fog restrainer is selected from a residual group of an organic compound of which silver salt has a pKsp (−log Ksp) of more than 10, provided that Ksp is a solubility product thereof in water of 25° C.

3. The thermal developing light-sensitive material of claim 1, wherein said residual group represented by $X_1$ or $X_2$ is a mono-valent residue of a photographic fog restrainer represented by formula (4) or (8) below;

Formula (4)

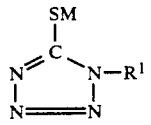

wherein $R^1$ is selected from the group consisting of a hydrogen atoms, an alkyl group having 1 to 7 carbon atoms, and an aryl group, n is 1 or 2, $R^2$ and $R^3$ are independently selected from the group consisting of of a hydrogen atom, an alkyl group having 1 to 7 carbon atoms, an aryl group having 1 to 7 carbon atoms and a nitro group provided that $R^2$ and $R^3$ may be combined with each other to form a 5- or 6-membered ring;

formula (8)

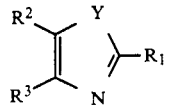

wherein Y is selected from the group consisting of oxygen, sulfur, a

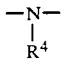

group and a

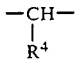

group, $R^1$ is a thiol group or a $—NHR^4$ group, $R^2$ and $R^3$ are independently selected from the group consisting of a hydrogen atom, an alkyl group having 1 to 7 carbon atoms, an aryl group having 1 to 7 carbon atoms and a nitro group provided that $R^2$ and $R^3$ may be combined with each other to form a 5- or 6-membered ring and $R^4$ is selected from the group consisting of a hydrogen, an alkyl group having 1 to 7 carbon atoms and an aryl group.

4. The thermal developing light-sensitive material of claim 1, wherein $L_1$ in formula (1) and is selected from the group consisting of an alkylene group having 1 to 7 carbon atoms, an alkenylene group, an arylene group, an imino group, a carbonyl group, a sulfonyl group, an ether group and any combination thereof.

5. The thermal developing light-sensitive material of claim 1, wherein said compound represented by general formula (1) is selected from the group of compounds represented by formula (19);

Formula (19)

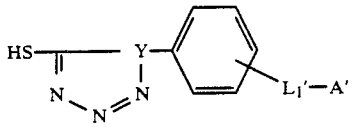

wherein, $L_1'$ and A' respectively have the same meanings as $L_1$ and A in formula (1) and Y is a nitrogen atom or a carbon atom.

6. The thermal developing light-sensitive material of claim 1, wherein said ballast group has 8 to 40 carbon atoms.

7. The thermal developing light-sensitive material of claim 1, wherein said ballast group is an alkyl group having 8 to 40 carbon atoms.

8. The thermal developing light-sensitive material of claim 1, wherein said ballast group is an alkyl group substituted by a hydrophilic group consisting of a sulfo group and having 8 to 30 carbon atoms.

9. The thermal developing light-sensitive material of claim 1, wherein said compound represented by formula (1) is contained in said material in a quantity of $10^{-7}$ to $10^{-1}$ mol with respect to 1 mol of said light-sensitive silver halide.

10. The thermal developing light-sensitive material of claim 9, wherein said compound represented by formula (1) is contained in said material in a quantity of $10^{-5}$ to $10^{-2}$ mol with respect to 1 mol o f said light-sensitive silver halide.

11. The thermal developing light-sensitive material of claim 1, wherein said compound represented by formula (2) is contained in said material in a quantity of $10^{-5}$ to $10^{-1}$ mol with respect to 1 mol of said light-sensitive silver halide.

12. The thermal developing light-sensitive material of claim 11, wherein said compound represented by formula (2) is contained in said material in a quantity of $10^{-4}$ to $10^{-2}$ mol with respect to 1 mol of said light-sensitive silver halide.

* * * * *

UNITED STATES PATENT AND TRADEMARK OFFICE

CERTIFICATE OF CORRECTION

PATENT NO. : 5,032,499

DATED : July 16, 1991

INVENTOR(S) : Junichi KOHNO et al.

It is certified that error appears in the above-identified patent and that said Letters Patent is hereby corrected as shown below:

On the Title page of the patent, insert the following related U.S. application data: --Continuation of Ser. No. 07/277,503, Nov. 28, 1988, abandoned, which is a cont. of Ser. No. 07/082,288, Aug. 6, 1987, abandoned.--

Claim 3, column 95, line 9, after "hydrogen" change "atoms" to --atom--.

Claim 3, column 95, line 11, change "of of" to --of--.

Claim 4, column 95, line 46, before "is" delete "and".

Claim 10, column 96, line 36, change "o f" to --of--.

Signed and Sealed this

Twentieth Day of July, 1993

*Attest:*

Michael K. Kirk

MICHAEL K. KIRK

*Attesting Officer*

*Acting Commissioner of Patents and Trademarks*